US006608980B2

(12) United States Patent
Murayama et al.

(10) Patent No.: US 6,608,980 B2
(45) Date of Patent: Aug. 19, 2003

(54) ELECTROPHOTOGRAPHIC IMAGE FORMING APPARATUS TO WHICH A PROCESS CARTRIDGE IS DETACHABLY MOUNTABLE AND PROCESS CARTRIDGE COMPRISING CARTRIDGE DRUM POSITIONING PORTION OR RECESS

(75) Inventors: Kazunari Murayama, Suntoh-gun (JP); Hisayoshi Kojima, Mishima (JP); Atsushi Numagami, Hadano (JP); Takahito Ueno, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/749,818

(22) Filed: Dec. 28, 2000

(65) Prior Publication Data

US 2001/0021320 A1 Sep. 13, 2001

(30) Foreign Application Priority Data

Dec. 28, 1999 (JP) ..... 11-373300
Dec. 27, 2000 (JP) ..... 2000-373323

(51) Int. Cl.[7] ..... G03G 15/00; G03G 21/16

(52) U.S. Cl. ..... 399/111

(58) Field of Search ..... 399/110, 111, 399/112, 116, 117

(56) References Cited

U.S. PATENT DOCUMENTS

| | | | | |
|---|---|---|---|---|
| 4,344,700 A | * | 8/1982 | Kasama et al. | 399/117 |
| 4,714,337 A | * | 12/1987 | Nishino et al. | 399/111 X |
| 4,839,690 A | * | 6/1989 | Onoda et al. | 399/117 |
| 4,922,297 A | * | 5/1990 | Kondo | 399/117 |
| 4,972,227 A | * | 11/1990 | Onoda et al. | 399/116 |
| 5,023,660 A | * | 6/1991 | Ebata et al. | 399/111 |
| 5,128,715 A | * | 7/1992 | Furuyama et al. | 399/116 |
| 5,235,383 A | | 8/1993 | Tada et al. | 355/200 |
| 5,249,026 A | | 9/1993 | Kojima | 355/327 |
| 5,283,616 A | | 2/1994 | Numagami et al. | 355/245 |
| 5,383,011 A | | 1/1995 | Numagami et al. | 355/298 |
| 5,442,421 A | | 8/1995 | Kojima | 355/211 |
| 5,471,284 A | | 11/1995 | Fujii et al. | 355/210 |
| 5,497,220 A | | 3/1996 | Inomata et al. | 355/245 |
| 5,500,714 A | | 3/1996 | Yashiro et al. | 355/200 |
| 5,521,693 A | | 5/1996 | Kojima et al. | 355/326 R |
| 5,543,898 A | | 8/1996 | Shishido et al. | 355/210 |
| 5,617,579 A | | 4/1997 | Yashiro et al. | 399/114 |
| 5,689,774 A | | 11/1997 | Shishido et al. | 399/111 |
| 5,768,658 A | | 6/1998 | Watanabe et al. | 399/111 |
| 5,790,923 A | | 8/1998 | Oguma et al. | 399/106 |
| 5,920,753 A | | 7/1999 | Sasaki et al. | 399/111 |
| 5,937,239 A | | 8/1999 | Watanabe et al. | 399/111 |

(List continued on next page.)

FOREIGN PATENT DOCUMENTS

| | | |
|---|---|---|
| EP | 0 738 940 | 10/1996 |
| EP | 0 833 232 | 4/1998 |
| JP | 10-90967 | 4/1998 |
| JP | 10-241112 | 9/1998 |

*Primary Examiner*—Fred L Braun
(74) *Attorney, Agent, or Firm*—Fitzpatrick, Cella, Harper & Scinto

(57) ABSTRACT

A process cartridge detachably mountable to a main assembly of an electrophotographic image forming apparatus includes: a cartridge frame; an electrophotographic photosensitive drum supported on the cartridge frame; a process device actable on the photosensitive drum; a cartridge drum positioning portion for positioning the photosensitive drum to the main assembly of the apparatus by engagement with a main assembly drum positioning portion provided in the main assembly of the apparatus when the process cartridge is mounted to the main assembly of the apparatus; and a cartridge frame positioning portion for positioning the cartridge frame to the main assembly of the apparatus by engagement with a main assembly frame positioning portion provided in the main assembly of the apparatus when the process cartridge is mounted to the main assembly of the apparatus.

26 Claims, 33 Drawing Sheets

U.S. PATENT DOCUMENTS

| | | | | |
|---|---|---|---|---|
| 5,937,242 | A | 8/1999 | Yokoyama et al. | 399/114 |
| 5,940,657 | A | 8/1999 | Yokomori et al. | 399/119 |
| 5,950,049 | A | 9/1999 | Yokomori et al. | 399/119 |
| 5,963,759 | A | 10/1999 | Kojima et al. | 399/111 |
| 5,966,566 | A | 10/1999 | Odagawa et al. | 399/109 |
| 5,966,568 | A | 10/1999 | Numagami et al. | 399/111 |
| 6,006,058 | A | 12/1999 | Watanabe et al. | 399/167 |
| 6,016,413 | A | 1/2000 | Yokoyama et al. | 399/113 |
| 6,029,032 | A | 2/2000 | Watanabe et al. | 399/111 |
| 6,072,969 | A | 6/2000 | Yokomori et al. | 399/119 |
| 6,097,908 | A | 8/2000 | Uchiyama et al. | 399/111 |
| 6,097,909 | A | 8/2000 | Watanabe et al. | 399/111 |
| 6,101,354 | A | 8/2000 | Nakagawa et al. | 399/225 |
| 6,118,960 | A | 9/2000 | Nakagawa et al. | 399/111 |
| 6,131,007 | A | 10/2000 | Yamaguchi et al. | 399/256 |
| 6,131,011 | A | 10/2000 | Kojima et al. | 399/351 |
| 6,157,792 | A | 12/2000 | Mori et al. | 399/24 |
| 6,169,866 | B1 | 1/2001 | Watanabe et al. | 399/111 |

* cited by examiner

ELECTROPHOTOGRAPHIC IMAGE FORMING APPARATUS TO WHICH A PROCESS CARTRIDGE IS DETACHABLY MOUNTABLE AND PROCESS CARTRIDGE COMPRISING CARTRIDGE DRUM POSITIONING PORTION OR RECESS

FIELD OF THE INVENTION AND RELATED ART

The present invention relates to an electrophotographic image forming apparatus and a process cartridge removably installable in the main assembly of an electrophotographic image forming apparatus.

Here, the term "electrophotographic image forming apparatus" refers to an apparatus that forms an image on recording medium with the use of an electrophotographic image forming method. As an example of an electrophotographic image forming apparatus, an electrophotographic copying machine, an electrophotographic printer (for example, a laser beam printer, an LED printer, and the like), a facsimile apparatus, a word processor, and the like can be included.

A process cartridge is: a cartridge, in which a charging means, either a developing means or a cleaning means, and an electrophotographic photosensitive member, are integrally placed, and which is removably installable in the main assembly of an image forming apparatus; a cartridge in which at least one of the processing means among a charging means, a developing means, and a cleaning means, and an electrophotographic photosensitive drum, are integrally placed, and which is removably installable in the main assembly of an image forming apparatus; or a cartridge in which at least a developing means among the aforementioned processing means, and an electrophotographic photosensitive member, are integrally placed, and which is removably installable in the main assembly of an image forming apparatus.

Conventionally, an electrophotographic image forming apparatus which employs an electrophotographic image forming process employs a process cartridge system, according to which an electrophotographic photosensitive member, and a single or a plurality of the aforementioned processing means, are integrally placed in a cartridge removably installable in the main assembly of an image forming apparatus. According to this process-cartridge system, an image forming apparatus can be maintained by the users themselves, without relying on service personnel, remarkably improving operational efficiency. Thus, a process-cartridge system is widely used in the field of an image forming apparatus.

In a process cartridge such as the one described above, a photosensitive drum is driven by the main assembly of an image forming apparatus, and the force for rotationally driving a development sleeve is transmitted to the development sleeve from the photosensitive drum. The force for rotationally driving a stirring member is transmitted also from the photosensitive drum through a gear train.

In recent years, an image forming apparatus that employs an electrophotographic image forming process has been developed to produce a high quality image without sacrificing its operational efficiency.

SUMMARY OF THE INVENTION

The present invention is a result of further development of the aforementioned conventional technologies.

The primary object of the present invention is to provide a process cartridge, the electrophotographic photosensitive drum of which is superior in rotational accuracy to a conventional one, and an electrophotographic image forming apparatus in which such a process cartridge is removably installable.

Another object of the present invention is to provide a process cartridge which can be more accurately positioned relative to the main assembly of an image forming apparatus than a conventional process cartridge, when the process cartridge is installed into the image forming apparatus, and an electrophotographic image forming apparatus in which such a process cartridge is removably installable.

Another object of the present invention is to provide a process cartridge, the electrophotographic photosensitive drum and cartridge frame of which are positioned, independently from each other, relative to the main assembly of an image forming apparatus when the process cartridge is installed into the image forming apparatus, and an electrophotographic image forming apparatus in which such a process cartridge can be removably installable.

Another object of the present invention is to provide a process cartridge in which the rotational load is smaller than in a conventional process cartridge, when the electrophotographic photosensitive drum rotates as the force for driving the electrophotographic photosensitive drum is transmitted from the main assembly of an image forming apparatus, and an electrophotographic image forming apparatus in which such a process cartridge can be removably installable.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

In the following description of the embodiments of the present invention, the term "longitudinal direction" means the direction that is perpendicular to the direction in which the recording medium is conveyed, and is parallel to the recording medium. The terms "left" and "right" correspond to the left and right sides of the recording medium when the recording medium is seen from above, and the trailing edge of the recording medium. A term "top side of a process cartridge" means the top side of the process cartridge when the process cartridge is in the main apparatus of an image forming apparatus.

Figure 1:
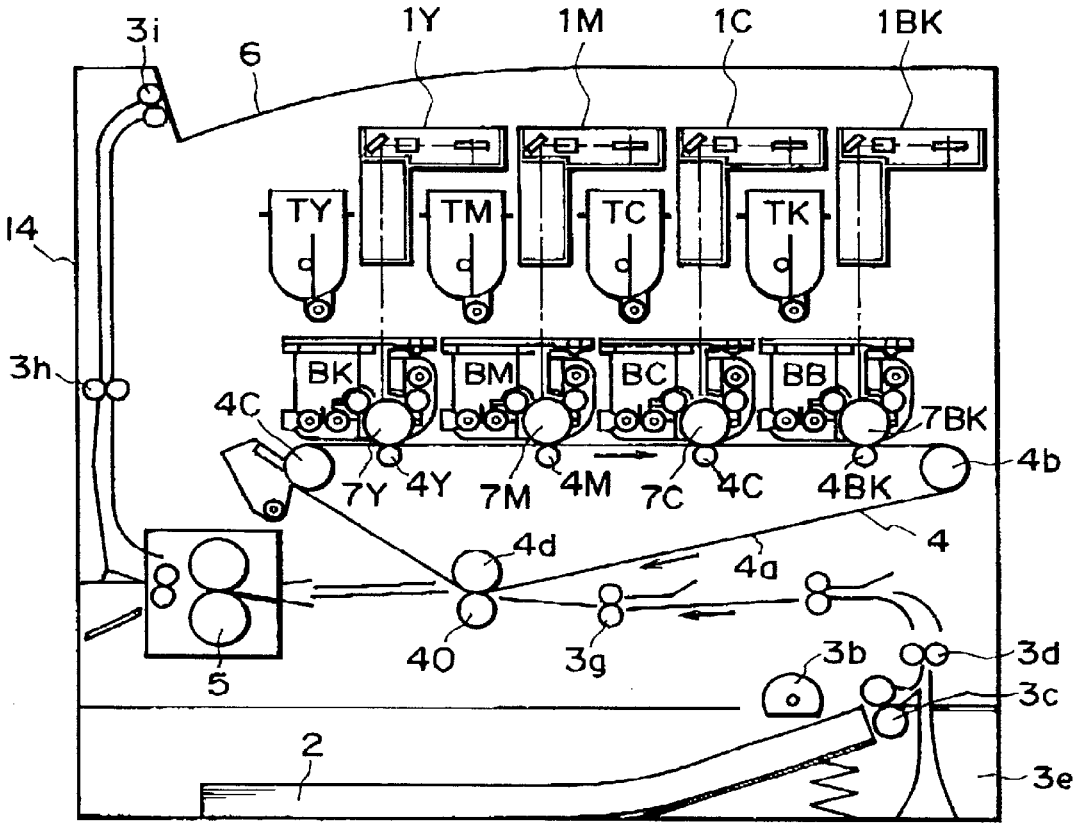
FIG. 1 is a vertical sectional view of an electrophotographic image forming apparatus.

FIG. 1 is a drawing which depicts one of the electrophotographic image forming apparatuses in accordance with the present invention. This image forming apparatus has: image forming portions that form toner images on a photosensitive drum as an image bearing member; an intermediary transfer belt 4*a* onto which the toner images are temporarily transferred; a secondary transfer roller 40 as a transferring means for transferring the toner images on the belt 4*a* onto a recording medium 2; a sheet feeding means for feeding the recording medium 2 into the image forming apparatus main assembly; a conveying means for conveying the recording medium to the transferring means, and more specifically, delivering the recording medium between the intermediary transfer belt 4*a* and secondary transfer roller 40; a fixing means; and a sheet discharging means.

Next, the image formation operation in this image forming apparatus will be described.

As shown in the drawing, there is a sheet feeder cassette in the image forming apparatus. The sheet feeder cassette can hold plural sheets of a recording medium 2 (for example, recording paper, an OHP sheet, fabric, and the like), and is removably installable in the main assembly of an image forming apparatus. After having been fed into the image forming apparatus main assembly by a pickup roller 3*b* from the sheet feeder cassette, each recording medium 2 is separated from the following recording media 2 by a retarding roller pair 3*c*, and conveyed to a registration roller pair 3*g* by conveying rollers 3*d*.

When the recording medium 2 is conveyed to the registration roller pair 3*g*, the registration roller pair 3*g* is not in motion, and the skewing of the recording medium 2 is eliminated as the recording medium 2 is bumped against the nip formed between the two registration rollers 3*g*.

In a full-color, image-formation system based on four drums, four process cartridges, that is, a process cartridge BK for yellow color, a process cartridge BM for magenta color, a process cartridge BC for cyan color, and a process cartridge BB for black color, each of which has an image bearing member, are placed in parallel to each other in an image forming apparatus, as shown in the drawing. The image forming apparatus is also provided with optical scanning systems 1Y, 1M, 1C, and 1Bk, which correspond to the process cartridges BK, BM, BC, and BB, one for one in the listed order. A toner image is formed on the photosensitive drum of each of the four process cartridges, by image formation signals. Then, the four toner images, different in color, are transferred in layers onto the intermediary transfer belt 4*a*, which is running in the direction indicated by an arrow mark, by the transfer rollers 4 (4Y, 4M, 4C, and 4Bk).

Thereafter, the recording medium 2 is delivered to the secondary transfer roller 40 with a predetermined timing, and the toner images on the intermediary transfer belt 4*a* are transferred onto the recording medium. Then, the toner images are fixed to the recording medium 2 in the fixing device 5, and the recording medium 2 is discharged into a delivery tray 6 located on top of the apparatus main assembly 14, by discharge roller pairs 3*h* and 3*i*, to be accumulated in the delivery tray 6.

The aforementioned image forming portions, exclusive of the optical scanning systems 1Y, 1M, 1C, and 1Bk, comprise the process cartridges BK, BM, BC, and BB, and toner containers TY, TM, and TC and BK, correspondingly. Since all the process cartridges are the same in structure, the cartridge structure will be described with reference to the process cartridge BK.

Figure 2:
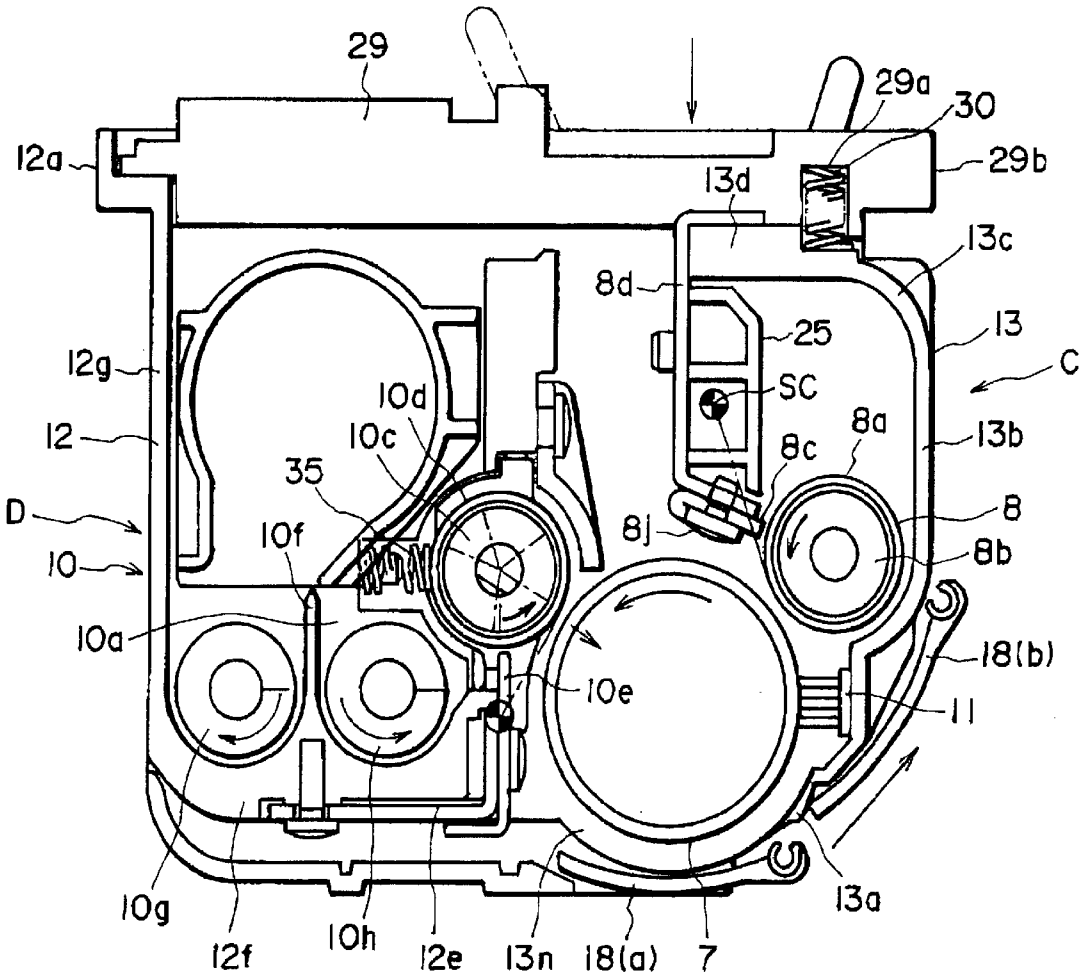
FIG. 2 is a vertical sectional view of a process cartridge.

Referring to FIG. 2, the process cartridge BK comprises the photosensitive drum 7, a charging means, an exposing means, and a developing means. The charging means, exposing means, and developing means are placed in the adjacencies of the peripheral surface of the photosensitive drum 7 in a manner to surround the photosensitive drum 7. Further, the process cartridge BK is provided with an opening for image transfer. In this embodiment, it uses two component developer which contains magnetic carrier particles. Thus, the photosensitive drum 7 used in this embodiment may be an ordinary organic photosensitive member or the like. It is preferable that the photosensitive drum 7 is an organic photosensitive member with a surface layer the electrical resistance of which is in a range of $10^2$–$10^{14}$ Ω·cm, a photosensitive member based on amorphous silicon, and the like, because such photosensitive members make it possible for electrical charge to be directly injected, and also are effective to prevent ozone generation and to reduce power consumption. In addition, they make it possible to improve charging performance.

Thus, in this embodiment, a photosensitive, drum is which comprised an aluminum drum as a base member, and a layer of organic photosensitive material placed on the peripheral surface of the aluminum drum, was used as the photosensitive drum 7.

The charging means is a charging device 8 based on a magnetic brush formed of a magnetic carrier. The charging device 8 comprises a rotatably supported charge roller 8*a* in the form of a hollow cylinder, and a magnet 8*b* fixedly placed in the charge roller 8*a*. After image transfer, the toner remaining on the photosensitive drum 7 is taken into the charging device 8, which rotates in the direction indicated by an arrow mark in the drawing.

As for the developing means, a developing method in which a layer of two component developer is placed in contact with the peripheral surface of the photosensitive drum 7 (two component, noncontact development) was used.

FIG. 2 shows the developing means 10 in this embodiment, which develops an electrostatic latent image with the use of a magnetic brush formed of two component developer. The development roller 10*d* is in the form of a follower cylinder, and is rotatably supported. Within the development roller 10*d*, a magnet 10*c* is fixedly placed. The development roller 10*d* rotates in the same direction as the photosensitive drum 7; in the area in which the distance between the peripheral surfaces of the development roller 10*d* and photosensitive drum 7 is the smallest, the peripheral surfaces of the development roller 10*d* and photosensitive drum 7 move in the opposite directions. The photosensitive drum 7 and development roller 10*d* are not placed in contact with each other; a gap within a range of 0.2–1.0 mm is provided between the two, so that only the layer of developer makes contact with the photosensitive drum 7 to develop an electrostatic latent image.

A mixture toner and carrier is supplied to the development roller 10*d* by stirring screws 10*g* and 10*h* located in a casing partitioned with a partition wall 10*f*. There is provided a gap between each of the longitudinal ends of the partition wall 10*f*, and the corresponding wall of the casing. As toner is supplied from an unillustrated toner supplying container, it falls into the adjacencies of one of the longitudinal ends of the stirring screw 10*g*, and then is conveyed to the other longitudinal end of the stirring screw 10*g*, in other words, the other side of the casing, while being stirred. After reaching the other side of the casing, the toner is moved through the gap between the longitudinal end of the partition wall 10*f* and the corresponding wall of the casing, into the space in which the stirring screw 10*h* is present, and is returned to the side where it landed from the toner supplying container, while being stirred, by the stirring screw 10*h*, and is moved through the gap between the partition wall 10*f* and the corresponding wall of the casing, into the space in which the stirring screw 10*g* is present. In other words, the toner is circulated, while being stirred, within the casing by the stirring screws 10*g* and 10*h*.

Described next will be the development process in which an electrostatic latent image formed on the photosensitive drum 7 is developed into a visible image, with the use of the developing apparatus 4 which uses a developing method based on a magnetic brush formed of two component developer composed of toner and magnetic carrier, and a developer circulating system. First, as the development roller 10*d* is rotated, a certain amount of the developer is picked up in a layer onto the peripheral surface of the development roller 10*d* by the force of the magnet 10*c*, and is carried in the rotational direction of the development roller 10*d*. As the layer of developer on the development roller 10*d* is carried in the rotational direction of the development roller 10*d*, it is regulated in thickness by a regulating blade 10*e*, that is, a development blade, positioned perpendicular to the peripheral surface of the development roller 10*d*. As a result, a thin layer of developer is formed on the development roller 10*d*. As this thin layer of developer reaches the primary pole of the magnet 10*c* for image development, a certain portion of the thin layer of developer is formed into a brush by the magnetic force. The electrostatic latent image on the photosensitive drum 7 is developed by this portion of developer in the form of a brush. Thereafter, this portion of developer on the development roller 10*d* is returned into the developing means container 10*a* by the magnetic field the polarity of which is opposite to the primary pole.

To the development roller 10*d*, DC voltage and AC voltage are applied from an unillustrated power source. Generally speaking, in a two component developing method, the application of AC voltage increases development efficiency, and also improves image quality. However, it is liable to cause fog. Thus, a certain amount of difference in potential level is provided between the DC voltage applied to the development roller 10*d* and the surface potential of the photosensitive drum 7, so that toner is prevented from adhering to the non-image areas of the peripheral surface of the photosensitive drum 7.

This toner image is transferred onto the intermediary transfer belt 4*a* by an intermediary transferring apparatus 4. The intermediary transferring apparatus 4 comprises an endless belt 4*a*, which is stretched around a driver roller 4*b*, a follower roller 4*c*, and a counter roller 4*d* for the secondary transfer roller 40, and is circularly driven in the direction indicated by an arrow mark in FIG. 1. Within the loop of the transfer belt 4*a*, transfer charge rollers 4Y, 4M, 4C, and 4Bk are disposed, each of which is kept under a predetermined amount of pressure generated from inward side of the loop toward the axial line of the corresponding photosensitive drum, with the endless belt 4*a* pinched between the transfer charge roller and the photosensitive drum. As voltage is applied to each transfer charge roller from a high voltage power source, the endless belt 4*a* is charged from the inward side of the endless belt loop to the polarity opposite to the toner charge polarity. As a result, the toner image on each photosensitive drum is transferred onto the surface of the intermediary transfer belt 4*a*, on the outward side of the endless loop.

As for the material for the intermediary transfer belt 4*a*, polyimide resin may be employed. However, the selection of the belt material does not need to be limited to polyimide resin. For example, the following materials can be used with satisfactory results: plastics such as polycarbonate resin, polyethylene-terephthalate resin, polyvinyliden fluoride resin, polyethylene naphthalate resin, polyether-ether-keton resin, polyether-sulfone resin, and polyurethane resin; and fluorinated or siliconized rubber.

After the transfer of the toner image from the photosensitive drum 7, a certain amount of toner (transfer residual toner) remains on the photosensitive drum 7. If this transfer residual toner is allowed to pass, as it is, through the charging device, the areas of the peripheral surface of the photosensitive drum 7 on which the transfer residual toner is present fail to be charged to a satisfactory potential level, and the following image is produced lighter or darker across the areas corresponding to the preceding image (hereinafter, such an anomaly will be referred to as a "ghost"). In other words, in most cases, even when the transfer residual toner comes into contact with the photosensitive drum charging magnetic brush, which is in contact with the peripheral surface of the photosensitive drum 7, the pattern of the preceding image reflected by the transfer residual toner remains virtually intact. Thus, it is necessary to temporarily collect the transfer residual toner into the magnetic brush based charging device 8 as the transfer residual toner reaches the charge station as the photosensitive drum 7 is rotated, so that the trace of the preceding image is erased. In many cases, the transfer residual toner on the photosensitive drum 7 is a mixture of toner particles with a negative polarity, and toner particles the polarity of which have been changed to a positive polarity by the separation discharge, or the like, during image transfer. However, from the standpoint of ease of the collection of the transfer residual toner into the magnetic brush based charging device 8, all transfer residual toner particles are desired to be positive in polarity.

Thus, in this embodiment, an electrically conductive brush 11 is placed in contact with the peripheral surface of the photosensitive drum 7, between the intermediary transferring apparatus 4 and magnetic brush based charging device 8, to apply a bias opposite in polarity to the charge bias. The positively charged portion of the transfer residual toner passes through the magnetic brush based charging device 8, whereas the negatively charged portion of the transfer residual toner is temporarily captured by the electrically conductive brush 11. The captured portion of the transfer residual toner is deprived of electrical charge by the electrically conductive brush 11, and is sent back onto the photosensitive drum 7. As a result, it becomes easier for the transfer residual toner to be taken in entirety into the magnetic brush.

(Frame Structure of Process Cartridge)

The process cartridge B (BK, BM, BC, and BB) comprises a development unit D, and a charge unit C. The development unit D comprises the photosensitive drum 7, the developing means 10, and a developing means frame 12 in which the preceding two components are integrally disposed. The charge unit C comprises the charge roller 8*a*, the regulating blade 8*c*, the charge brush 11, and the like, and a charging means frame 13 in which the preceding two components are integrally disposed. In assembling the process cartridge B, first, the development unit D and charge unit C are connected to each other, and a front end cover 16 and a rear end cover 17 (FIG. 4) are attached to the combination of the development unit D and charge unit C from the longitudinal direction of the two units to accurately fix the positional relationship between the development unit D and charge unit C.

Figure 3:
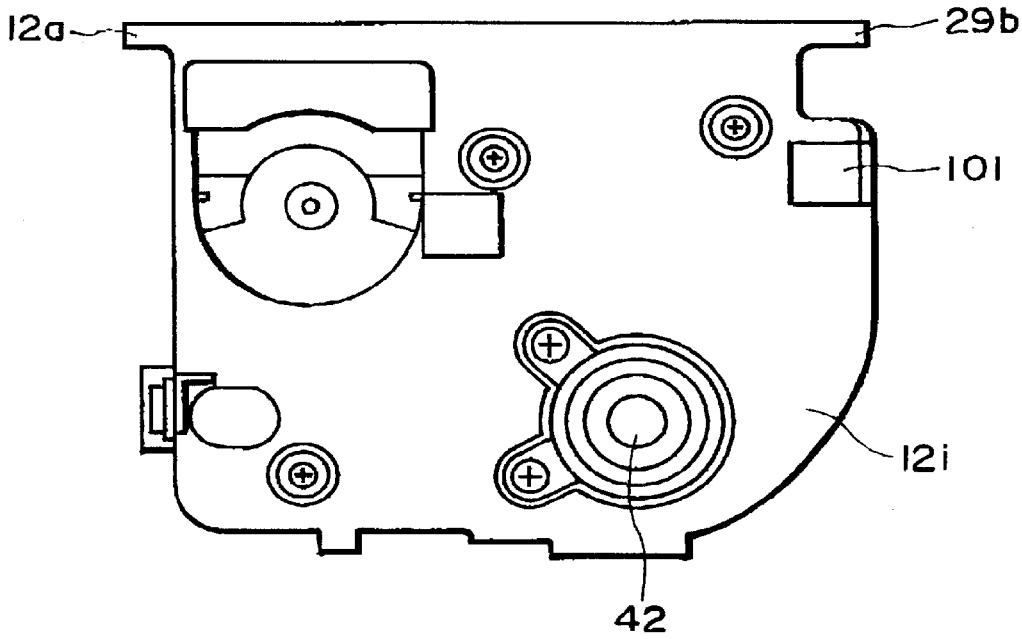
FIG. 3 is a front view of the process cartridge.
Figure 4:
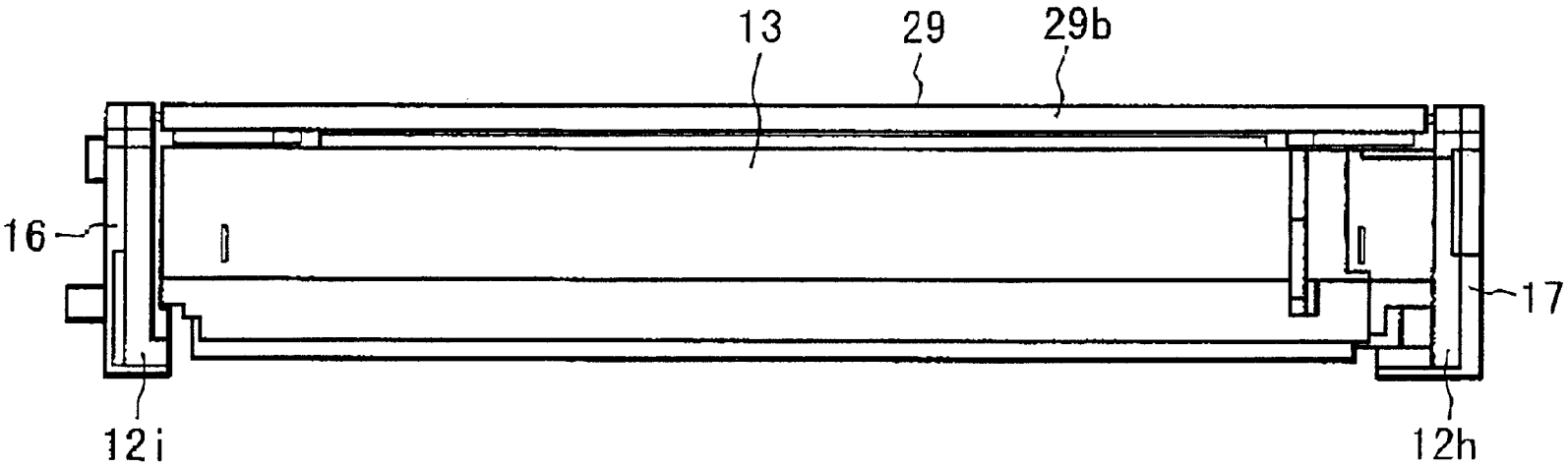
FIG. 4 is a right side view of the process cartridge.
Figure 5:
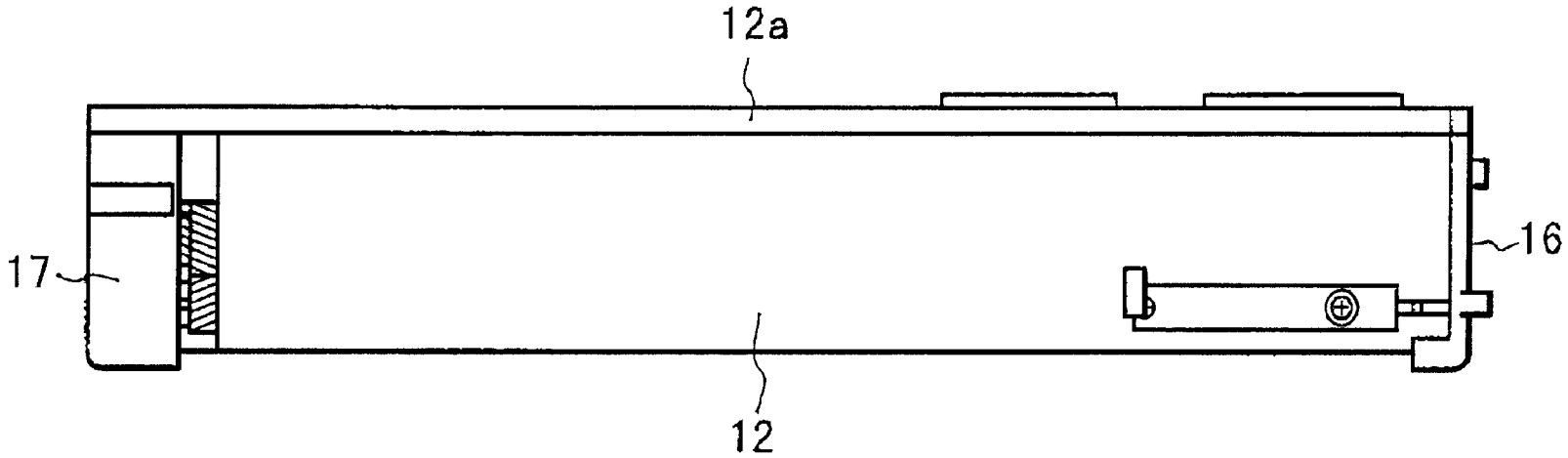
FIG. 5 is a left side view of the process cartridge.
Figure 6:
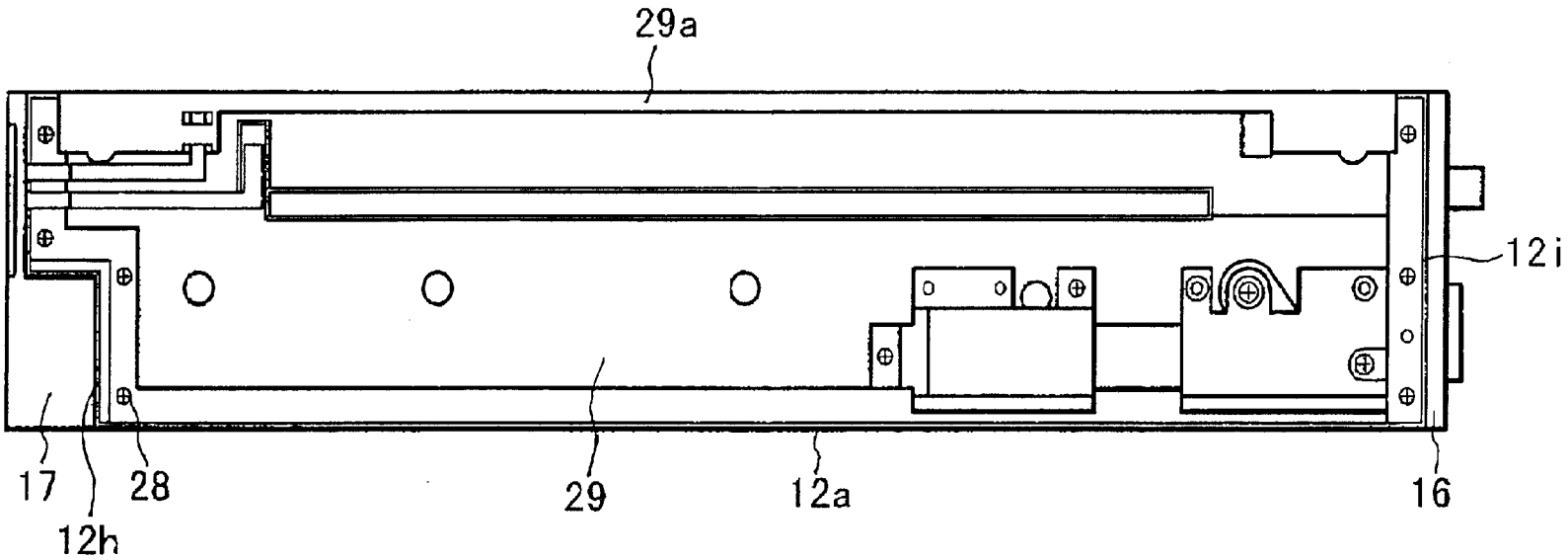
FIG. 6 is a plan view of the process cartridge.
Figure 7:
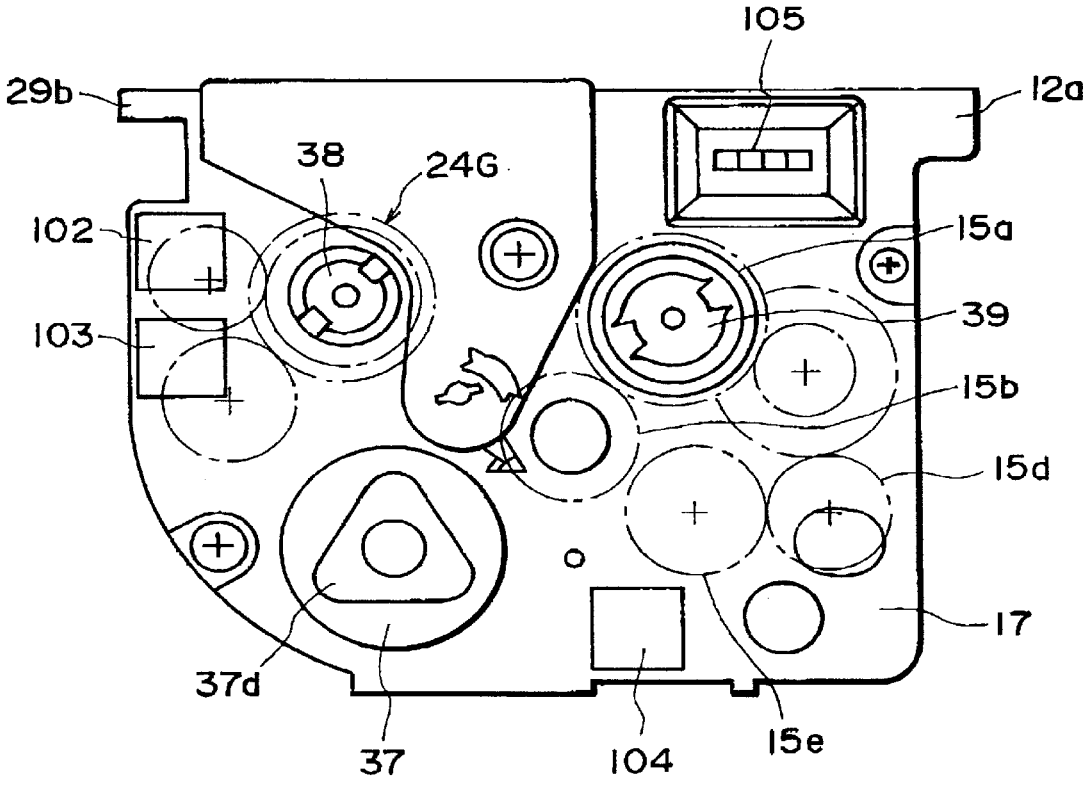
FIG. 7 is a rear side view of the process cartridge.
Figure 8:
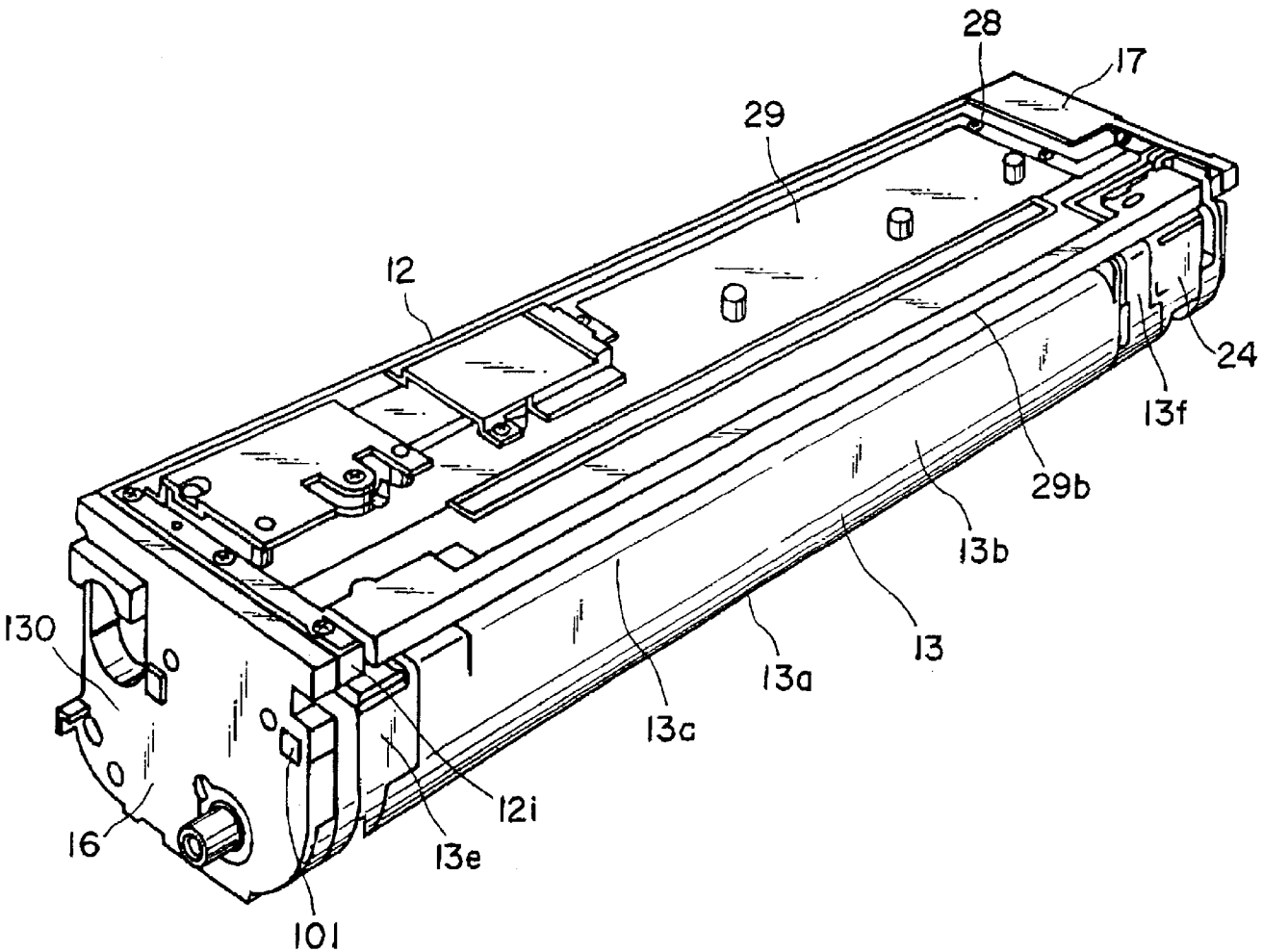
FIG. 8 is a perspective view of the process cartridge as seen from diagonally above the right front.
Figure 9:
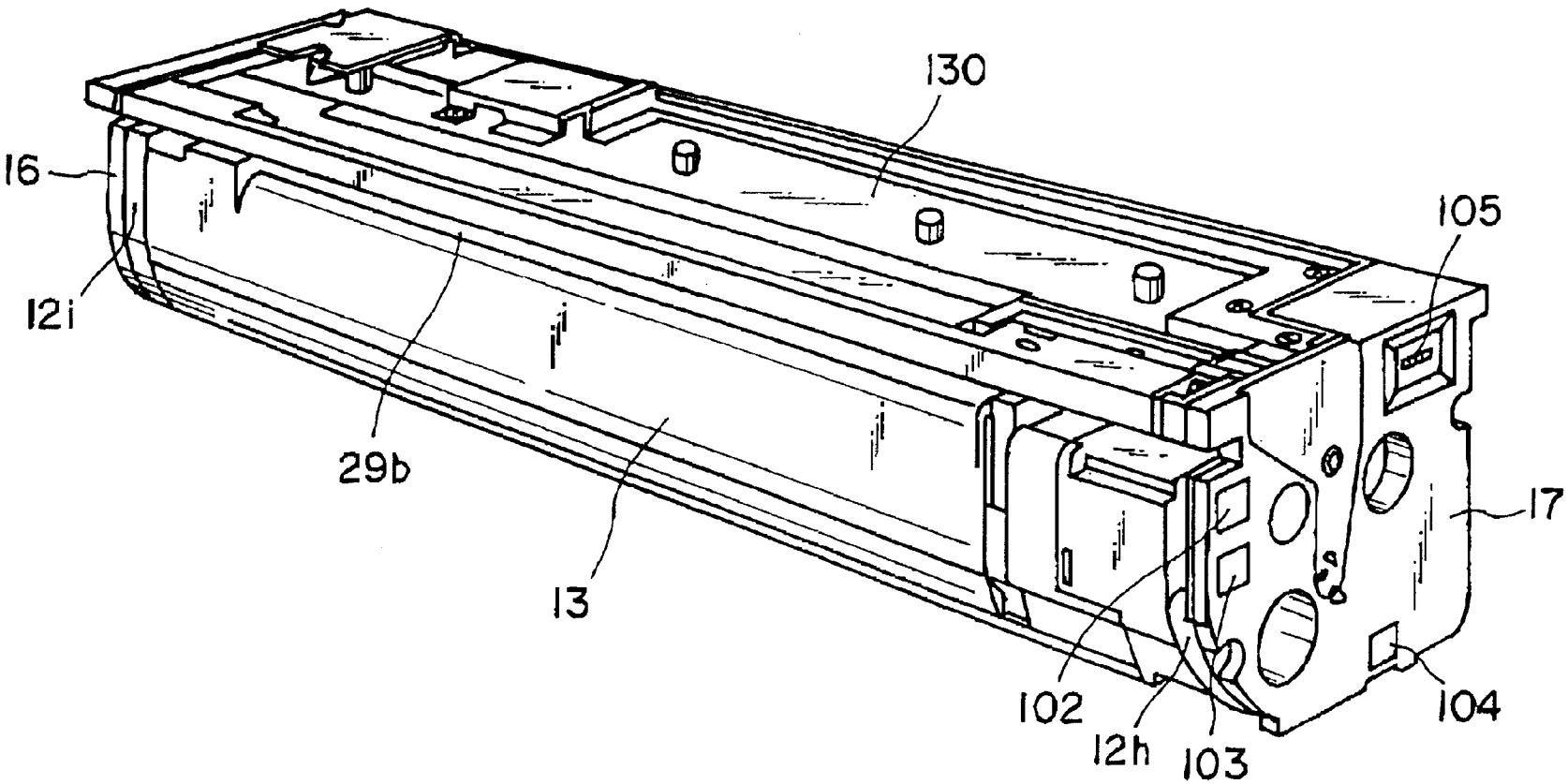
FIG. 9 is a perspective view of a process cartridge as seen from diagonally above the right rear.
Figure 10:
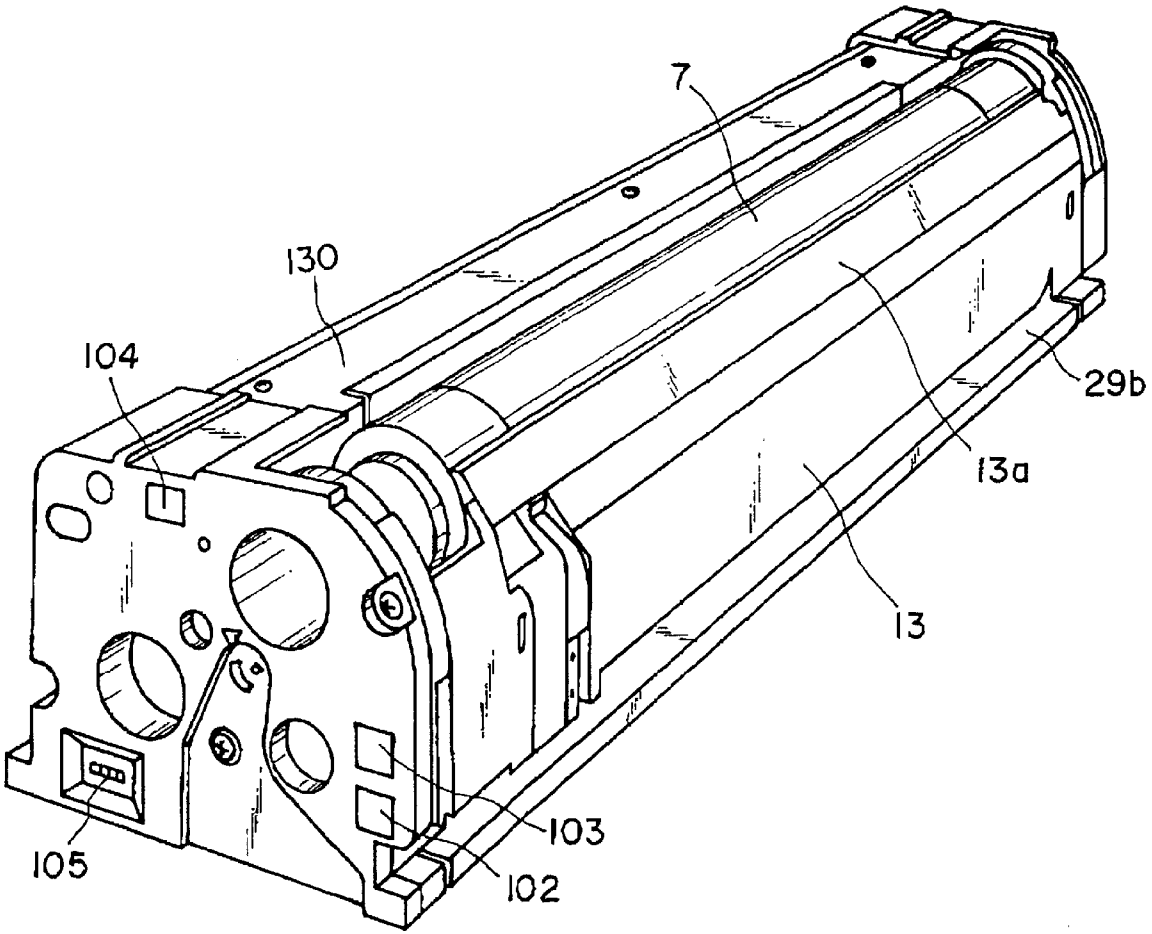
FIG. 10 is a perspective view of a process cartridge as seen from diagonally above the right rear, with the process cartridge placed upside down.

FIGS. 3 to 7 are projection drawings of the process cartridge B (BK, BM, BC, and BB). FIG. 3 is a front view of the process cartridge B; FIG. 4 is a right side view; FIG. 5 is a left side view; FIG. 6 is a plan view; and FIG. 7 is a rear view of the process cartridge. FIGS. 8 to 10 are external perspective views of the process cartridge B. FIG. 8 is a perspective view of the process cartridge B as seen from diagonally above the right front; FIG. 9 is a perspective view as seen from the right rear; and FIG. 10 is a perspective view of the process cartridge B as seen from diagonally above the right rear, with the process cartridge B placed upside down.

As shown in FIG. 2, the charge unit C comprises the charge roller 8*a*, the regulating blade 8*c*, and the electrically conductive brush 11, which are integrally combined with the charging means frame 13. Referring to FIGS. 2, 4, 8, 9, and 10, a portion of the charging means frame 13 constitutes a portion of the shell of the process cartridge B. Referring to FIGS. 2 and 10, the bottom edge 13*a* of the charging means frame 13 is parallel to the longitudinal direction of the photosensitive drum 7, with the provision of a small gap between the bottom edges 13*a* and the peripheral surface of the photosensitive drum 7. From this bottom edge 13*a*, an approximately vertical wall 13*b* extends upward, constituting another part of the shell of the process cartridge B. The top portion of the approximately vertical wall 13*b* is bent inward, forming a corner portion 13*c*. From the corner portion 13*c*, a top plate 13*d* with a roughly key-shaped cross section extends nearly horizontally. There is provided an empty space immediately below the top plate 13*d*. Below the longitudinal ends of the top plate 13*d*, component mounting portions 13*e* and 13*f* are located, in the front and rear, respectively, which also are integral parts of the top plate 13.

Figure 11:
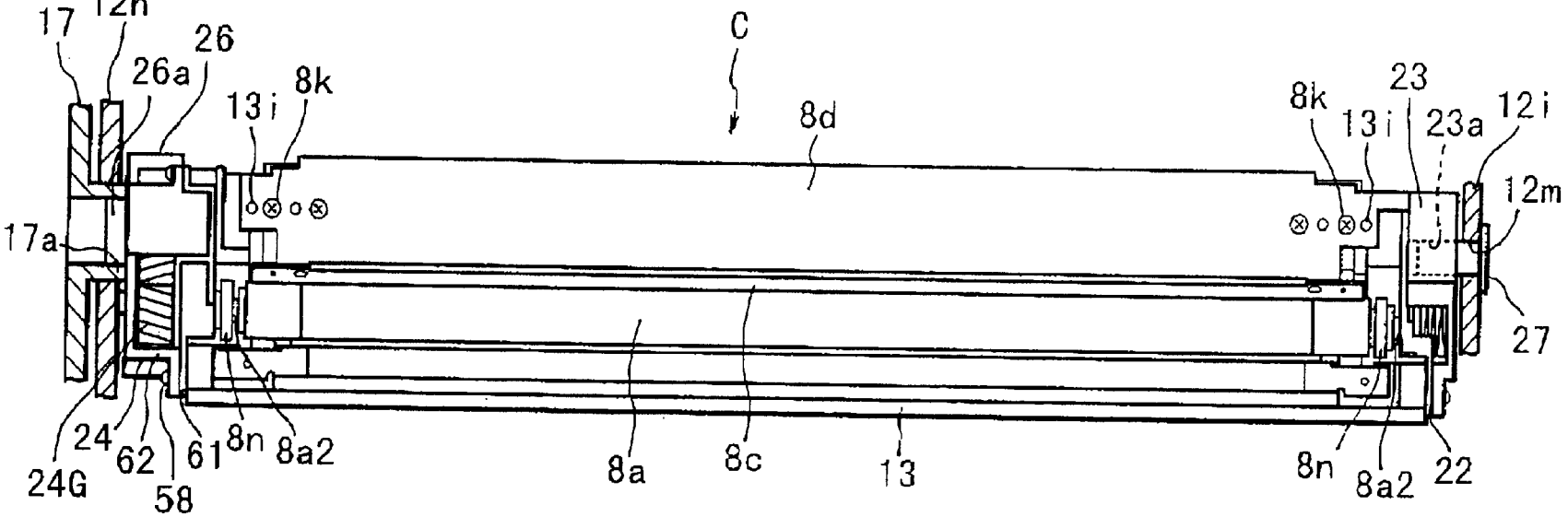
FIG. 11 is a side view of a charging unit.

FIG. 11 is a side view of the charge unit C as seen from the inward side. The front end, or the operator side end, of the charge unit C, with respect to the direction in which the process cartridge B is installed (in the longitudinal direction of the process cartridge B, from the front side of the apparatus main assembly 14) is provided with a charge roller bearing 22 and an end cover 23, which are fixed to the front end of the charge unit C with the same screws. The other end of the charge unit C is provided with a gear unit 24, which is fixed to the rear end of the charge unit C with the use of screws.

Figure 12:
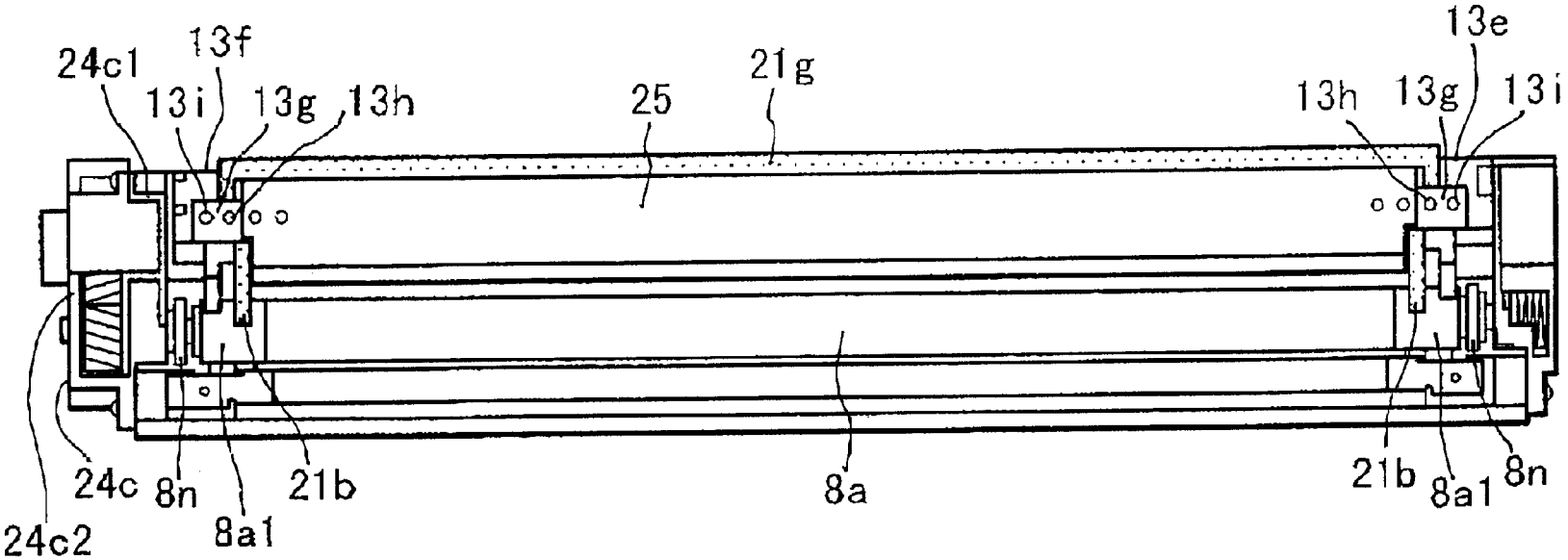
FIG. 12 is a side view of the charging unit in FIG. 11, with its blade removed.

FIG. 12 is a side view of the charge unit C, with the regulating blade 8*c* and the regulating blade supporting metallic plate 8*d* removed. Blade seats 13*g*, which are the portions raised one for one from the side surfaces of the component mounts 13*e* and 13*f*, are provided with a female screw and a dowel-like projection, which are on the flat surfaces to which the regulating blade 8*c* is attached by their longitudinal ends. The flat surface recessed from the surface of the top surface of the blade seat 13*g* is provided with a sealing member 21*g* like a piece of sponge, which is pasted to the flat surface. Further, there is a sealing member 21*b* like a piece of felt at each of the longitudinal ends of the charge roller 8*a*. The sealing member 21*b* is pasted to the charging means frame to prevent developer from leaking outward in the axial direction of the charge roller 8, following the peripheral surfaces of the sealing portions 8*a*1 located at the longitudinal ends of the charge roller 8*a*. Therefore, the surfaces of the portions of the charging means frame 13, which meet the sealing portions 8*a*1 at the longitudinal ends of the charge roller 8*a*, form an arc, the centers of which coincide with that of the charge roller 8*a*.

Referring to FIG. 2, the metallic regulating blade 8*c* is fixed to the regulating blade supporting metallic plates 8*d* with the use of small screws 8*j*, with the provision of a gap between the regulating blade 8*c* and charge roller 8*a*. Both of the regulating blade supporting metallic plates 8*d* are trough-like in cross section, and have two of holes. When attaching each regulating blade supporting metallic plate 8*d* to the blade mount 13*g*, the dowel-like projection 13*i* of the blade seat 13*g* of the charging means frame 13 is put through one of the two holes of the regulating blade supporting metallic plate 8*d*, and a small screw 8*k* is put through the other hole of the regulating blade supporting metallic plate 8*d*, and screwed into the female screw 13*h* of the blade seat 13*g*. As the small screw 8*k* is tightened, not only does the regulating blade supporting metallic plate 8*d* come into contact with the blade seat 13*g*, but also the sealing member 21*a* is compressed by the regulating blade supporting metallic plate 8*d*. Further, the sealing member 21*b* is compressed by the regulating blade supporting metallic plate 8*d*, near the blade seat 13*g*. The regulating blade supporting metallic plate 8*d* is extremely high in rigidity, and therefore, attaching it to the charging means frame 21 by its longitudinal ends improves the charging means frame 21 in rigidity.

(Attaching of Charge Unit)

Referring to FIG. 11, the charge unit C is supported by the developing means frame 12 in such a manner that the charge unit C is allowed to pivot about a pivotal axis SC illustrated in FIG. 2. Thus, the gear case 26 of the gear unit 24 fixed to the inward end of the charging means frame 13, in terms of the longitudinal direction of the charging means frame 13, is provided with a cylindrical bearing portion 26*a*, which is positioned so that its axis coincides with the pivotal axis SC, whereas the end cover 23, at the other longitudinal end of the charging means frame 13, is provided with a cylindrical hole 23*a*, the axis of which coincides with the pivotal axis SC.

Also referring to FIG. 12, the developing means frame 12 can be roughly divided into four sections: a bottom portion 12f, which contains the aforementioned stirring screws 10*g* and 10*h*, in its left and right spaces, respectively, partitioned by the partition wall 10*f*, and having a blade seat 12*e* to which the regulating blade 10*c* is attached; a side portion 12*g*, which constitutes the left portion of the shell of the process cartridge B as seen from the direction from which the process cartridge B is installed; a side plate 12*h* (inward side plate) attached to the rear side of the charge unit C in terms of its longitudinal direction; and side plate 12*i* (front side) attached to the front side of the charge unit C in its longitudinal direction, as shown in FIGS. 13, 14, 17, and 18 as well as in FIG. 2. The end plate 12*h* is provided with a hole 12*j*, through which a bearing is put to rotationally support the cylindrical shaft portion 26*a* of the charge unit C. The end plate 12*i* is provided with a hole 12*m*, the diameter of which is the same as that of the hole 23*a* of the charging means frame 13. Thus, when assembling the process cartridge B, first, the round hole 23 of the charge unit C is aligned with the hole 12*m* of the end plate 12*i* of the developing means frame 12, with the cylindrical shaft portion 26*a* of the charge unit C inserted in the hole 12*j* of the end plate 12*h* of the developing means frame 12. Then, the rear end cover 17, that is, the end cover on the inward side as seen from the direction in which the process cartridge B is inserted, is aligned with the rear end portion of the developing means frame 13. This allows a hollow, cylindrical, and shaft supporting portion 17*a* (FIGS. 11 and 15), which projects in the longitudinal direction of the developing means frame 13 from the inward side of the rear end cover 17, to fit into the hole 12*j* of the developing means frame 12, while allowing the hollow, cylindrical, and shaft-supporting portion 17*a* to fit around the cylindrical shaft portion 26*a* of the charge unit C. Further, a supporting shaft 27 (FIGS. 11 and 14), which has been fitted inward of developing means frame 12 through the hole 12*m* of the end plate 12*i* of the developing means frame 12, fits into the hole 23*a* of the charge unit C. As a result, the charge unit C is pivotally supported by the developing means frame 12; more specifically, the cylindrical shaft portion 26*a* of the charge unit C is rotationally supported by the rear end cover 17, whereas the other end of the charge unit C is supported by the supporting shaft 27 fitted through both the hole 12*i* of the end plate 12*i* of the developing means frame 12, and the hole 23*a* of the charge unit C.

Referring to FIGS. 6 and 8, to the top portion of the developing means frame 12, a top plate 29 is fixed with the use of small screws 28, with the edges of the top plate 29 placed in contact with the inward side of a guide portion 12*a*, that is, the top portion of the side wall 12*g*, and also in contact with the edges of the end plates 12*h* and 12*i*.

Referring to FIG. 2, the top plate 29 is provided with two spring seats 29*a*, which are located at the longitudinal ends of the top plate 29, one at each end. In each spring seat 29*a*, a compression coil spring 30 is held, being compressed between the top plate 29 and charging means frame 13. Thus, the charge unit C is kept under the pressure generated by the compression coil springs 30 in a direction to pivot the charge unit C about the pivotal axis SC in the clockwise direction in FIG. 2.

Referring to FIG. 11, each of the longitudinal end portions of the charge roller 8*a* forms a journal portion 8*a*2, which is smaller in diameter than the main portion of the charge roller 8*a*, and the rotational axis of which is the same as that of the charge roller 8*a*. Each journal portion 8*a*2 is fitted with a spacer roller 8*n* which is allowed to freely rotate around the journal portion 8*a*2. The space rollers 8*n* are kept in contact with the photosensitive drum 7, outside the image formation range, by the pressure from the aforementioned compression coil springs 8*n*. With the provision of the above described structure, a gap is provided between the peripheral surfaces of the photosensitive drum 7 and the charge roller 8*a*. The transfer residual toner is captured by the charge roller 8*a*, to which a charge bias is being applied, as the transfer residual toner passes through the areas in which the gap between the photosensitive drum 7 and charge roller 8*a* is smallest, and in this smallest gap, the moving direction of the peripheral surface of the charge roller 8*a* is opposite to that of the photosensitive drum 7.

Referring to FIG. 2, the line which connects the pivotal axis SC and the center of the charge roller 8*a* is virtually perpendicular to the line which connects the centers of the charge roller 8*a* and photosensitive drum 7.

Figure 17:
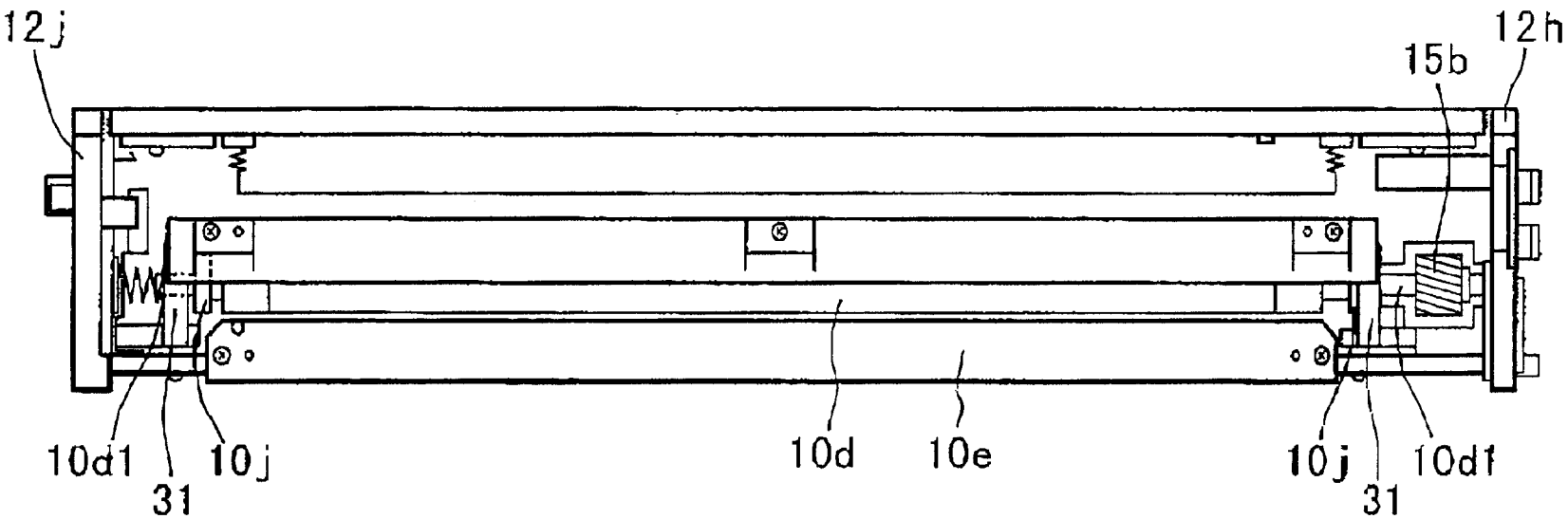
FIG. 17 is a side view of the developing unit.

Also referring to FIG. 2, the development roller 10*d* is attached to the developing means frame 12 in a manner to allow the development roller 10*d* to pivot about the Slv pressure center. Referring to FIG. 17, the journal portions 10*d*1, that is, the longitudinal end portions of the development roller 10*d*. which are smaller in diameter than the center portion of the development roller 10*d*, are fitted with a spacer roller 10*j*, the outer radius of which is smaller than the radius of the development roller 10*d* by a gap necessary for image development. On the outward side of each spacer roller 10*j*, a pivotal arm 32 is located, though the hole of which the journal 10*d*1 is fitted.

Figure 18:
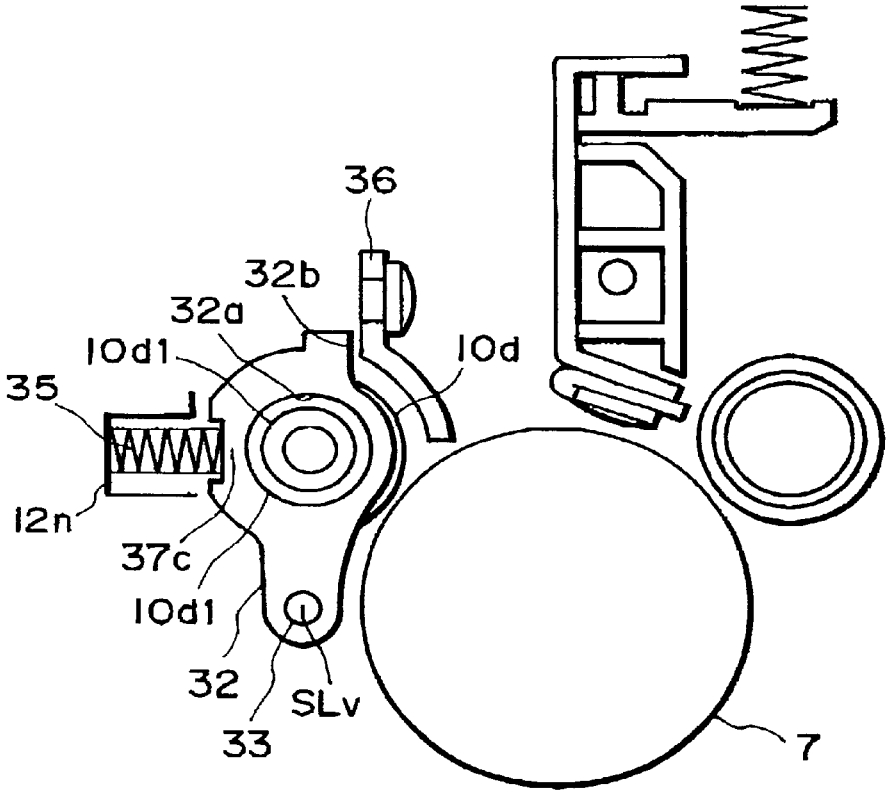
FIG. 18 is a front view of the development sleeve supporting portion.

FIG. 18 is a sectional view of a portion of the process cartridge B, at a plane perpendicular to the development roller 10*d*, and shows the pivotal arm 32 and its adjacencies. Each pivotal arm 32 is pivotally supported at its base portion by a supporting shaft 33, which has been press-fitted in the end plate 12*h* (12*i*) of the developing means frame 12 in the longitudinal direction of the process cartridge B. The pivotal arm 32 is provided with a hole 32*a* with a bearing surface, which is located virtually straight above the supporting shaft 33. The pivotal arm 32 is also provided with a stopper portion 32*b*, which is above the hole 32*a* with a bearing surface. Further, the pivotal arm 32 is provided with a spring seat 37*c*, the center of which is on a line nearly perpendicular to the line that connects the pressure application center Slv, which is the same as the center of the supporting shaft 33, and the center of the hole 32*a* with a bearing surface.

In the hole 32*a* of the pivotal arm 32, the journal portion 10*d*1 of the development roller 10*d* is rotatably supported, at both longitudinal ends of the process cartridge B. Between the spring seat 32*c* and the spring seat 12*n* with which the end plate 12*h* (12*i*) of the developing means frame 12 are provided, a compression coil spring 35 is held in the compressed state. With this arrangement, the development roller 10*d* is enabled to pivot about the pressure application center Slv, and is kept in contact with the photosensitive drum 7 by the pressure from the compression coil springs 35, and also, the spacer rollers 10*j* are kept in contact with the longitudinal end portions of the photosensitive drum 7, outside the image formation areas, also by the pressure from the compression coil springs 35, providing a predetermined gap (0.2–1.0 mm) between the development roller 10*d* and the photosensitive drum 7.

The aforementioned stopper portion 32*b* is a portion which prevents the pivotal arm 32 from over pivoting in the outward direction in FIG. 18, by coming into contact with the development roller cover 36, during the assembly or disassembly of the process cartridge B. Therefore, in the process cartridge B after its assembly, the stopper 32*b* and developer roller cover 36 are not in contact with each other. The development roller cover 36 extends between the two pivotal arms 32, one at each longitudinal end of the process cartridge B, in the longitudinal direction of the process cartridge B, and is fixed to the developing means frame 12 with the use of screws.

(Structure for Installing, or Removing, Process Cartridge, into or Out of, Image Forming Apparatus Main Assembly)

Referring to FIGS. 3 and 7, the top portion of the process cartridge B is provided with guide portions 12*a* and 29*b* in the form of a flange, which are located on the left and right side, respectively, as seen from the direction from which the process cartridge B is inserted into the apparatus main assembly. When the process cartridge B is installed into, or removed from, the image forming apparatus main assembly 14, these guide portions 12*a* and 29*b* fit into, and are guided by, a pair of guides 14*c* (FIG. 34) which extend perpendicular to FIG. 1. The guides 14*c* are portions of a guiding member 14*b* fixed to the apparatus main assembly 14.

The process cartridge B is provided with various electrical contact points which come into contact with the corresponding electrical contact points connected to an unillustrated high voltage power source, on the apparatus main assembly side, when the process cartridge B is inserted into the apparatus main assembly 14.

Referring to FIGS. 3 and 8 one of the aforementioned electrical contact points is a drum grounding contact point 101, which is connected to the photosensitive drum 7, and is located on the front side as seen from the direction from which the process 5 cartridge B is installed. Next, referring to FIGS. 7, 9, and 10, located on the rear side, as seen from the direction from which the process cartridge B is installed, are a contact point 102 connected to the electrically conductive brush 11, a charge bias contact point 103 connected to the charge roller 8*a*, and a development bias contact point 104 connected to the development roller 10*d*.

Figure 19:
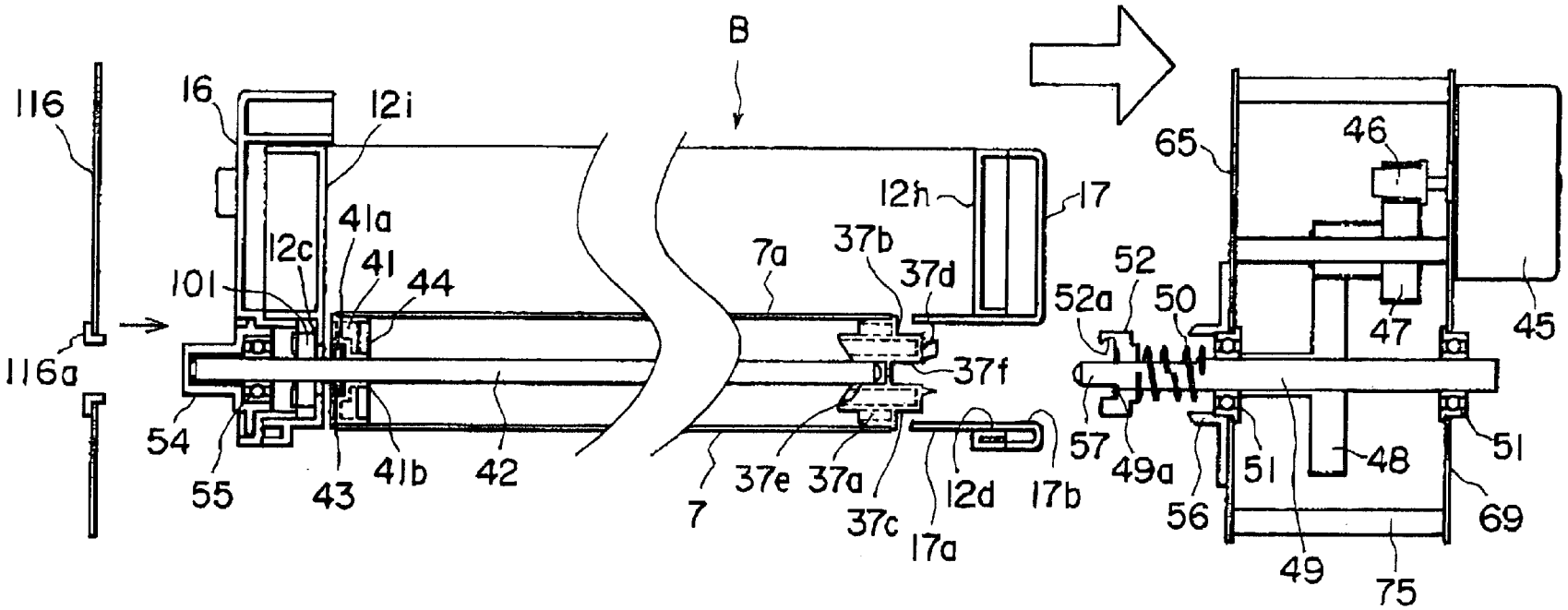
FIG. 19 is a vertical sectional view of the electrophotographic photosensitive drum supporting portions, and the electrophotographic photosensitive drum driving apparatus, in the first embodiment (before cartridge installation).
Figure 20:
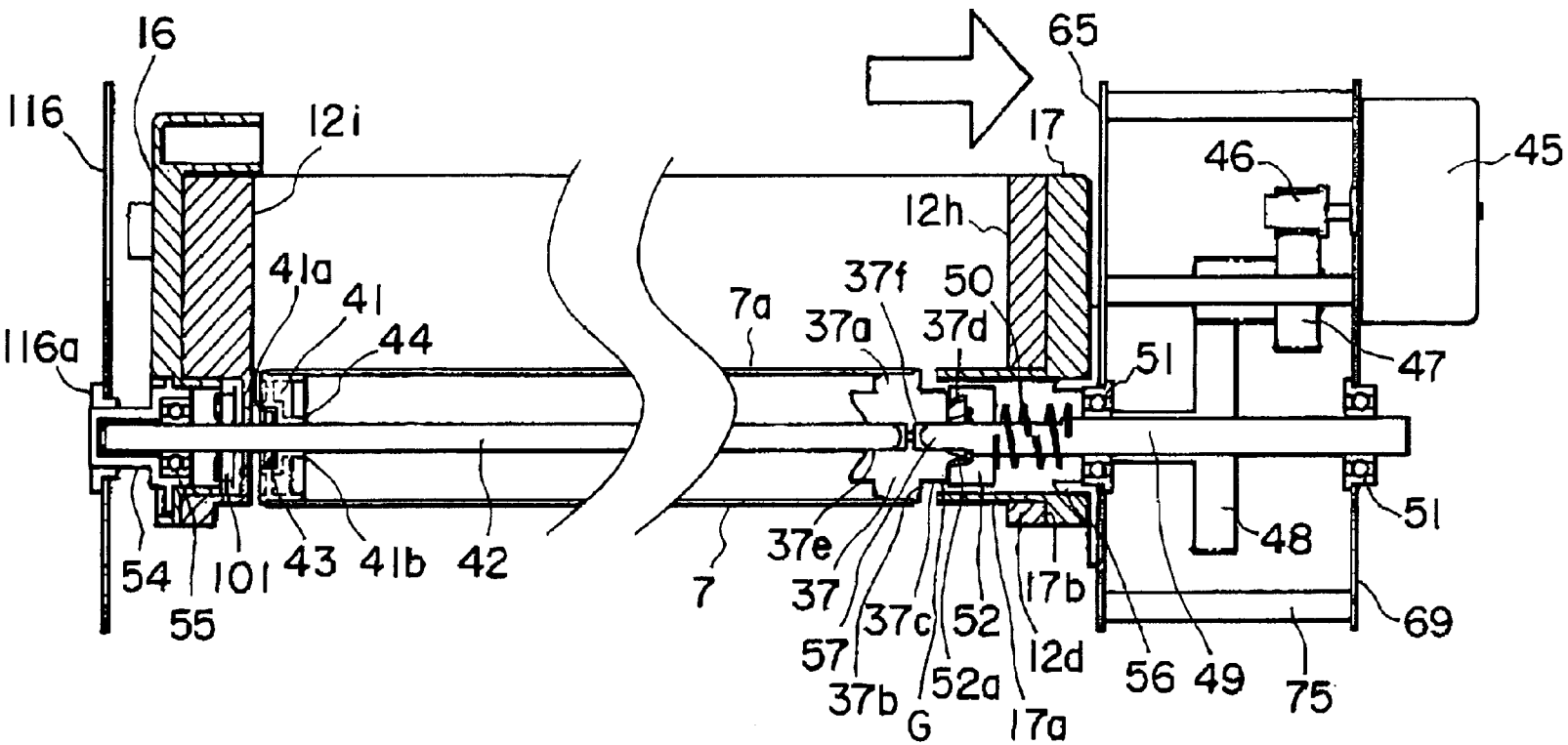
FIG. 20 is a vertical sectional view of the electrophotographic photosensitive drum supporting portions, and the electrophotographic photosensitive drum driving apparatus, in the first embodiment (after cartridge installation).

Referring to FIGS. 19 and 20 which are sectional views of the process cartridge B prior to its installation into, and removal from, respectively, the apparatus main assembly 14, as the process cartridge B is inserted into the apparatus main assembly 14, being guided by the guides 14*c* (FIG. 34) of the apparatus main assembly 14, the leading end of the process cartridge B advances toward the couplings 66, 67, and 68 (FIG. 34) on the driving side, or the main assembly side. Then, the cartridge frame positioning portion 56 on the main assembly side, which is a cartridge positioning boss fixed to the front plate 65 of the drum driving gear unit in such a manner that the axis of the cartridge frame positioning portion 56 coincides with the rotational axis of a shaft 49 for the large gear, that is, a drum driving shaft, and the axis of the bearing 51 for the shaft 49 for the large gear, engages with the cartridge frame positioning portion 17*b* of the rear end cover 17 of the process cartridge B.

Figure 34:
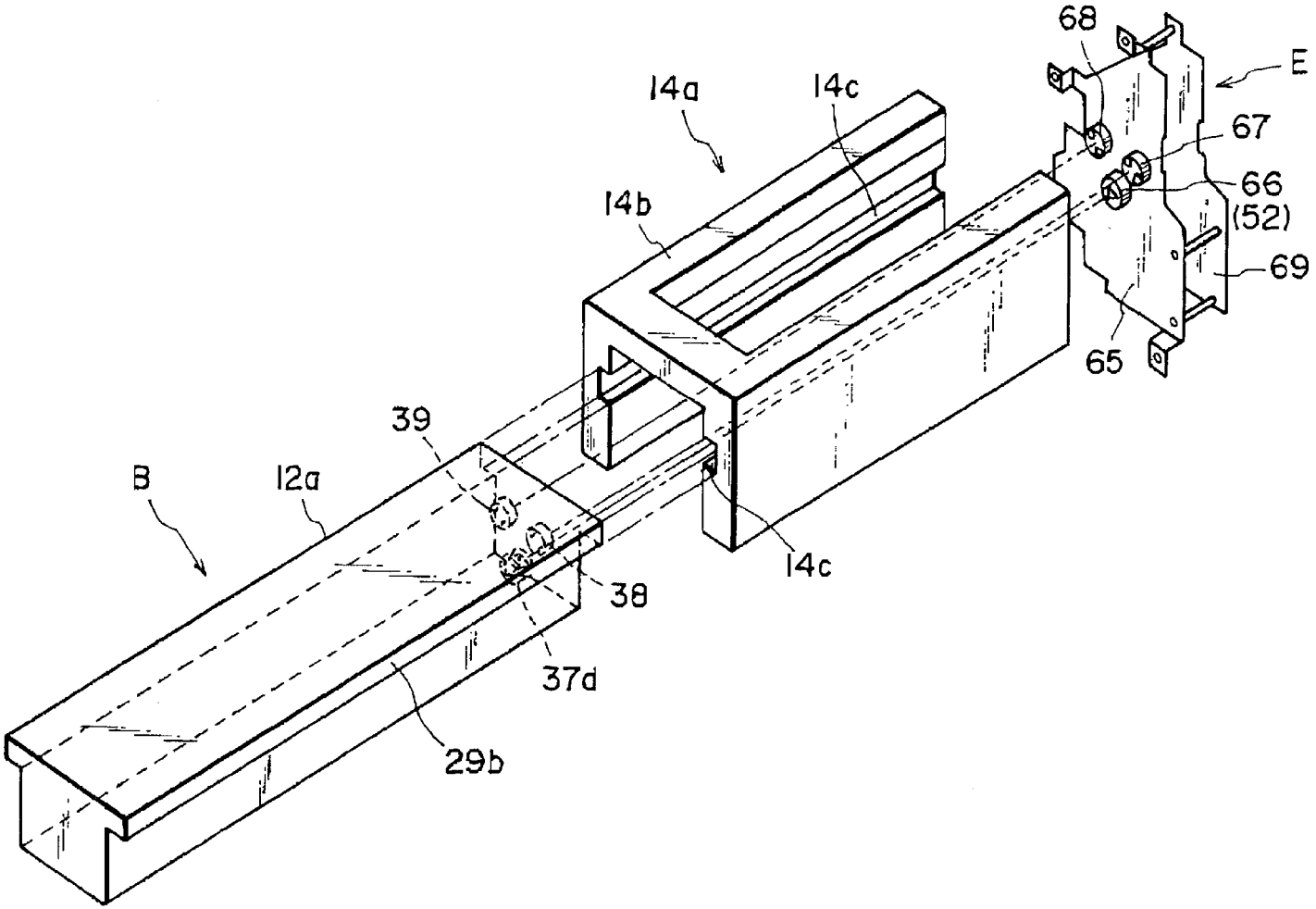
FIG. 34 is a perspective view of the portion of the image forming apparatus, in which the cartridge is installed.

As FIG. 34 shows, the leading end of the process cartridge B, in terms of the direction in which the process cartridge B is inserted into the apparatus main assembly 14, is provided with three driving force receiving portions, which are shaft couplers, each of which rotates about its own shaft extending in the longitudinal direction of the process cartridge B. These driving force receiving couplers are a cartridge coupling 37*d*, or the primary coupling of the process cartridge B, with which the drum flange 37 of the photosensitive drum 7 is provided, a charging means driving coupling 38, and a developing means driving coupling 39. They are male couplings. As the process cartridge B is inserted into the apparatus main assembly 14, these three driving force receiving portions are connected to the corresponding driving members on the apparatus main assembly side. These driving members on the apparatus main assembly side are a photosensitive drum driving coupling 66 (52), or the primary coupling, a charging means driving coupling 67, and a developing means driving coupling 68.

After the process cartridge B is completely inserted into the apparatus main assembly 14, the front cover 116 of the apparatus main assembly 14 is closed onto an unillustrated front plate of the apparatus main assembly 14, from the direction from which the process cartridge B is inserted. As the front cover 116 is closed, the positional relationship between the process cartridge B and the apparatus main assembly 14 is accurately fixed. The front cover 116 is provided with cartridge frame supporting holes 116*a* for very precisely positioning the four process cartridges BK, BM, BC, and BB relative to the apparatus main assembly 14. The size of each hole 116*a* is such that the bearing case 54 of the corresponding process cartridge B perfectly fits in the hole 116*a*.

Referring to FIG. 7, the rear side of the process cartridge B is provided with the photosensitive drum driving coupling 37*d*, or the primary cartridge on the cartridge side, the charging means driving coupling 38, and the developing means driving coupling 39, which are exposed from the process cartridge B, but are recessed from the leading end of the process cartridge B.

(Drum Supporting and Drum Driving Means in First Embodiment)

The photosensitive drum driving coupling 37*d* is the leading end portion of the drum flange 37 fixed to the leading end of the photosensitive drum 7, in terms of the direction in which the process cartridge B is inserted into the apparatus main assembly 14.

FIGS. 19 and 20 show the method for supporting the photosensitive drum 7 and the method for driving the photosensitive drum 7. The photosensitive drum 7, which comprises a hollow aluminum cylinder 7*a* and a photosensitive layer coated on the peripheral surface of the cylinder 7*a*, is provided with two drum flanges: a drum flange 37 on the side from which the photosensitive drum 7 is driven, or the driven side, and a drum flange 41 on the side from which the photosensitive drum 7 is not driven, or the non-driven side. The drum flanges 37 and 41 are fixed to the longitudinal ends of the photosensitive drum 7 by being immovably inserted therein, one for one. One end of a drum shaft 42, which has been put through the center hole of the drum flange 37, the aluminum cylinder 7*a* of the photosensitive drum 7, and the center hole of the drum flange 41, extends through the drum shaft supporting hole 12*b* of the end plate 12*i* of the developing means frame 12. The drum shaft 42 is provided with a pin 43, which is press-fitted through the drum shaft 42, in the diameter direction of the drum shaft 42, and across the rotational axis of the drum shaft 42. The pin 43 fits in the groove 41 a with which the flange 41 on the non-driven side is provided. The groove 41*a* is in the exposed end surface of the flange 41, and extends in the radial direction of the flange 41. In order to connect the drum shaft 42 to the drum cylinder 7*a* in terms of electricity, an electrically conductive spring 44 is fixed to the inward surface of the drum flange 41 on the non-driven side. As for the method for fixing the electrically conductive spring 44 to the drum flange 41, the electrically conductive spring 44 is fitted around a dowel-like projection 41*b* provided on the drum flange 41, and the dowel-like projection 41*b* is melted and solidified. One end of the electrically conductive spring 44 presses upon, and remains in contact with the inward surface of the drum cylinder 7*a* because of its resiliency, and the other end of the spring 44 presses upon, and remains in contact with, the drum shaft 42 also because of its resiliency.

One end of the drum grounding contact point 101 attached to the end plate 12*i* of the developing means frame 12 presses upon, and remains in contact with, the drum shaft 42 because of its resiliency, whereas the other end of the drum grounding contact point 101 is exposed from the process cartridge B, constituting an external contact point.

Figure 14:
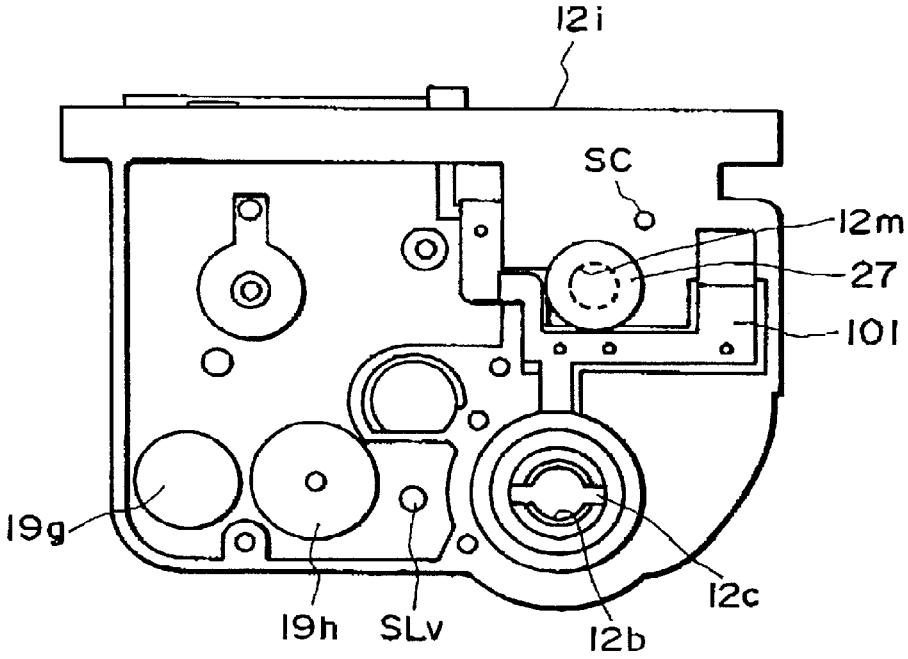
FIG. 14 is a front view of the developing unit, with its front cover removed.
Figure 15:
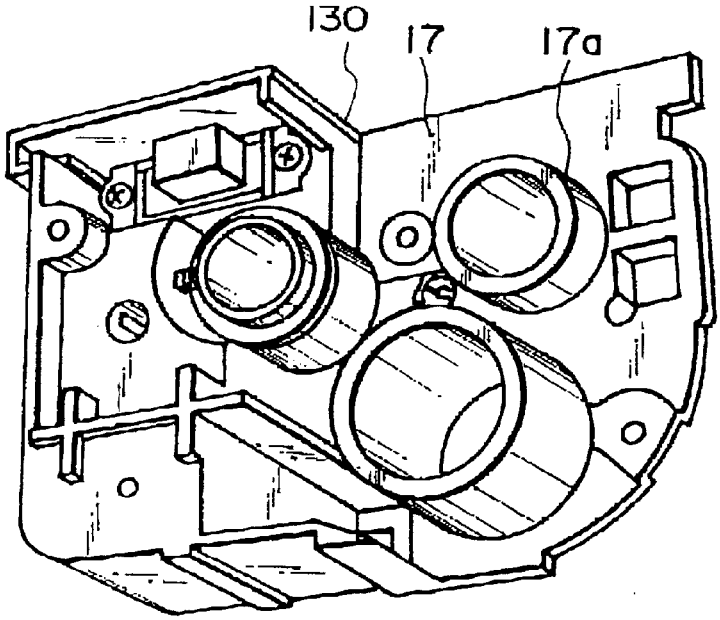
FIG. 15 is a perspective view of the inward side of the rear cover of the developing unit.
Figure 16:
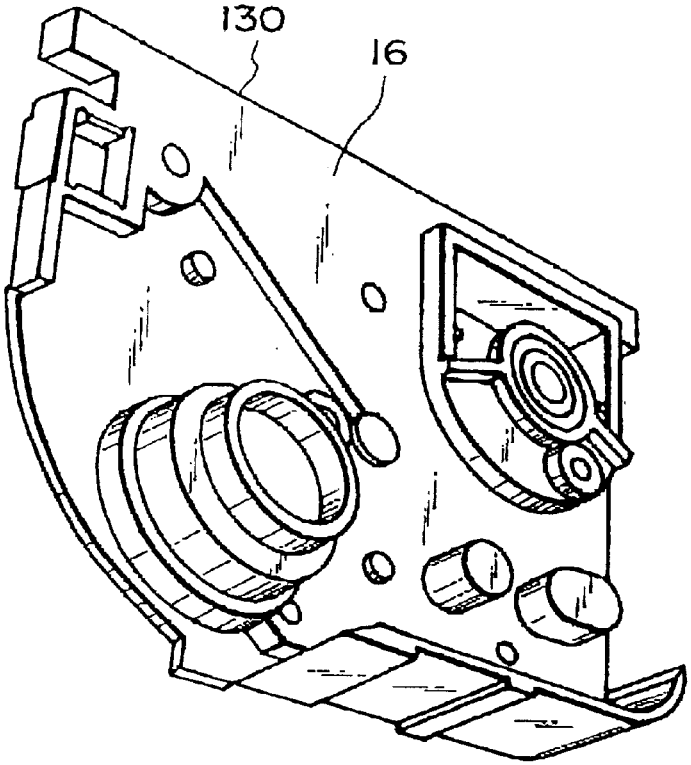
FIG. 16 is a perspective view of the inward side of the front cover of the developing unit.

For ease of assembly, the surface of the drum supporting hole 12*b* of the end plate 128 is provided with a pair of grooves 12*c*, which are deep enough in the radial direction of the hole 12*c*, so that the pin 43 can be put through the end plate 12*i* in the longitudinal direction of the drum shaft 42 (FIG. 14).

The driven side drum flange 37 has an anchor portion 37*a* which engages with the cylinder 7*a*, a flange portion 37*b*, the inwardly facing surface of which contacts the edge of the cylinder 7*a*, a cylindrical projection 37*c*, the diameter of which is smaller than that of the flange portion 37*b*, and photosensitive drum driving coupling 37*d*, that is, a portion projecting in the axial direction of the photosensitive drum 7 from the center portion of the outwardly facing surface of the cylindrical projection 37*c*, listed from the front side of the apparatus. The driven side drum flange 37 is a single-piece component formed of plastic.

The cylindrical projection 37*c* is temporarily fitted into a rear side cylindrical portion 17*a*, which is an integral part of the rear end cover 17 fitted in the hole 12*d* of the end plate 12*h*, projects inward of the process cartridge B, and serves as a shaft supporting portion. With the cylindrical projection 37*c* temporarily fitted in the cylindrical portion 17*a*, there is a gap of 0.2–1.0 mm between the peripheral surface of the circular projection 37*c* and the inward surface of the rear side cylindrical portion 17*a*, allowing the circular projection 37*c* (photosensitive drum 7) to freely rotate.

Figure 21:
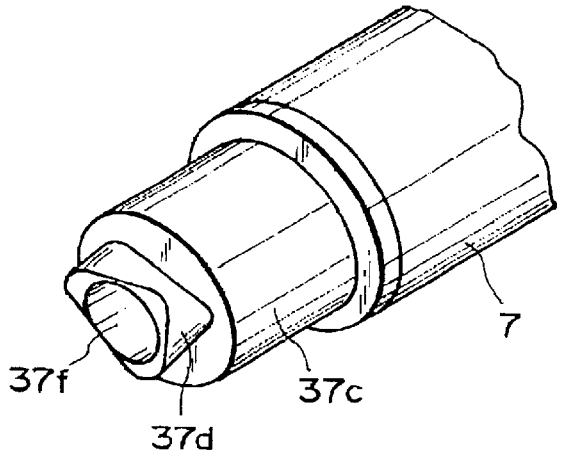
FIG. 21 is a perspective view of the drum flange, on the side from which the drum is driven.

Referring to FIG. 21, the photosensitive drum driving coupling 37*d* is a twisted equilateral triangular projection, the central axis of which coincides with that of the drum shaft 42. The diameter of the circumcircle of this triangular projection is smaller than that of the cylindrical projection 37*c*.

Figure 36:
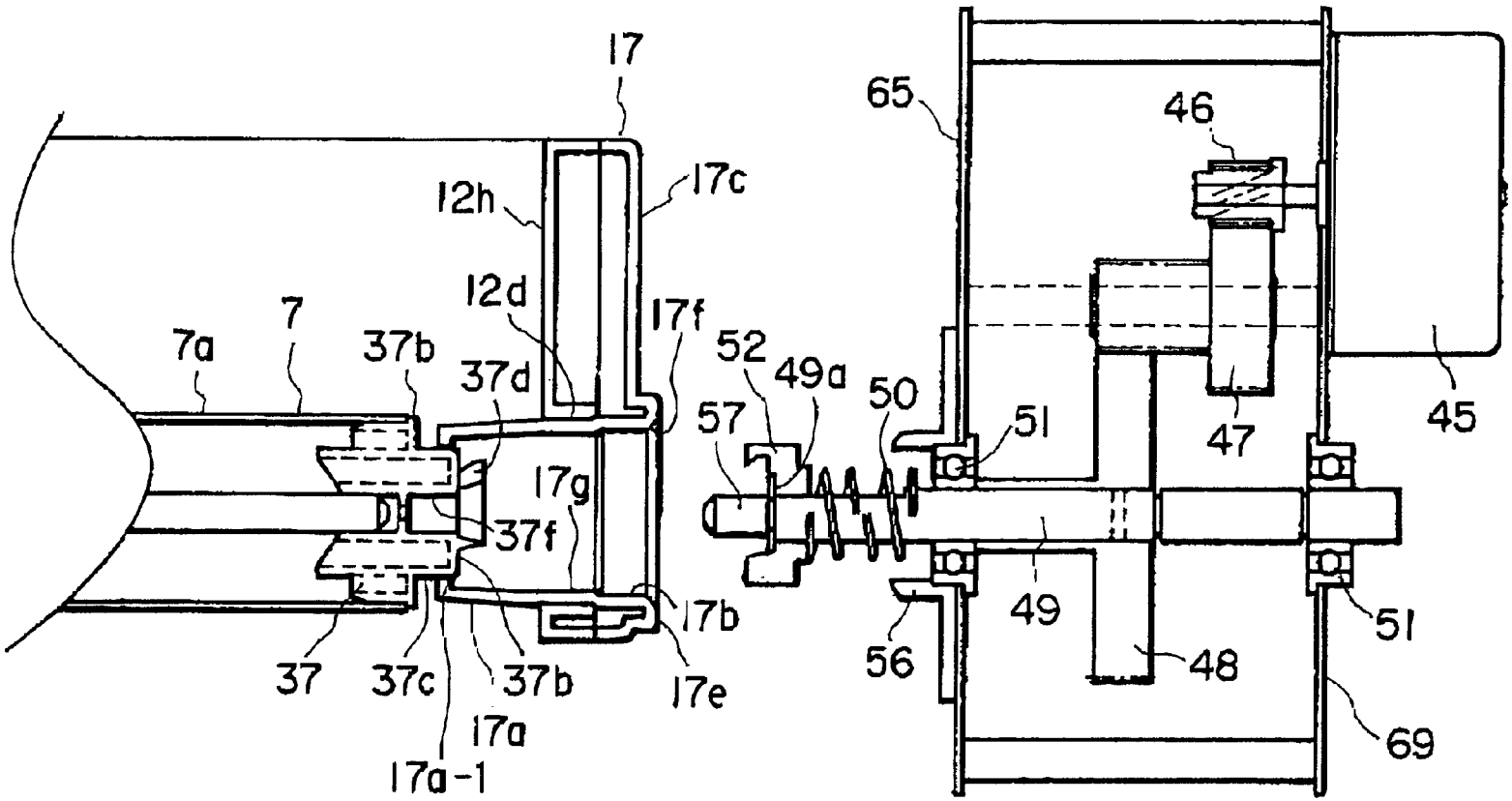
FIG. 36 is a sectional view of the electrophotographic photosensitive drum supporting portion, and the electrophotographic photosensitive drum driving apparatus, in the second embodiment of the present invention (before cartridge installation).
Figure 37:
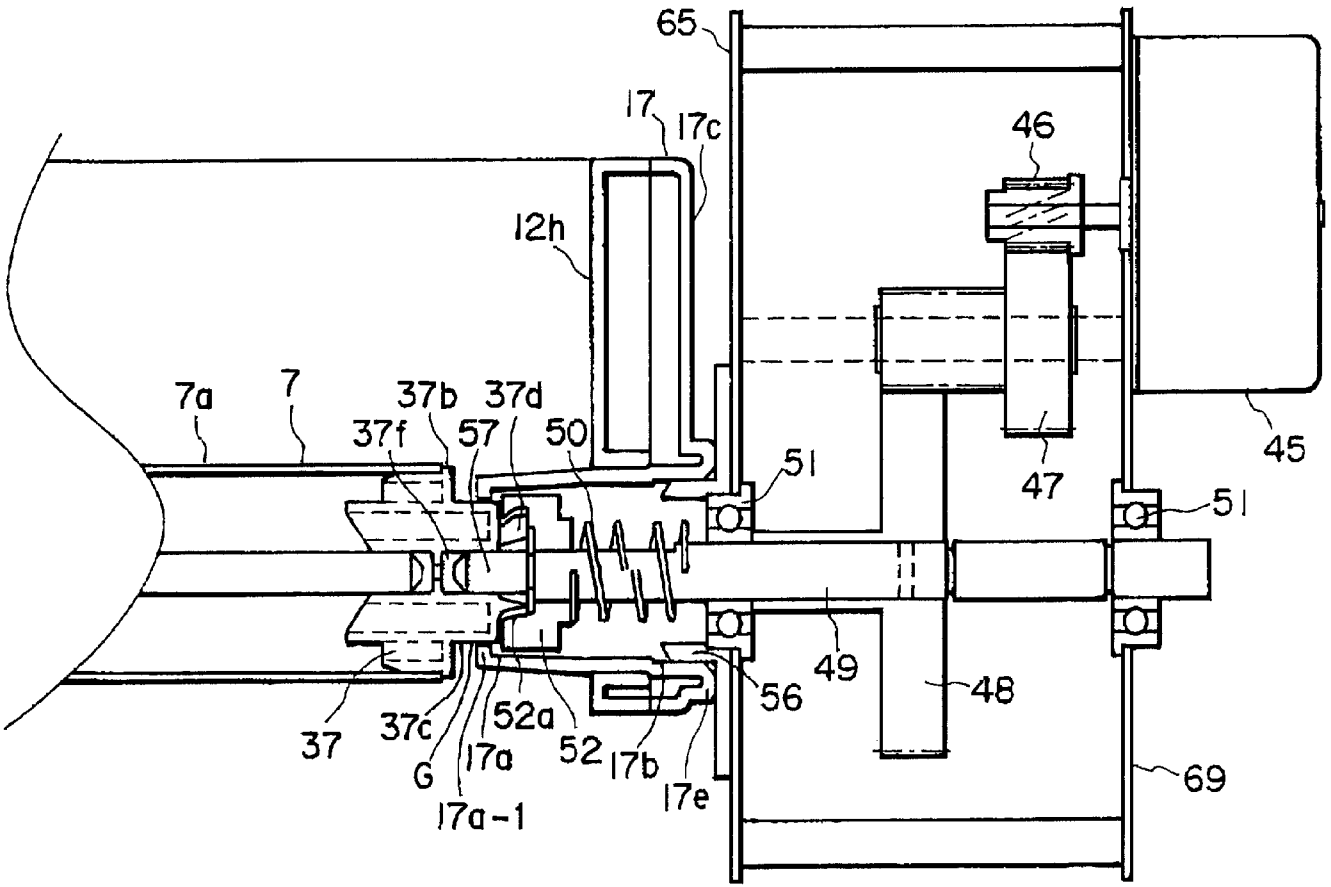
FIG. 37 is a sectional view of the electrophotographic photosensitive drum supporting portion, and the electrophotographic photosensitive of drum driving apparatus, in the second embodiment of the present invention (after cartridge installation).

Referring to FIG. 36, the driving apparatus provided on the apparatus main assembly side has a fixedly disposed motor 45, a pinion 46 fixed to the shaft of the motor 45, an intermediary gear 47 which is rotatably supported and is meshed with the pinion 46 and a large diameter gear 48, a driving shaft 49, to which the large diameter gear 48 is fixed, and to the inward end of which a main assembly side coupling 52, and a bearing 51, which bears the driving shaft 49. Incidentally, the intermediary gear 47 may be a step gear, for example, a gear with a single step. The portion of the driving shaft 49, where the main assembly side coupling 52 fits, may be given a D-shaped cross section, for example, so that the rotation of the driving shaft 49 is reliably transmitted. The main assembly side coupling 52 is allowed to freely move in the driving shaft direction. Between the bearing 51 on the inward side of the process cartridge, and the main assembly side coupling 52, a compression coil spring 50 is positioned around the driving shaft 49 in the compressed state. The main assembly side coupling 52 transmits the force generated by the compression coil spring 50 to the driving shaft 49 through a flange 49*a* integral with the driving shaft 49. With the provision of the above arrangement, the positions of the driving shaft 49 and main assembly side coupling 52 in terms of the shaft direction are fixed.

The bearing 51 rotatably supports the driving shaft 49. The actual coupling portion 52*a* of the main assembly side coupling 52 is a hole in the form of a twisted equilateral triangular pillar, and the cartridge side coupling 37*d* is engaged into, or disengaged from, the hole 52*a* of the main assembly side coupling 52, in the shaft direction. As the cartridge side coupling 37*d* and hole 52*a* engage with each other, the ridges of the twisted equilateral triangular projection, that is, the projection of the cartridge side coupling 37*d* come into contact with the walls of the twisted equilateral triangular hole of the hole 52*a* of the main assembly coupling 52. As a result, the rotational axes of the projection and hole become aligned with each other. A drum positioning portion 57 on the apparatus main assembly side, which is the shaft centering inward end portion of the driving shaft 49, and the main assembly side coupling 52, are provided with a microscopic amount of tolerance.

As the above described two coupling portions engage each other, the main assembly side coupling 52 is positioned as close as possible to the process cartridge B, while being allowed to be pushed back outward of the process cartridge B against the force from the compression coil spring 50 (detailed description will be omitted).

Referring to FIGS. 19 and 20, the drum shaft supporting portion on the non-driven side is structured to prevent the drum shaft 42 from shifting toward the non-driven side. The front side end of the drum shaft 42 is fitted in a bearing 55 encased in a bearing case 54 fixed to the front end cover 16 fixed to the end plate 128 of the developing means frame 12. The movement of the drum shaft 42 toward the nondriven side is prevented by the contact between the front end of the drum shaft 42 and the bottom surface of the pouch-like blind hole of the bearing case 54. On the driven side, the end portion of the drum shaft 42 is fitted in the hole 37*e* of the drum flange 37. The drum flange 37 is prevented from being excessively moved toward driven side, by the contact between the outwardly facing surface of the flange portion 37*b* of the drum flange 3, and the edge of the cylindrical portion 17*a* of the rear cover 17, which projects inward of the process cartridge B. In the above described structure, in order to allow the photosensitive drum 7 a limited amount of movement in its axial direction, the distance between the edge of the cylindrical portion 17*a* of the rear cover 17 and the bearing case 54, is rendered greater than the distance between the outwardly facing surface of the drum flange portion 37*b* and the outwardly facing surface of the non-driven side flange 41.

Since the driving apparatus is structured as described above, as the process cartridge B is inserted into the image forming apparatus main assembly 14, the position of the cartridge frame (developing means frame 12, front end cover 16, and rear end cover 17) relative to the apparatus main assembly 14 is fixed. More specifically, the drum position fixing portion 57 on the main assembly side, that is, the shaft centering portion, which is the inward end of the driving shaft 49, is fitted into the drum position fixing portion 37*f* on the cartridge side, which is the center hole of the drum flange 37, and at the same time, the coupling 37*d* on the cartridge side, that is, a projection, engages into the coupling hole 52*a* of the coupling 52 on the main assembly side. As a result, the driven side end of the photosensitive drum 7 is supported, with its rotational axis in alignment with the rotational axis of the driving shaft 49, by the drum position fixing portion 57, that is, the driving shaft centering portion on the apparatus main assembly side, with the provision of a gap between the photosensitive drum 7 and cartridge frame. On the other hand, on the nondriven side, the bearing case 54, which holds the bearing 55 having been press-fitted into the bearing case 54, is inserted into the cartridge frame supporting hole 116*a* of the front cover 116 of the apparatus main assembly 14, being thereby supported by the front cover 116. Therefore, the position of the photosensitive drum 7 is virtually directly fixed relative to the main assembly frame. Incidentally, the front cover 116 is accurately positioned relative to the main assembly frame when it is attached to the main assembly frame.

In this embodiment, after the coupling of the drum positioning portion 57 on the main assembly side, that is, the inward end portion of the driving shaft 49, into the drum positioning portion 37*f* on the cartridge side, the gap between the peripheral surface of the drum positioning portion 57 and the inward surface of the drum positioning portion 37*f* is in a range of 10 $\mu$m–30 $\mu$m. Further, the gap between the inward surface of the inwardly projecting cylindrical portion 17*a*, and the peripheral surface of the cylindrical projection 37*c* of the flange 37 is in a range of 0.2 mm–0.4 mm.

As the motor 45 rotates, the pinion gear 46, the intermediary gear 47, the large diameter gear 48, the driving shaft 49, and the main assembly side coupling 52, rotate. As the main assembly side coupling 52 rotates, the cartridge side coupling 37*d* and coupling hole 52*a*, which are in the form of a twisted equilateral triangular pillar, are caused to pull each other in such a manner that a male screw is screwed into a female screw. As a result, the drum flange 37 and main assembly side coupling 52 pull each other. Eventually, the end of the cartridge side coupling 37*d* comes into contact with the bottom surface of the coupling hole 52*a*, fixing the position of the photosensitive drum 7 relative to the main assembly side coupling 52, the position of which is virtually fixed; in other words, the position of the photosensitive drum 7 relative to the apparatus main assembly 14 in terms of the longitudinal direction is fixed. In this state, there is no contact between the inward surface of the aforementioned rearwardly projecting cylindrical portion 17*a* and the peripheral surface of the cylindrical projection 37*c* of the flange 37; the gap between the two surfaces is in a range of 0.2 mm–0.4 mm. There is no friction between the two surfaces, reducing the overall frictional resistance load which applies to the photosensitive drum 7.

In a situation in which the cartridge side coupling 37*d* fails to engage the coupling hole 52*a* on the main assembly side after the installation of the apparatus main assembly 14, the main assembly side coupling 52 will have been pushed back against the force from the compression coil spring 50, by the rearwardly facing surface of the cartridge side coupling 37*d*, which will have come into contact with the edge of the opening of the coupling hole 52*a*. Therefore, as soon as the rotational phase of the cartridge side coupling 37*d* is caused to match that of coupling hole 52*a*, by the aforementioned rotation of the main assembly side coupling 52 after the installation of the process cartridge B, the two couplings instantly engage each other.

(Photosensitive Drum Supporting and Driving Means, in Second Embodiment)

This embodiment is a modification of the first embodiment. More specifically, the rear end cover 17, which is one of the components of the cartridge frame 130, of the photosensitive drum supporting and driving means in this embodiment, is a modified version of the rear end cover 17 in the first embodiment. Otherwise, the photosensitive supporting and driving means in this embodiment is the same in structure as that in the first embodiment. Thus, this embodiment will be described regarding only its difference from the first embodiment, while referring to the first embodiment.

Figure 22:
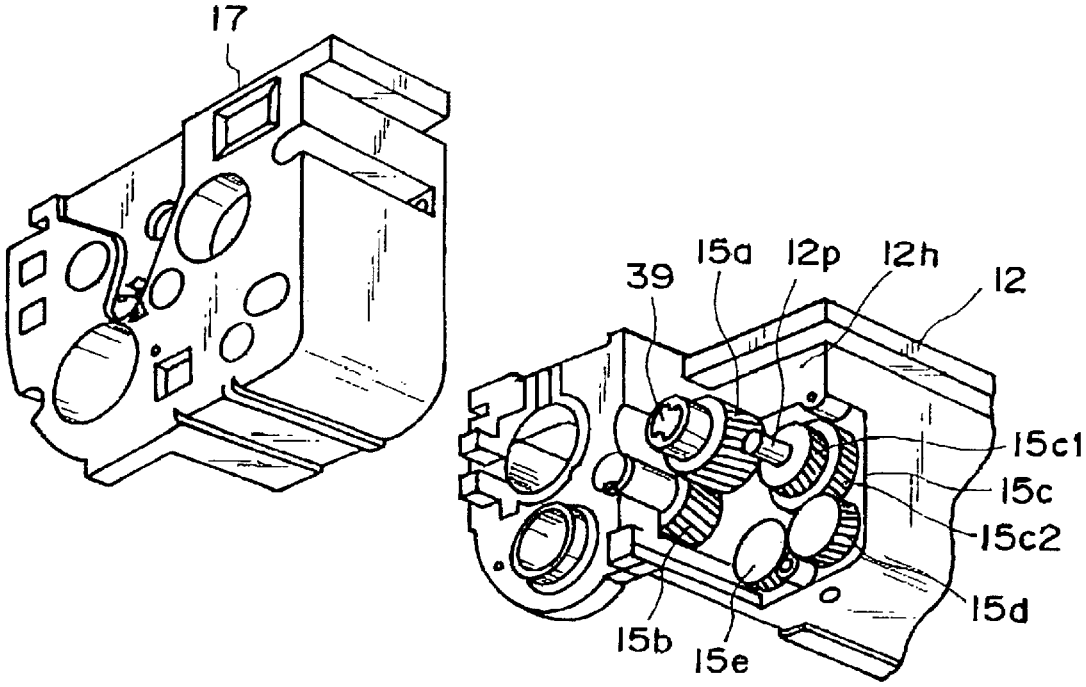
FIG. 22 is a perspective view of the process cartridge as seen from diagonally below the left rear, with the rear cover removed.
Figure 35:
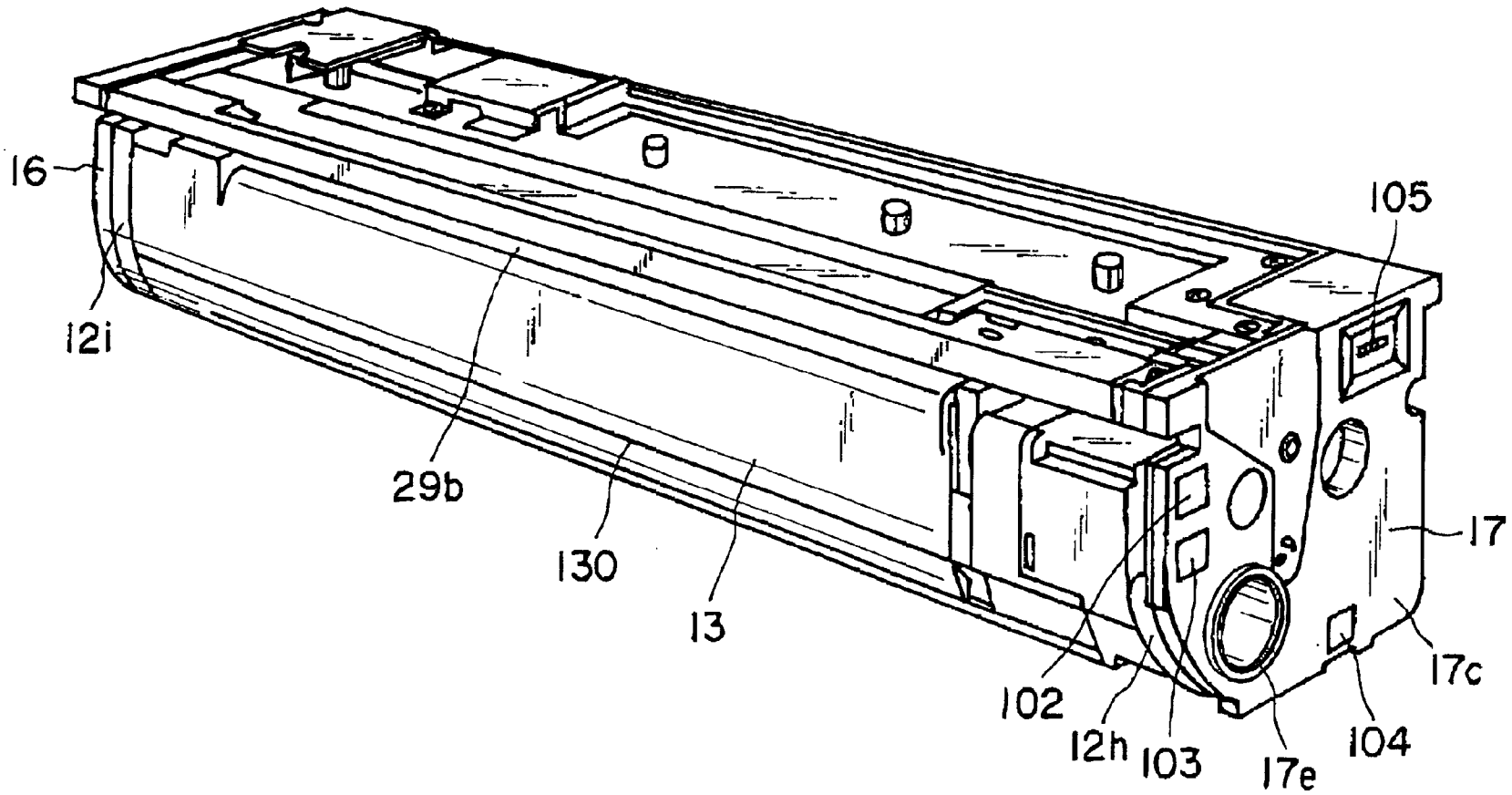
FIG. 35 is a perspective view of the process cartridge in the second embodiment, as seen from diagonally above the right rear.

Referring to FIG. 22, the surface of the rear end cover 17 of the process cartridge B in the first embodiment, which faces the direction toward which the process cartridge B is inserted, is practically flat. Referring to FIG. 35, in this embodiment, however, the end surface 17*c* has a projection 17*e* which projects in the downstream direction in terms of the direction in which the process cartridge B is inserted. This projection 17*e* is cylindrical. Next, referring to FIG. 36, the cylindrical inward wall portion of this cylindrical projection 17*e* constitutes a part of the cartridge frame positioning portion 17*b*. The edge of the opening of the projection 17*e* has been chambered on the inward side, providing a surface 17*f*. In other words, the cylindrical, cartridge frame positioning portion 17*b* is the portion of the rear end cover 17 that extends inward of the rear end cover 17 from the inward edge of the slanted surface 17*f* (chamfer) of the cylindrical projection 17*e*. From the inward side of this cylindrical, cartridge frame positioning portion 17*b*, as seen from the entrance side of the cartridge frame positioning portion 17*b*, an intermediary cylindrical portion 17*g* extends inward. Also as seen from the entrance side of the cartridge frame positioning portion 17*b*, the intermediary cylindrical portion 17*g* extends inward from the inward side of the cartridge frame positioning portion 17*b*, and the innermost cylindrical portion 17*a* extends inward from the inward side of the intermediary cylindrical portion 17*g*. These intermediary and innermost cylindrical portions 17*g* and 17*a* gradually are reduced in internal diameter toward the upstream side in terms of the direction in which the process cartridge B is inserted; in other words, their internal diameters gradually are reduced toward the inward side of the process cartridge B. Further, the inward end of the innermost cylindrical portion 17*a* is provided with a flange 17*a*-1 which extends inward of the innermost cylindrical portion 17*a*, in terms of the radial direction of the innermost cylindrical portion 17*a*, in other words, toward the peripheral surface of the cylindrical projection 37*c* of the drum side flange 37. The internal diameter of the flange 17*a*-1 is such that a gap in a range of 0.2 mm–0.4 mm is provided between the inward edge of the flange 17*a*1, and the peripheral surface of the cylindrical projection 37*c*.

The function of this photosensitive drum supporting and driving means in this second embodiment is practically the same as that of the photosensitive drum supporting and driving means in the first embodiment, except for the following effect. That is, since the internal diameters of the cylindrical portions 17*g* and 17*a*, which are on the inward side of the cartridge frame positioning portion 17*b*, are gradually reduced toward the inward side of the process cartridge B, it is easier for the rear end cover 17 to be released from the mold. Further, since the rear end portion of the cylindrical, cartridge frame positioning portion projects rearward from the end cover 17 (cartridge frame), it is better assured that the cartridge frame positioning portion on the process cartridge side engages with the cartridge frame positioning portion on the main assembly side.

Incidentally, although the preceding embodiments of the present invention were described with reference to the process cartridge B which integrally comprised developing means, the charging means, and the photosensitive drum, the structure for supporting the photosensitive drum by the cartridge frame, and the structure for allowing the driving force receiving portion of the photosensitive drum and the cartridge driving member of the image forming apparatus main assembly, to be engaged with, or be disengaged from, each other, in the preceding embodiments. are applicable to process cartridges in general.

The embodiments are summarized as follows:

1. A process cartridge B detachably mountable to a main assembly 14 of an electrophotographic image forming apparatus, comprising:

a cartridge frame 130;

an electrophotographic photosensitive drum 7 supported on the cartridge frame 130;

wherein the photosensitive drum 7 has a downstream side end, with respect to a mounting direction in which the process cartridge B is mounted to the main assembly 14 of the apparatus in the axial direction of the photosensitive drum 7, and is supported on the cartridge frame 130 for movement in a direction crossing with the axis direction of the photosensitive drum 7;

process means actable on the photosensitive drum 7;

a cartridge drum 7 positioning portion 37*f* for positioning the photosensitive drum 7 to the main assembly 14 of the apparatus by engagement with a main assembly 14 drum 7 positioning portion 57 provided in the main assembly 14 of the apparatus when the process cartridge B is mounted to the main assembly 14 of the apparatus, wherein the cartridge drum 7 positioning portion 37*f* is disposed coaxially with the photosensitive drum 7;

a cartridge frame 130 positioning portion for positioning the cartridge frame 130 to the main assembly 14 of the apparatus by engagement with a main assembly 14 frame positioning portion 56 provided in the main assembly 14 of the apparatus when the process cartridge B is mounted to the main assembly 14 of the apparatus;

wherein the cartridge frame 130 positioning portion is disposed at a leading end portion with to respect to a mounting direction in which the process cartridge B is mounted to the main assembly 14 of the apparatus, and the cartridge frame 130 positioning portion is disposed so as to be coaxial with the photosensitive drum 7 when the cartridge drum 7 positioning portion 37*f* is engaged with the main assembly 14 drum 7 positioning portion 57 so that the photosensitive drum 7 is positioned to the main assembly 14 of the apparatus.

2. A process cartridge B according to Item 1, wherein the cartridge frame 130 positioning portion is a positioning cylindrical portion 17*b* extended in the cartridge frame 130 in the mounting direction.

3. A process cartridge B according to Item 2, wherein the positioning cylindrical portion 17*b* is projected outwardly from a leading end surface of the cartridge frame 130, and the positioning cylindrical portion 17*b* is extended from outside of the cartridge frame 130 to an inside thereof.

4. A process cartridge B according to Item 1, 2 or 3, wherein a rear side cylindrical portion is provided at a rear side of the positioning cylindrical portion 17*b*, and a circular projected portion of a flange 37 of the photosensitive drum 7 enters an upstream side end of the rear side cylindrical portion in the mounting direction, and a gap G of 0.2 mm–0.4 mm is provided between an inner surface of said rear side cylindrical portion and an outer surface of the circular projected portion, and the rear side cylindrical portion is disposed substantially coaxially with the positioning cylindrical portion 17*b*.

5. A process cartridge B according to Item 1, 2 or 3, wherein the inner diameter of the positioning cylindrical portion 17*b* is 25 mm–27 mm, and the length thereof is 8 mm–10 mm.

6. A process cartridge B according to Item 1, 2 or 3, wherein the positioning cylindrical portion 17*b* and rear side cylindrical portion are made of resin material, and are integrally molded with an end cover 16 or 17 of resin material as a part of a cartridge frame 130.

7. A process cartridge B according to Item 4, further comprising a cartridge coupling, at a leading end of the circular projected portion, for receiving a driving force for rotating the photosensitive drum 7 through a main assembly 14 coupling 52 provided in the main assembly 14 of the apparatus when the process cartridge B is mounted to the main assembly 14 of the apparatus.

8. A process cartridge B according to Item 7, wherein the cartridge drum 7 positioning portion 37*f* is in the form of a recess formed substantially at a center of the cartridge coupling.

9. A process cartridge B according to Item 1, wherein a cartridge drum 7 positioning portion 37*f* is a recess formed at a center of a flange 37 of the photosensitive drum 7, wherein the flange 37 is mounted to a downstream side end of cylinder of the photosensitive drum 7.

10. A process cartridge B according to Item 9, wherein the flange 37 has a circular projected portion, and a free end of the circular projected portion is provided with a cartridge coupling for receiving a driving force for rotating the photosensitive drum 7 through a main assembly 14 coupling 52 provided in the main assembly 14 of the apparatus, wherein the recess is disposed substantially at center portions of a cartridge 25 coupling and the circular projected portion.

11. A process cartridge B according to Item 8 or 10, wherein the cartridge coupling has a substantially triangular prism which is twisted, and the main assembly 14 coupling 52 has a twisted hole having a substantially triangular cross-section, corner portions of the substantially triangular prism are beveled, and a recess as the cartridge drum 7 positioning portion 37*f* is provided substantially at the center of the substantially triangular prism.

12. A process cartridge B according to Item 8, 9, wherein when the process cartridge B is mounted to the main assembly 14 of the apparatus, a driving shaft 46 as the main assembly 14 drum 7 positioning portion 57 provided in the main assembly 14 of the apparatus is engaged with the recess, and the main assembly 14 coupling 52 provided at a free end portion or leading end portion of the shaft is engaged with cartridge coupling, by which the position of the photosensitive drum 7 in a direction crossing with a direction of an axis, and a rotating force for rotating the photosensitive drum 7 is transmitted from main assembly 14 of the apparatus, the driving shaft 46 is rotatable by a driving force from a motor provided in the main assembly 14 of the apparatus.

13. A process cartridge B according to Item 12, wherein the amount of press-fitting is 10 $\mu$m and a gap G between the driving shaft 46 and the recess is 30 $\mu$m in a direction crossing with an axis of the driving shaft 46.

14. A process cartridge B according to Item 1 or 13, wherein an upstream side end of the photosensitive drum 7 with respect to a mounting direction, is rotatably supported on the cartridge frame 130 so as not to be movable in a direction crossing with a direction of the axis of the photosensitive drum 7.

15. A process cartridge B according to Item 1, wherein the process means includes at least one of developing means for developing an electrostatic latent image formed on the photosensitive drum 7, charging means for charging the photosensitive drum 7, and cleaning means for removing a developer remaining on the photosensitive drum 7.

16. A process cartridge B detachably mountable to a main assembly 14 of an electrophotographic image forming apparatus, comprising:

a cartridge frame 130;

an electrophotographic photosensitive drum 7 supported on the cartridge frame 130;

wherein the photosensitive drum 7 has a downstream side end, with respect to a mounting direction in which the process cartridge B is mounted to the main assembly 14 of the apparatus in the axial direction of the photosensitive drum 7, is supported on the cartridge frame 130 for movement in a direction crossing with the axis direction of the photosensitive drum 7;

a developing roller for developing an electrostatic latent image formed on the photosensitive drum 7;

a charging roller for charging the photosensitive drum 7;

a cartridge drum 7 positioning recess for positioning the photosensitive drum 7 to a main assembly 14 of the apparatus by engagement with a main assembly 14 drum 7 positioning portion 57 provided in the main assembly 14 of the apparatus when the process cartridge B is mounted to the main assembly 14 of the apparatus;

wherein a cartridge drum 7 positioning recess is disposed coaxially with the photosensitive drum 7, and the cartridge drum 7 positioning recess is provided at a center of a circular projected portion of a flange 37 of the photosensitive drum 7, and wherein the flange 37 is mounted at one end portion of a cylinder of the photosensitive drum 7 in an axis direction;

a positioning cylindrical portion 17*b* for positioning the cartridge frame 130 to a main assembly 14 of the apparatus by engagement with a main assembly 14 frame positioning portion 56 provided in the main assembly 14 of the apparatus when the process cartridge B is mounted to the main assembly 14 of the apparatus;

wherein the positioning cylindrical portion 17*b* is disposed at a leading end, with respect to a mounting direction in which the process cartridge B is mounted to the main assembly 14 of the apparatus, and the positioning cylindrical portion 17*b* is disposed such that it is coaxial with the photosensitive drum 7 when a cartridge drum 7 is positioning to the main assembly 14 of the apparatus by engagement of the cartridge drum 7 positioning recess with the main assembly 14 drum 7 positioning portion 57, and the positioning cylindrical portion 17*b* is extended in the mounting direction on the cartridge frame 130, and the positioning cylindrical portion 17*b* is outwardly projected from a free end surface of the cartridge frame 130, and the positioning cylindrical portion 17*b* is extended from outside to inside of the cartridge frame 130;

a cartridge coupling for receiving a driving force for rotating the photosensitive drum 7 through a main assembly 14 coupling 52 provided in the main assembly 14 of the apparatus when the process cartridge B is mounted to the main assembly 14 of the apparatus, and the recess is disposed at the center of the cartridge coupling and the circular projected portion.

17. A process cartridge B according to Item 16, wherein a rear side cylindrical portion is provided at a rear side of the positioning cylindrical portion 17*b*, and the circular projected portion enters an upstream side end of the rear side cylindrical portion, wherein a gap G of 0.2–0.4 mm is formed between an inner surface of the rear side cylindrical portion and an outer surface of the circular projected portion, wherein the rear side cylindrical portion is substantially coaxial with the positioning cylindrical portion 17*b*.

18. A process cartridge B according to Item 17, wherein the inner diameter of the positioning cylindrical portion 17*b* is 25 mm–27 mm, and the length thereof is 8 mm–10 mm.

19. A process cartridge B according to Item 16, 17, 18, wherein the positioning cylindrical portion 17*b* and rear side cylindrical portion are made of resin material, and are integrally molded with an end cover 16 or 17 of resin material as a part of a cartridge frame 130.

20. A process cartridge B according to Item 16, 17, 18 or 19, wherein when the process cartridge B is mounted to the main assembly 14 of the apparatus, a driving shaft 46 as the main assembly 14 drum 7 positioning portion 57 provided in the main assembly 14 of the apparatus is engaged with the recess, and the main assembly 14 coupling 52 provided at a free end portion or leading end portion of the shaft is engaged with cartridge coupling, by which the position of the photosensitive drum 7 in a direction crossing with a direction of an axis, and a rotating force for rotating the photosensitive drum 7 is transmitted from main assembly 14 of the apparatus, the driving shaft 46 is rotatable by a driving force from a motor provided in the main assembly 14 of the apparatus.

21. A process cartridge B according to Item 20, wherein the amount of press-fitting is 10 $\mu$m—and the gap G between the driving shaft 46 and the recess is 30 $\mu$m in a direction crossing with an axis of the driving shaft 46.

22. A process cartridge B according to Item 16 or 21, wherein an upstream side end of the photosensitive drum 7 with respect to a mounting direction, is rotatably supported on the cartridge frame 130 so as not to be movable in a direction crossing with a direction of the axis of the photosensitive drum 7.

23. An electrophotographic image forming apparatus for forming an image on a recording material, to which a process cartridge B is detachably mountable, comprising:

(a) a main assembly 14 drum 7 positioning portion 57;

(b) a main assembly 14 frame positioning portion 56;

(c) a mounting member for detachably mounting a process cartridge B, the process cartridge B including:

a cartridge frame 130;

an electrophotographic photosensitive drum 7 supported on the cartridge frame 130;

wherein the photosensitive drum 7 has a downstream side end, with respect to a mounting direction in which the process cartridge B is mounted to the main assembly 14 of the apparatus in the axial direction of the photosensitive drum 7, and is supported on the cartridge frame 130 for movement in a direction crossing with the axis direction of the photosensitive drum 7;

process means actable on the photosensitive drum 7;

a cartridge drum 7 positioning portion 37*f* for positioning the photosensitive drum 7 to the main assembly 14 of the apparatus by engagement with the main assembly 14 drum 7 positioning portion 57 when the process cartridge B is mounted to the main assembly 14 of the apparatus, wherein the cartridge drum 7 positioning portion 37*f* is disposed coaxial with the photosensitive drum 7; and a cartridge frame 130 positioning portion for positioning the cartridge frame 130 to a main assembly 14 of the apparatus by engagement with a positioning portion of the main assembly 14 frame when the process cartridge B is mounted to the main assembly 14 of the apparatus, wherein the cartridge frame 130 positioning portion is disposed at a leading end with respect to a mounting direction of the process cartridge B relative to the apparatus, and the cartridge frame 130 positioning portion is disposed in the cartridge frame 130 such that when the photosensitive drum 7 is positioned to the main assembly 14 of the apparatus by engagement of the cartridge drum 7 positioning portion 37*f* with the main assembly 14 drum 7 positioning portion 57, it is coaxial with the photosensitive drum 7.

24. An electrophotographic image forming apparatus for forming an image on a recording material, to which a process cartridge B is detachably mountable, comprising:

(a) a main assembly 14 drum 7 positioning portion 57;

(b) a main assembly 14 frame positioning portion 56;

(c) a main assembly 14 coupling 52;

(d) a mounting member for detachably mounting a process cartridge B, the process cartridge B including:

a cartridge frame 130;

an electrophotographic photosensitive drum 7 supported on the cartridge frame 130;

wherein the photosensitive drum 7 has a downstream side end, with respect to a mounting direction in which the process cartridge B is mounted to the main assembly 14 of the apparatus in the axial direction of the photosensitive drum 7, is supported on the cartridge frame 130 for movement in a direction crossing with the axis direction of the photosensitive drum 7;

a developing roller for developing an electrostatic latent image formed on the photosensitive drum 7;

a charging roller for charging the photosensitive drum 7;

a cartridge drum 7 positioning recess for positioning the photosensitive drum 7 to the main assembly 14 of the apparatus by engagement with the main assembly 14 drum 7 positioning portion 57 when the process cartridge B is mounted to the main assembly 14 of the apparatus, wherein the cartridge drum 7 positioning recess is disposed coaxially with the photosensitive drum 7, and the cartridge drum 7 positioning recess is provided at the center of a circular projected portion of a flange 37 of the photosensitive drum 7, and the flange 37 is mounted to one axial end of a cylinder of the photosensitive drum 7;

a positioning cylindrical portion 17*b* for positioning the cartridge frame 130 to the main assembly 14 of the apparatus by engagement with the main assembly 14 frame positioning portion 56 when the process cartridge B is mounted to the main assembly 14 of the apparatus;

wherein the positioning cylindrical portion 17*b* is disposed at a leading end, with respect to a mounting direction in which the process cartridge B is mounted to the main assembly 14 of the apparatus, wherein the positioning cylindrical portion 17*b* is disposed on the cartridge frame 130 such that when the photosensitive drum 7 is positioned in the main assembly 14 of the apparatus by engagement of the cartridge drum 7 positioning recess with the main assembly 14 drum 7 positioning portion 57, it is coaxial with the photosensitive drum 7, wherein the positioning cylindrical portion 17*b* is extended along the mounting direction on the cartridge frame 130, and the positioning cylindrical portion 17*b* is projected outwardly from a leading end surface of the cartridge frame 130, and the positioning cylindrical portion 17*b* is extended from outside of the cartridge frame 130 to inside thereof;

a cartridge coupling, provided at a leading edge of the circular projected portion, for receiving a driving force for rotating the photosensitive drum 7 through a main assembly 14 coupling 52 when the process cartridge B is mounted to the main assembly 14 of the apparatus, wherein the recess is disposed substantially at center portions of the circular projected portion and the cartridge coupling.

According to the embodiments described above, when the process cartridge B is installed into the image forming apparatus main assembly 14, the positional relationship between the photosensitive drum 7 and the apparatus main assembly 14, and the positional relationship between the cartridge frame 100 and the apparatus main assembly 14, are independently fixed. Therefore, the vibrations of the cartridge frame 100 are not transmitted to the photosensitive drum 7. As a result, the degree of accuracy with which the photosensitive drum 7 is rotated is improved. Further, since the position of photosensitive drum 7 relative to the apparatus main assembly 14 is fixed independently from that of the cartridge frame 100, the positioning accuracy for the photosensitive drum 7 is also improved.

(Driving of Development Roller)

Figure 13:
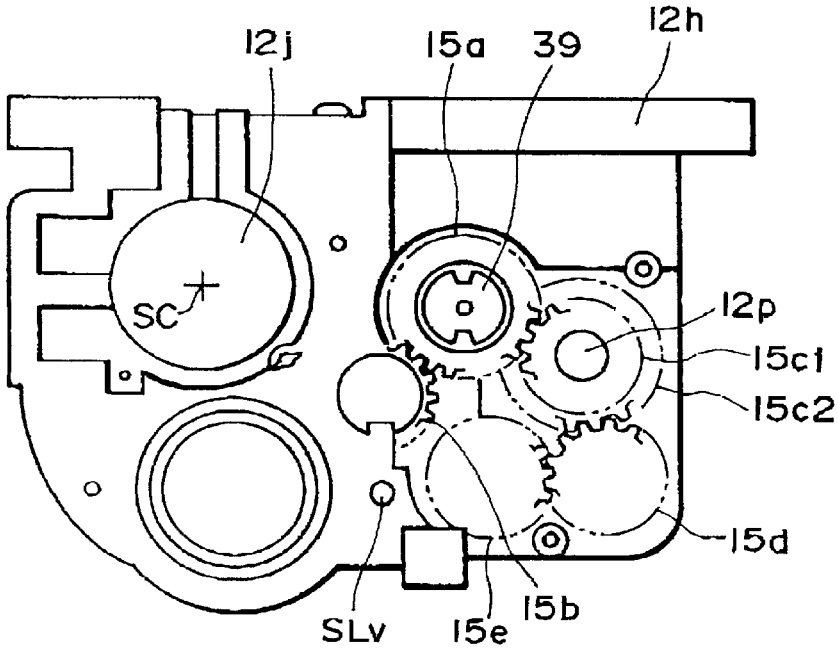
FIG. 13 is a rear view of a developing unit, with its rear cover removed.

Referring to FIG. 17, the development roller 10*d* is provided with a development roller gear 15*b*, the position of which is on the outward side of the journal portion 10*d*1 in terms of the longitudinal direction. Referring to FIGS. 7, 13, and 22, the development roller gear 15*b* is meshed with the developing means driving gear 15*a*. The developing means driving gear 15*a* is integral with a developing means driving coupling 39, as the rotational driving force receiving member of the developing means, on the cartridge side. The developing means driving coupling 39 on the cartridge side is provided with a round hole, the axis of which coincides with the rotational axis of the developing means driving coupling 39 and the rotational axis of the developing means driving gear 15*a*. An unillustrated shaft with which the end plate 12*h* of the developing means frame 12 is provided, and which extends outward of the process cartridge B in terms of the longitudinal direction, fits in the aforementioned round hole of the developing means driving coupling 39 integral with the developing means driving gear 15*a*, allowing the developing means driving coupling 39 with the developing means driving gear 15*a* to freely rotate.

The developing means driving gear 15*a* is meshed with a smaller diameter gear 15*c*1 of a step gear 15*c*. The step gear 15*c* is rotatably fitted around a shaft 12*p* which is integral with the end plate 12*h* and extends outward in terms of the longitudinal direction from the end plate 12*h*. The larger diameter gear 15*c*2 of the step gear 15*c* is meshed with the stirring gear 15*d* attached to the rear end of the shaft of the stirring screw 10*g* illustrated in FIG. 2. The stirring gear 15*d* is meshed with the stirring gear 15*e* attached to the rear end of the shaft of the stirring screw 10*h*. The stirring gears 15*d* and 15*e* are provided with an unillustrated journal which projects from the center of each stirring gear. The end portion of the unillustrated journal of the stirring gear 15*d* (15*e*) is provided with an unillustrated connecting portion by which the journal is connected to the stirring screw 10*g* (10*h*). This connecting portion is also an integral part of the stirring gear (15*e*). The unillustrated journal of the stirring gear 15*d* (15*e*) is inserted into an unillustrated hole (with bearing surface) of the end plate 12*h* of the developing means frame 12, being rotatably supported by the end plate 12*h*, and the connecting portion is connected to the rear end of the shaft of the stirring screw 10*g* (10*h*) and drives the stirring screw 10*g* (10*h*).

The front end of the shaft of the stirring screw 10*g* (10*h*) is provided with a center hole. Referring to FIG. 14, the end plate 12*i* of the developing means frame 12, which is on the opposite side of the developing means frame 12 with respect to the aforementioned end plate 12*h* of the developing means frame 12, is provided with supporting shafts 19*g* and 19*h*, which are anchored, by press-fitting, in the holes made in the end plate 12*i*, perpendicular to the end plate 12*i*, and project inward of the developing means frame 12 in terms of the longitudinal direction. The inward end of the supporting shafts 19*g* (19*h*) is inserted into the aforementioned center holes of the front end of the shaft of the stirring screw 10*g* (10*h*), rotatably supporting the stirring screw 10*g* (10*h*). With the provision of the above structural arrangement, as the driving force is transmitted from the apparatus main assembly 14 to the process cartridge B in the apparatus main assembly 14, the developing means driving coupling 39 is rotated. As a result, the developing means driving gear 15*a* integral with the developing means driving coupling 35 rotates the development roller gear 15*b*. Consequently, the development roller 10*d* rotates. Further, the developing means driving gear 15*a* drives the stirring gear 15*d* through the step gear 15*c*, and the stirring gear 15*d* transmits its rotation to the stirring gear 15*e*. As a result, the stirring screws 10*g* and 10*h* rotate and stir toner while circulating toner.

The aforementioned development roller 10*d* is made to rotate in the same direction as the photosensitive drum 7. Thus, in the area in which the distance between the peripheral surfaces of the development roller 10*d* and photosensitive drum 7 is smallest, that is, the development station, the two peripheral surfaces move in the opposite directions. Therefore, in the development station, the spacer rollers 10*j* (FIG. 17) rotatably fitted around the longitudinal ends of the development roller 10*d* rotate in the same direction as the photosensitive drum 7 while rotating in the direction opposite to the rotational direction of the development roller 10*d*.

Referring to FIG. 21, the aforementioned gears 15*a*, 15*b*, 15*c*, 15*d*, and 15*e* are covered with the rear cover 17 directly fixed to the end plate 12*h* of the developing means frame 12.

(Driving of Charge Roller)

Figure 23:
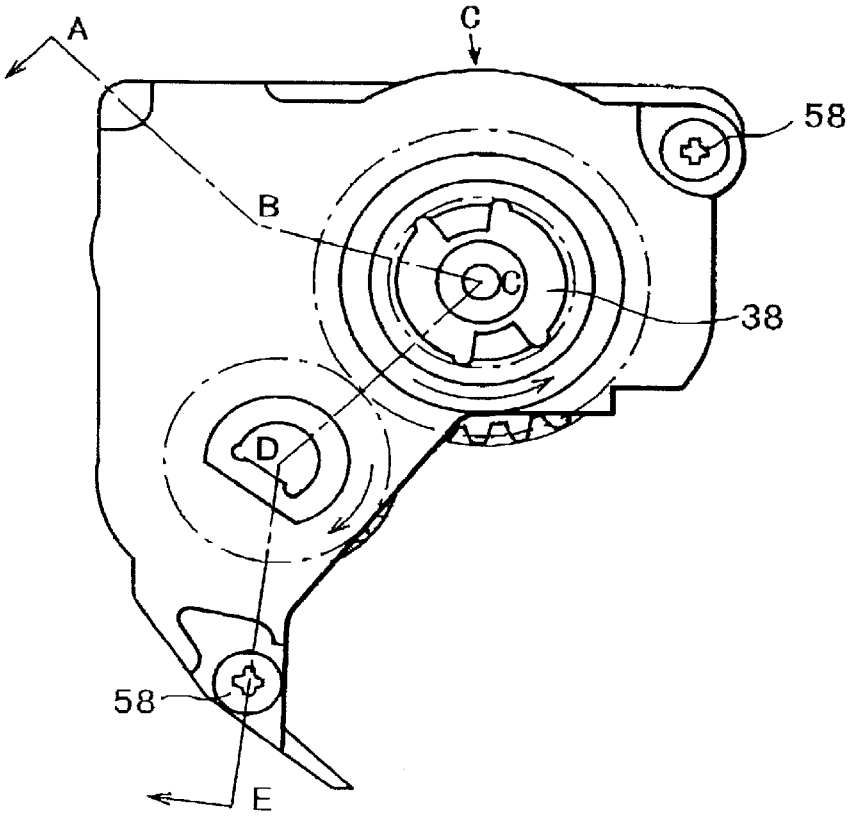
FIG. 23 is a front view of the charging unit.
Figure 24:
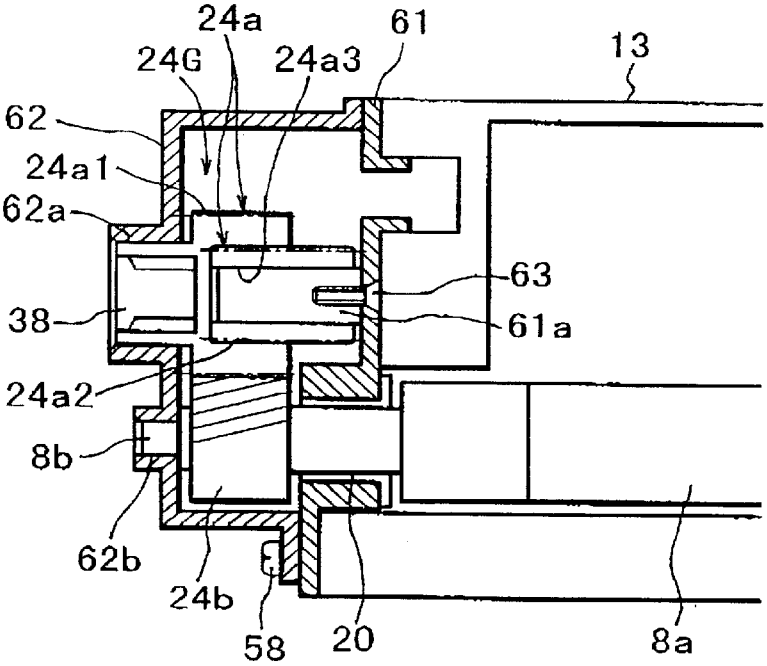
FIG. 24 is a sectional view of the charging unit, at the planes indicated by the lines A-B-C-D in FIG. 23.

Referring to FIGS. 11, 23, and 24, the gear unit 24 fixed to the rear end portion of the charge unit C in terms of the longitudinal direction comprises a two piece gear case formed of gear case pieces 61 and 62, and a gear train 24G covered by the gear case pieces 61 and 62.

The gear case pieces 61 and 62 are constructed so that they become separable from each other in the longitudinal direction. The gear case piece 61 is placed in contact with the rear end portion of the charging means frame 13, and the gear case piece 62 is placed in contact with the gear case piece 61. Both pieces 61 and 62 are fixed to the charging means frame 13 with the use of small screws 58 put through both pieces 61 and 62.

FIG. 23 is a front view of the charge unit C, that is, a plan view of the rear end of charge unit C in terms of the direction in which the process cartridge B is inserted. FIG. 24 is an internal view of the charge unit C exposed at the planes indicated by the lines A-B-C-D-E in FIG. 23. The charging means driving coupling 38 on the cartridge side is provided with a step gear 24*a* integral with the coupling 38. In the center hole 24*a*3 of the step gear 34*a*, a supporting shaft 61 a, which is fixed to the gear case piece 61 with the use of a small screw 63, and extends outward in the longitudinal direction, is rotatably fitted. Incidentally, the supporting shaft 61*a* may be integrally formed with the gear case piece 61. The charge roller 8*a* is rotatably supported by the charge roller bearing 20 on the rear side fitted in the component mounting portion 13*f* of the charging means frame 13. The large diameter gear portion 24*a*1 of the step gear 24*a* is meshed with a charge roller gear 24*b* fixed to one end of the charge roller 8*a*. In a hole 62*b* of the gear case piece 62, one end of the magnet 8*b* is supported. The large diameter gear portion 24*a*1 of the step gear 24*a* and the small diameter gear portion 24*a*2 of the step gear 24*a* are fixed to each other by press-fitting the latter into the former. However, the two gear portions 24*a*1 and 24*a*2 may be integrally formed.

(Process Cartridge Driving Apparatus)

The apparatus main assembly 14 is provided with a driving apparatus for driving the process cartridge B. This driving apparatus is a driving unit comprising three couplings: a coupling which couples with the photosensitive drum driving coupling 37*d* on the cartridge side, a coupling which couples with the charging means driving coupling 38 on the cartridge side, and a coupling which couples with the developing means driving coupling 39 on the cartridge side. Incidentally, since the photosensitive drum driving apparatus illustrated in FIGS. 19 and 20 is different in configuration from that in this embodiment, the referential codes used in FIGS. 19 and 20 are not used for the description of this embodiment.

Each of the above described three couplings is driven by its own driving force source. As described previously, on the side of the coupling on the process cartridge side, the cartridge frame positioning portion and photosensitive drum positioning portion are placed on the same shaft, but apart from each other. Therefore, the photosensitive drum 7, the charge roller 8*a*, and the development roller 10*d* are not affected by the driving systems that do not belong to them, rendering this embodiment superior, in particular, in the smoothness of the rotation of the photosensitive drum 7 and the speed at which the apparatus starts up. Referring to FIG. 1, behind each of the process cartridges B (BK, BM, BC, and BB), different in toner color, and in the cartridge mounting space of its own in the apparatus main assembly 14, a driver unit is located. As the process cartridge B is inserted into the cartridge mounting space in the longitudinal direction (axial direction of photosensitive drum 7), each coupling as a driving force receiving member on the process cartridge side engages with its counterpart, or a coupling as the driving force transmitting member on the driving unit side.

Figure 25:
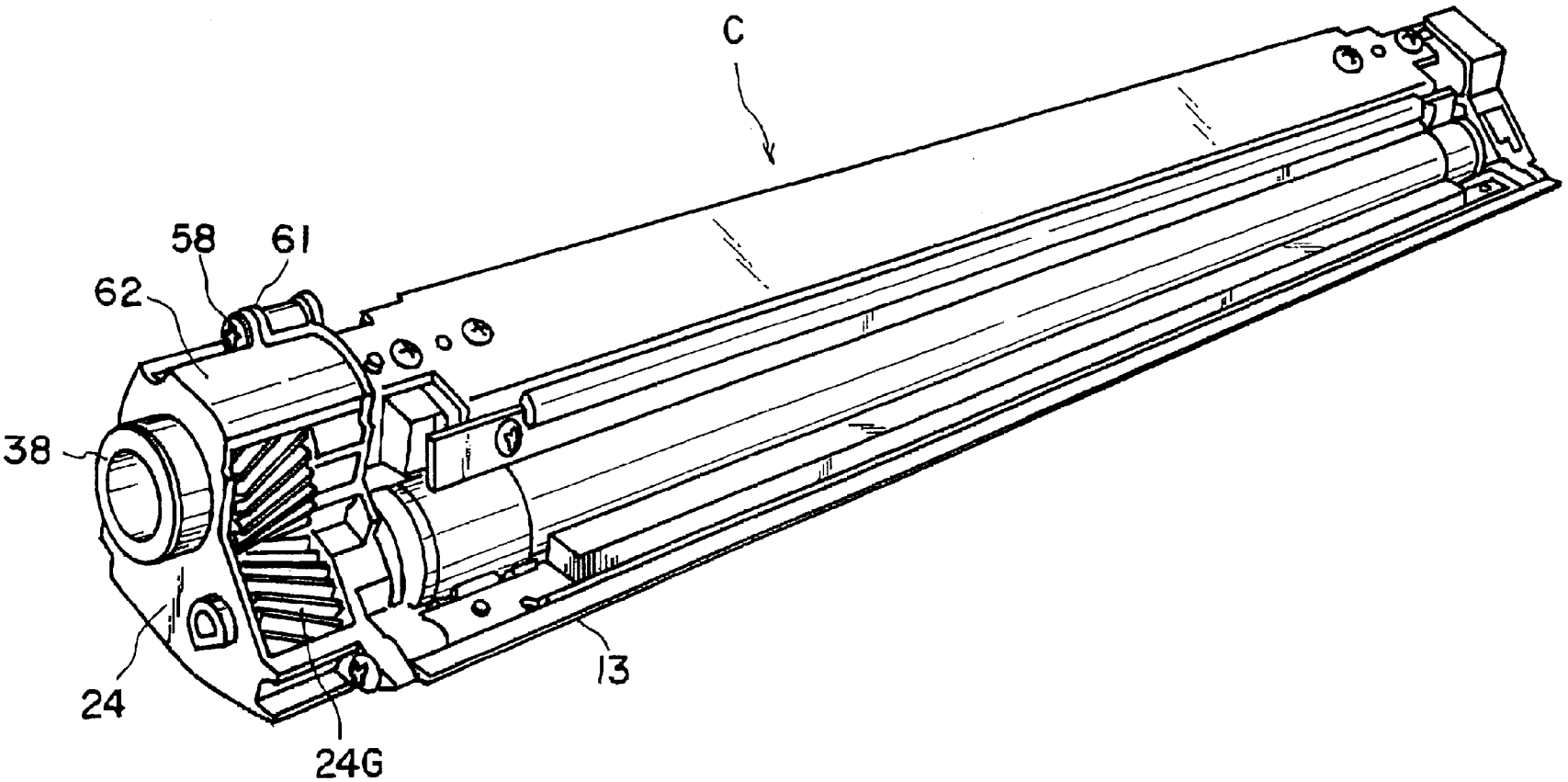
FIG. 25 is a perspective view of the charging unit.
Figure 26:
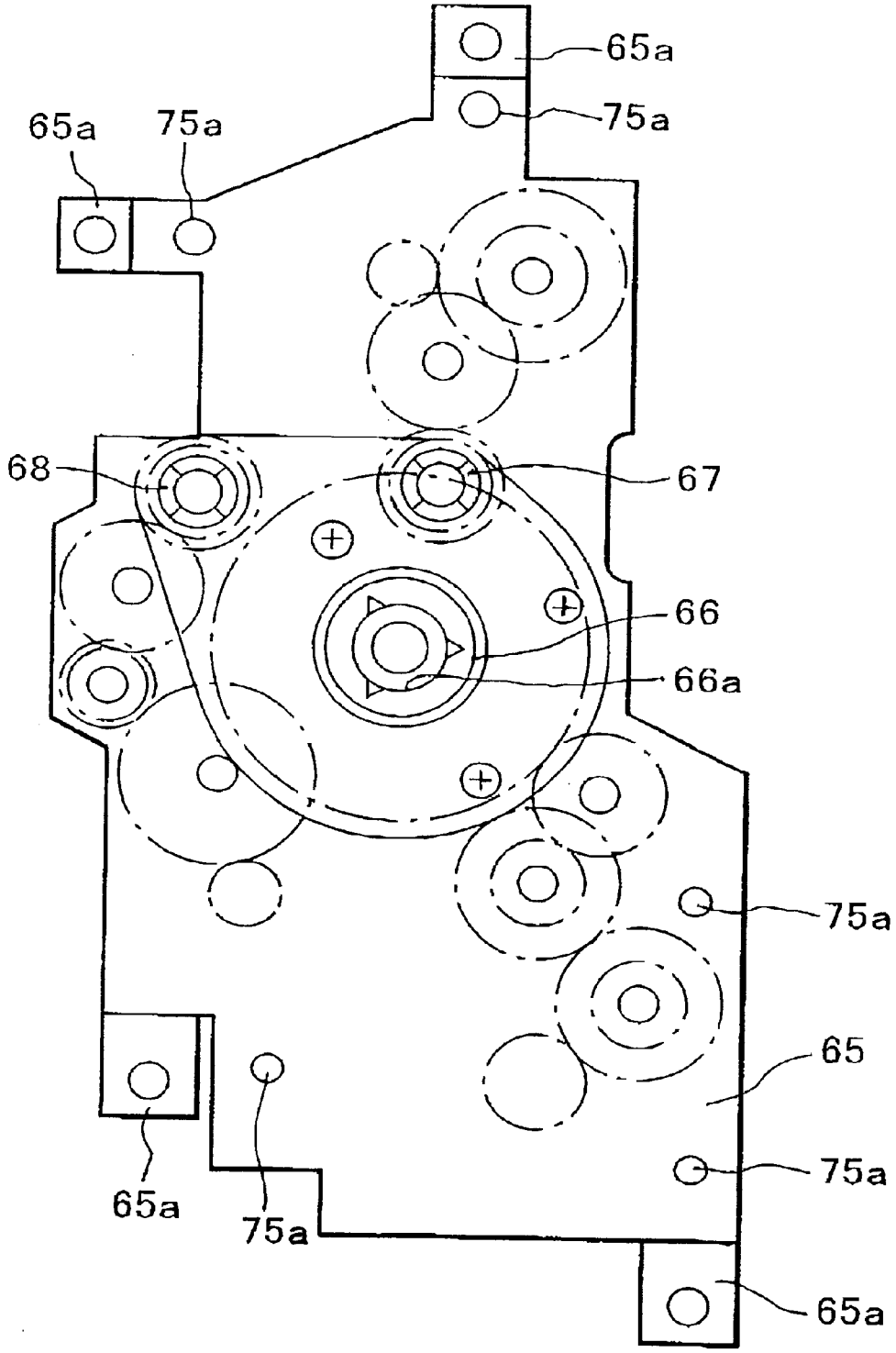
FIG. 26 is a front view of the driving unit on the apparatus main assembly side.
Figure 27:
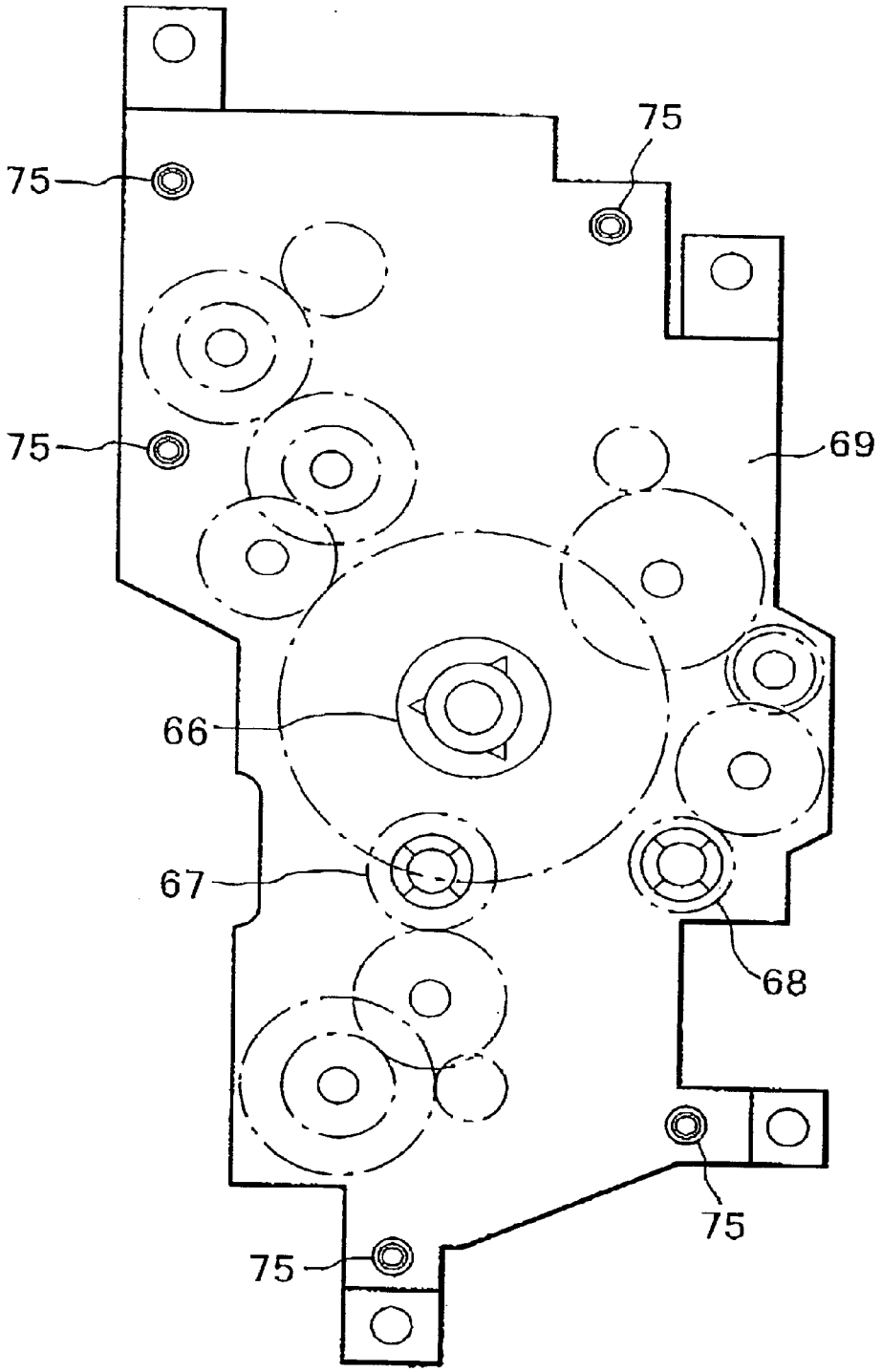
FIG. 27 is a front view of the driving unit on the apparatus main assembly side, with the front plate in FIG. 26 removed.
Figure 28:
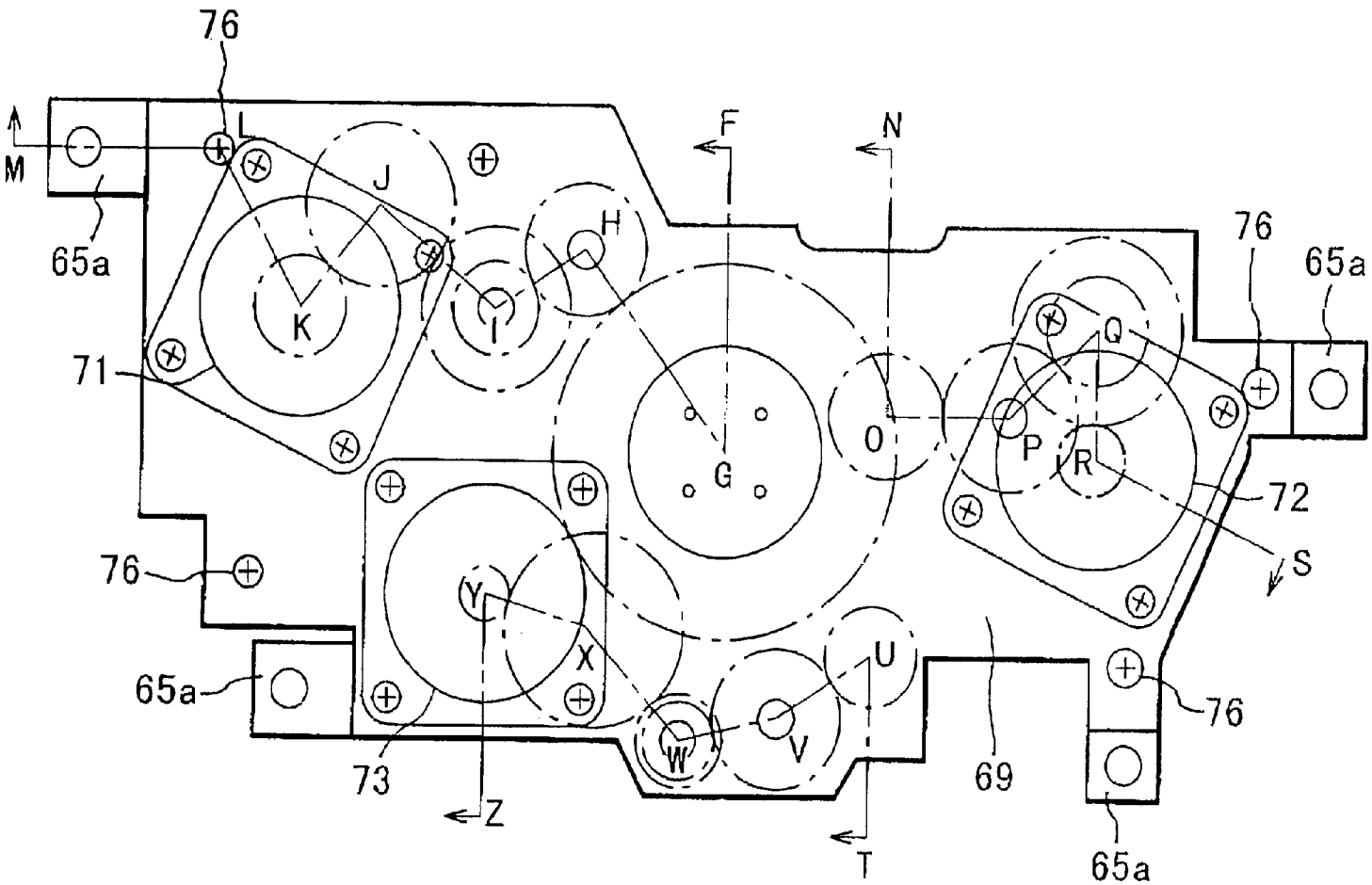
FIG. 28 is a rear view of the driving unit on the apparatus main assembly side.
Figure 29:
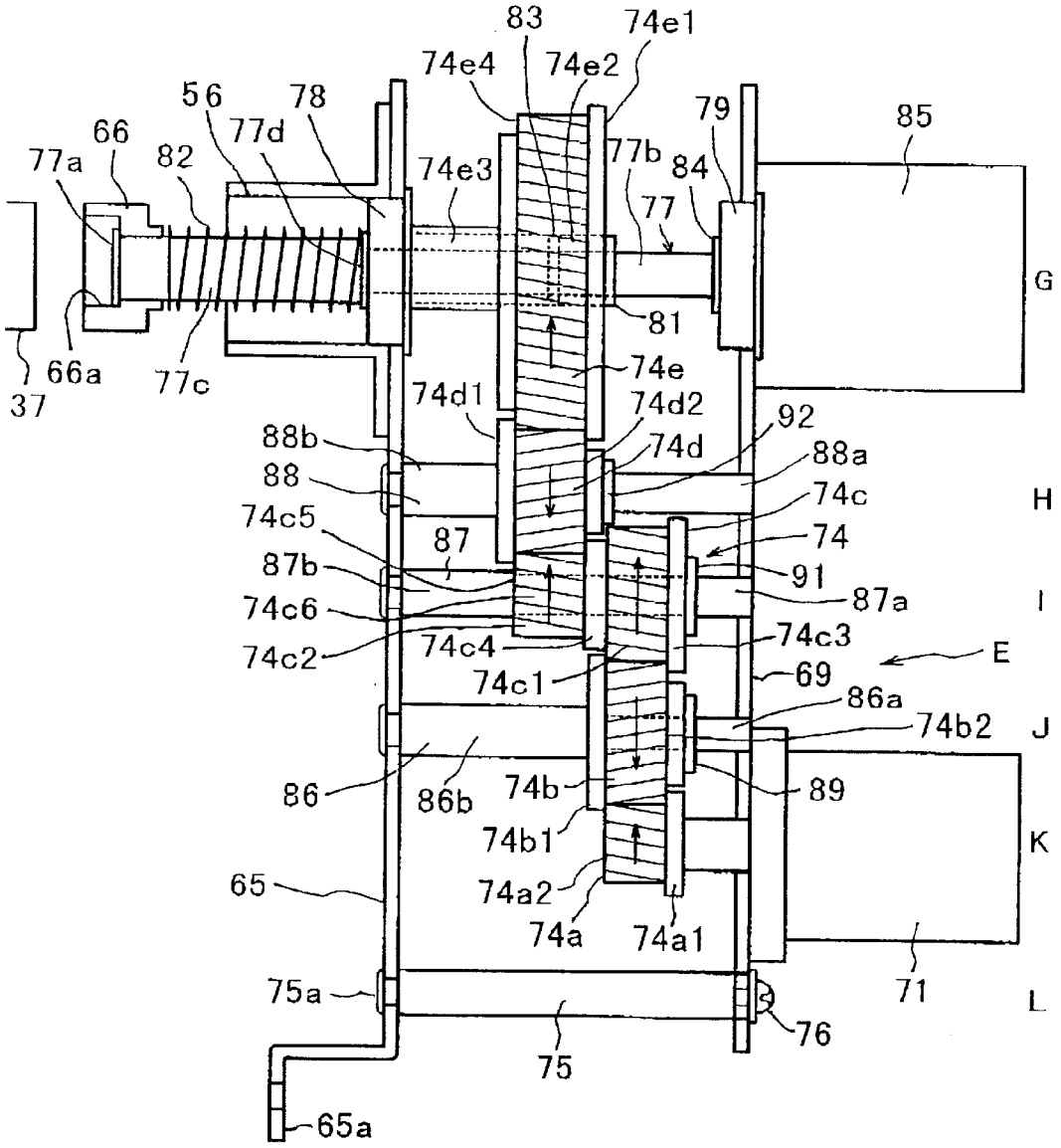
FIG. 29 is a sectional view of the driving unit on the apparatus main assembly side, at the planes indicated by the lines F-G-H-I-J-K-L-M in FIG. 28.
Figure 30:
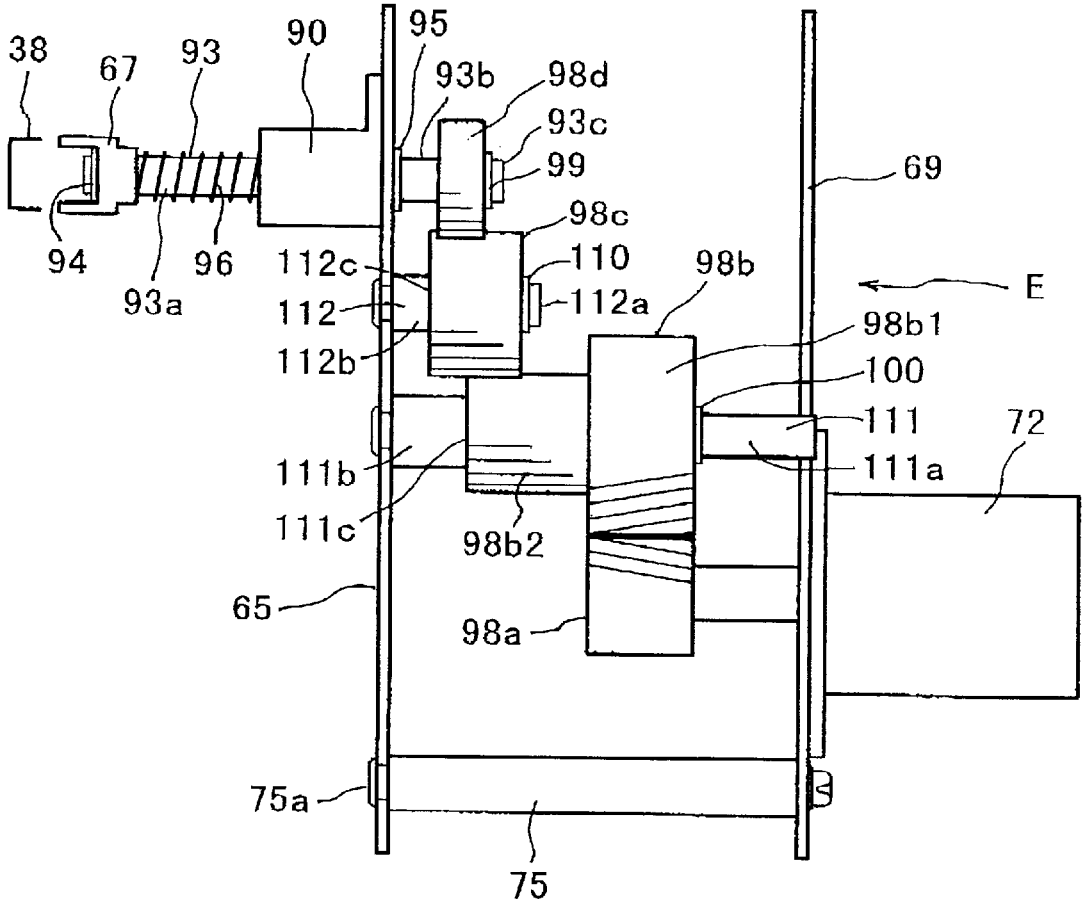
FIG. 30 is a sectional view of the driving unit on the apparatus main assembly side, at the planes indicated by the lines N-O-P-Q-R-S in FIG. 28.

FIG. 25 is a perspective view of the driving unit, and FIG. 26 is a front view of the driving unit in FIG. 25, with its front plate removed. FIG. 27 is a rear view of the same driving unit. In FIGS. 26 and 27, the gears are represented by only their pitch circles. FIG. 28 is a sectional view of the driving unit, exposed at the planes indicated by the line F-G-H-I-J-K-L in FIG. 27, and FIG. 29 is a sectional view of the driving unit, exposed at the planes indicated by the line N-O-P-Q-R-S in FIG. 27. FIG. 30 is a sectional view of the driving unit, exposed at the planes indicated by the line T-U-V-W-X-Y-Z in FIG. 27.

Referring to FIG. 26, the driving unit has three couplings: the photosensitive drum driving coupling 66, or the primary coupling, with a coupling hole 66*a*, with or from which the coupling projection 37*d* on the process cartridge side is engaged or disengaged; the charging means driving coupling 67 with or from which the charging means driving coupling 38 on the process cartridge side is engaged or disengaged; and the developing means driving coupling 68 with or from which the developing means driving coupling 39 on the process cartridge side is engaged or disengaged. These couplings 66, 67, and 68 project frontward, that is, toward the direction from which the process cartridge B is inserted (front side with respect to the surface of the sheet on which FIG. 25 is drawn), from the front plate 65.

Referring to FIG. 27, on the outward side of the rear plate 69, there are a motor 71 as the driving power source for driving the photosensitive drum 7, a motor 72 as the driving power source for driving the charge roller 8*a*, and a motor 73 as the driving power source for driving the development roller 10*d*, which are fixed to the rear plate 69. The shaft of each of the motors 71, 72, and 73 extends between the front and rear plates 65 and 69. The motor 71 for driving the photosensitive drum 7 is a servo-motor, and its shaft extends rearward past the rear plate 69.

The front and rear plates 65 and 69, which are flat, are connected to each other with a plurality of stays 75 so that the front and rear plates 65 and 69 are held parallel to each other. Referring to FIGS. 28–30, one end of each stay 75 is fixed to the front plate 65 by a portion 75*a*, and with the use of swaging, and the other end is fixed to the front surface of the rear plate 69 with the use of a small screw 76 which is screwed into the stay 75, through the hole in the rear plate 69, from the backside of the rear plate 69. The front plate 65 is provided with a plurality of driving unit anchoring portions 65*a* for anchoring the driving unit E to the apparatus main assembly 14. These driving unit anchoring portions 65*a* are offset frontward from the front plate, by the same distance so that their offset surfaces remain in the same vertical plane. In this embodiment, the number of the driving unit anchoring portions 65*a* is four. The driving unit E is anchored to the apparatus main assembly 14 with the use of small screws (unillustrated).

Referring to FIG. 28, there is a gear train 74 between the photosensitive drum driving coupling 66 and the motor 71. (Photosensitive Drum Driving Apparatus)

Also referring to FIG. 29, a coupling shaft 77 is supported by a bearing 78 fitted in a hole of the front plate 65, and a bearing 79 fitted in a hole of the rear plate 69. Around a shaft portion 77*c*, which has a D-shaped cross section, and is smaller in diameter than the flange portion 77*a* at the front end, the photosensitive drum driving coupling 66 on the main assembly side is fitted, in a manner to allow the coupling 66 to move freely in the shaft direction. Between the flange with which the bearing 78 is provided, and the photosensitive drum driving coupling 66 on the main assembly side, a compression coil spring 82 is fitted, in the compressed state, around the shaft portion 77*c* with the D-shaped cross section, and therefore, the coupling 66 is kept in contact with the flange 77*a* at the front end of the shaft portion 77*c* with the D-shaped cross section, by the pressure from the compression coil spring 82. The diameter of the shaft portion 77*b*, which is put through the bearing 78, is the same all the way from the front side to the rear end, but is smaller than the diameter of the shaft portion 77*a* with the D-shaped cross section, creating a stepped portion. This stepped portion is where the front surface of the bearing 78 is in contact, whereas the rear surface of the bearing 78 is in contact with the boss 74*e*3 of a large diameter gear 74*e*. The large diameter gear 74*e* is prevented from moving in the shaft direction, by a stopper ring 81 which contacts the large diameter gear 74*e*, on the side opposite to where the large diameter gear 74*e* contacts the bearing 78. The stopper ring is fitted in a circumferential groove of the shaft portion. In a key slot 74*e*2 cut in the large diameter gear 74*e*, a pin 83 put through the shaft portion 78*e*1 in the diameter direction is fitted, to assure that the large diameter gear 74*e* fitted around the coupling shaft 74 rotates with the coupling shaft 77. The bearing 79 with a flange, which is inserted in the hole of the rear plate 69, is prevented from moving in the shaft direction, by a stopper ring 84 fitted in the circumferential groove of the shaft portion 77*b*. The coupling shaft 77 is provided with a detecting means for detecting the rotational angle of the coupling shaft 77, such as an encoder 85, which projects rearward from the rear plate 69. The detecting means is used for controlling the photosensitive drum 7.

A gear 74*b* meshed with the pinion gear 74*a* fixed to the output shaft of the motor 71 is meshed with the large diameter gear 74*c*1 of the step gear 74*c*. A gear 74*d* meshed with the small diameter gear 74*c*2 of the step gear 74*c* is meshed with the large diameter gear 74*e*. The intermediary gears 74*b*, 74*c*, and 74*d* are rotatably fitted around the small diameter portions 86*a*, 87*a*, and 88*a*, of their own shafts 86, 87, and 88, correspondingly. These gears are prevented from moving in their shaft directions, except for a very slight distance, by the stepped portions between the large diameter portions 86*b*, 87*b*, and 88*b* of the shafts 86, 87, and 88, and the shaft portions 86*a*, 87*a*, and 88*a* smaller in diameter than the large diameter portion 86*b*, 87*b*, and 88*a*, and stopper rings 89, 91, and 92 fitted in the circumferential grooves of the smaller diameter portions 86*a*, 87*a*, and 88*a*, correspondingly. One end of each of the shafts 86, 87, and 88 is fixed in a hole of the front plate 65 by swaging, and the other end is simply fitted in the hole of the rear plate 69.

The gears 74*a*–74*e* are helical gears. The pinion gear 74*a* is a right-hand helix twist gear, and the large diameter gear 74*e* is also a right-hand helix twist gear.

Referring to FIG. 29, the gears 74*a*–74*e* are provided with flanges 74*a*1, 74*b*1, 74*c*3, 74*c*4, 74*d*1, and 74*e*1, correspondingly. The side surface of the flange of each gear is in contact with the side surface of the gear with which this gear is meshed. The position of the flange of each gear, with respect to the gear to which the flange is attached, is on the side opposite to the flange of the gear with which this gear is meshed, in terms of the shaft direction.

Each gear rotates in such a direction that its peripheral surface moves in the direction indicated by an arrow mark in FIG. 28. In other words, it rotates in such a direction that the photosensitive drum 7 rotates in the counterclockwise direction as shown in FIG. 1.

As the motor 71 rotates, the gear 74*b* meshed with the gear 74*a* of the output shaft of the motor 71 is subjected to thrust which pushes it rightward in FIG. 29. The thrust is caught by the side surface 74*b*2 of the gear 74*b* as the side surface 74*b*2 of the gear 74*b* comes into contact with, and slides on, the flange 74*a*1 integral with the pinion gear 74*a*, and/or the flange 74*c*3 of the large diameter gear 74*c*1 of the step gear 74*c*; by the flange 74*b* of the gear 74*b* and the side surface 74*a*2 of the pinion gear 74*a* of the motor shaft; and/or by the flange 74*b*1 as it comes into contact with the side surface 74*c*6 of the large diameter gear 74*c*1 of the step gear 74*c*. All that is necessary is for the thrust to be caught by one of the above listed portions. In consideration of manufacture errors, the number of the portions which catch the thrust may be only one.

The directions in which the large diameter gear 74*c*1 and small diameter gear 74*c*2 of the step gear 74*c* are twisted are the same, and are subjected to thrust that pushes them leftward in FIG. 29. This thrust is caught by the side surface 74*b*2 of the gear 74*b* as the flange 74*c*3 of the large diameter gear 74*c*1 of the step gear 74*c* comes into contact with the side surface 74*b*2 of the gear 74*b*; by the side surface 74*d*2 of the gear 74*d*, as the flange 74*c*4 of the small diameter gear 74*c*2 comes into contact with the side surface 74*d*2 of the gear 74*d*; by the flange 74*d*1, as the side surface 74*c*5 of the small diameter gear 74*c*2 comes into contact with the flange 74*d*1; and/or by the flange 74*b*1 of the gear 74*b*, as the side surface 74*c*7 of the large diameter gear 74*c*1 comes into contact with the flange 74*b*1 of the gear 74*b*. In other words, this thrust is caught by at least one of the above listed portions.

The thrust from the gear 74*d* applies rightward in FIG. 29, and is caught by the contact between the flange 74*d*1 and the side surface 74*c*5 of the small diameter gear 74*c*2 of the step gear 74*c*, the contact between the side surface 74*d*2 of the gear 74*d* and the flange 74*c*4 of the small diameter gear 74*c*2 of the step gear 74*c*, the contact between the side surface 74*d*2 of the gear 74*d* and the flange 74*e*1 of the large diameter gear 74*e*, and/or the contact between the flange 74*d*1 and the side surface 74*e*4 of the large diameter gear 74*e*. In other words, this thrust is caught by any one or more among the above listed contacts. As described before, the large diameter gear 74*e* is mounted on the coupling shaft 77 in such a manner that it does not move in the shaft direction.

Further, the positions of the intermediary gears 74*b*, 74*c*, and 74*d* in terms of the shaft direction are fixed by the stepped portion between the large diameter portions 86*b*, 87*b*, and 88*b* of the shafts 86, 87, and 88, and the small diameter portions 86*a*, 87*a*, and 88*a* of the shaft 86, 87, and 88, and also by the stopper rings 89, 91, and 92, correspondingly. Therefore, the thrust upon the intermediary gears 74*b* and 74*d* is blocked by the stopper rings 89 and 90, respectively, and the thrust upon the intermediary gear 74*c* is blocked by the stepped portion of the shaft 87.

With the provision of the above-described structural arrangement, the position of the pinion gear 74*a* of the motor shaft, and the position of the large diameter gear 74*e* on the coupling shaft 77, relative to their own shafts, with respect to the shaft direction, are fixed by their own shafts. However, the positions of the pinion gear 74*a* of the motor shaft, large diameter gear 74*e* on the coupling shaft 77, and intermediary gears 74*b*, 74*c*, and 74*d*, with respect to the shaft direction, are controlled by the contacts between their flanges and the side surfaces of the pertinent gears, and therefore, the intermediary gears 74*b*, 74*c*, and 74*d* are afforded a slight movement in their shaft directions.

(Charge Roller Driving Apparatus)

FIG. 30 shows the charging means driving apparatus portion of the apparatus main assembly 14, equipped with a coupling which can be engaged with or disengaged from the charging means driving coupling 38 on the cartridge side. The charging means driving coupling 67 on the main assembly side (driving side) is mounted on the shaft, which aligns with the shaft of the charging means coupling 38 on the process cartridge side as the process cartridge B is inserted into the apparatus main assembly 14. It is mounted on the shaft in such a manner that as the process cartridge B is inserted into, or removed from, the apparatus main assembly 14, it engages with, or disengages from, the charging means coupling 38 on the process cartridge side. These couplings are in the form of one side of a claw (tooth) clutch; in other words, their coupling portions are provided with a pair of teeth (ridges) and a pair of gaps (valleys), being enabled to lock themselves with their counterparts to transmit a rotational force. The charging means coupling 67 on the main assembly side is mounted on a coupling shaft 93 in such a manner that it is movable in the direction of the coupling shaft 93. The coupling shaft 93 is rotatably supported by an unillustrated bearing fitted in a bracket 90 fixed to the front plate 65, being allowed to move in its axial direction. A portion 93*a* of the coupling shaft 93, around which this coupling 67 is fitted, has a D-shaped cross section. This shaft portion 93*a* with the D-shaped cross section fits into the D-shaped hole of the coupling 67, and therefore, the coupling shaft 93 and coupling 67 rotate together. The two circumferential grooves of the coupling shaft 93, one at the front end of the coupling 93 and the other immediately behind the front plate 65, are fitted with stopper rings 94 and 95, respectively. Between the coupling 67 and bracket 90, a compression coil spring 96 is fitted, in the compressed state, around the coupling shaft 93.

A pinion gear 98*a* fixed to the shaft of the motor 72 fixed to the rear plate 69 is meshed with the large diameter gear 98*b*1 of a step bear 98*b*, and the gear 98*c* meshed with the small diameter gear 98*b*2 of the step gear 98*b* is meshed with a gear 98*d* fixed to the rear end of the coupling shaft 93. The rear end portion 93*c* of the coupling shaft 93 is reduced in diameter, creating a step 93*b*. The cross section of this rear end portion 93*c* is D-shaped. The gear 98*d* is prevented from moving on the coupling shaft 93 in the shaft direction, by this step 93*b*, and a stopper ring 99 fitted in the circumferential groove with which the shaft portion 93*c* with the D-shaped cross section is provided. In order to assure that the gears 98*c* and 98*d* remain always meshed with each other, in spite of the fact that the gear 98*d* is allowed to move with the coupling shaft 93, a certain distance in the shaft direction, the face width of the gear 98*c* is rendered greater than that of the gear 98*d*.

One side of the step gear 98*b* is rotatably supported by the reduced diameter portion 111*a* of the shaft 111, one end of which is fixed to the front plate 65 by swaging, and the other end of which is simply fitted in a hole of the rear plate 69. The step gear 98*b* is prevented from moving on the nonrotational shaft 111 in the shaft direction, by a step 111*c* between the larger diameter portion 111*b* and reduced diameter portion 111*a* of the nonrotational shaft 111, and the stopper ring 100 fitted in the circumferential groove of the reduced diameter portion 111*a*. The pinion gear 98*a* and the large diameter gear 98*b*1 of the step gear 98*b* are helical gears.

The gear 98*c* is fitted around the reduced diameter portion 112*a* of a nonrotational shaft 112, one end of which is inserted in the hole of the front plate 65 and fixed thereto by swaging. The movement of the gear 98*c* in the shaft direction is controlled by a step 112*c* between the larger diameter portion 112*b* and reduced diameter portion 112*a* of the nonrotational shaft 112, and a stopper ring 110 fitted in the circumferential groove of the reduced diameter portion.

(Development Roller Driving Apparatus)

Figure 31:
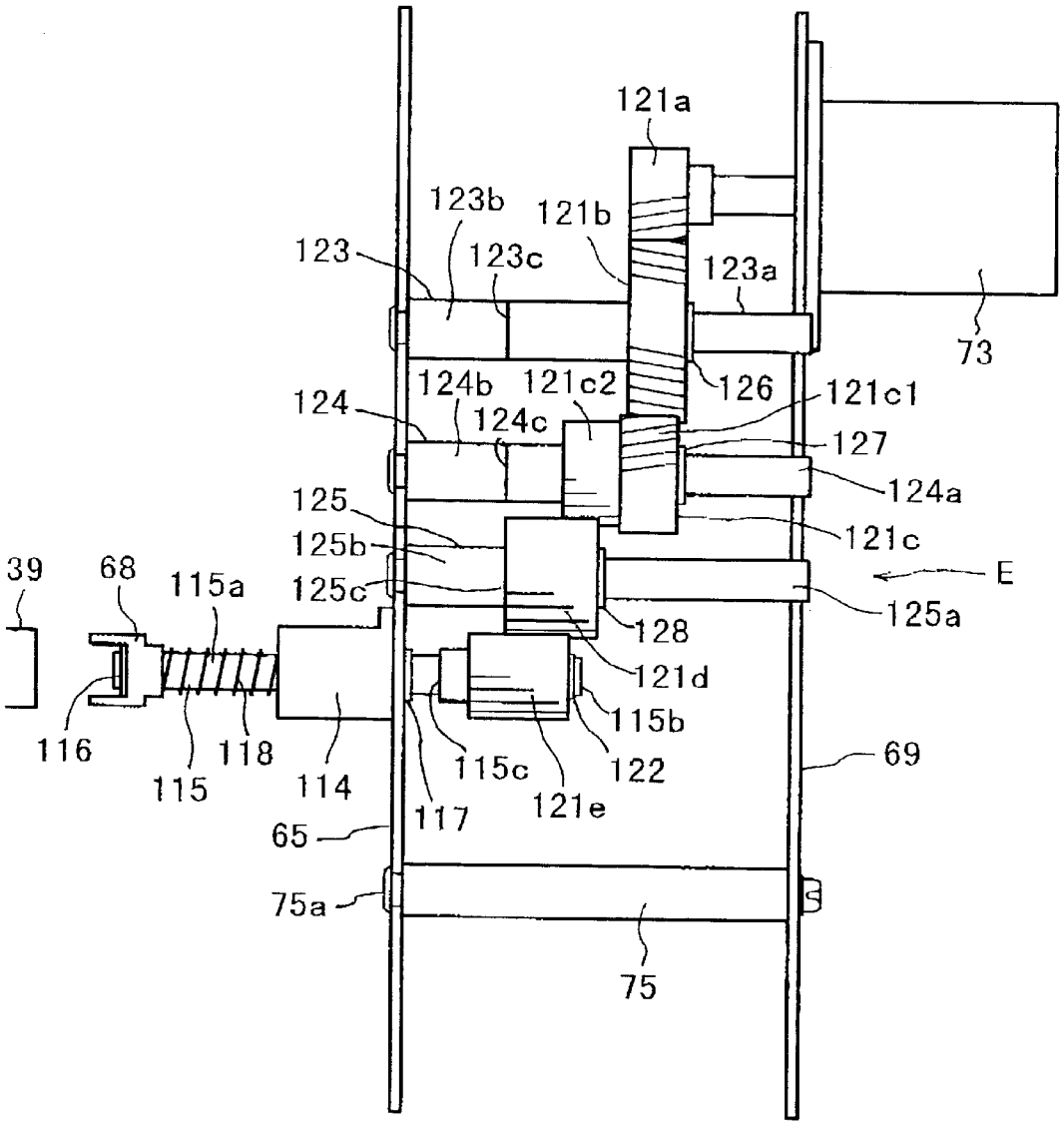
FIG. 31 is a sectional view of the driving unit on the apparatus main assembly side, at the planes indicated by the lines T-U-V-W-X-Y-Z in FIG. 28.

FIG. 31 shows a development roller driving apparatus portion of the image forming apparatus, on the main assembly side. On a shaft in alignment with the shaft of the developing means driving coupling 39 on the process cartridge side, a developing means driving coupling 68 on the apparatus main assembly side, is mounted in such a manner that the two couplings can be engaged or disengaged. This pair of couplings constitute a claw (tooth) type clutch; in other words, the coupling surface of each coupling is provided with a pair of teeth (ridges) and a pair of tooth gaps (valleys), which lock with those of the counterpart to transmit a rotational force.

The developing means driving coupling 68 on the apparatus main assembly side is mounted on a coupling shaft 115, being allowed to move in the shaft direction. The coupling shaft 115 is rotatably borne by an unillustrated bearing fitted in a hole of a bracket 114 fixed to the front plate 65, being enabled to move in its longitudinal direction. The portion 115*a* of the coupling shaft 115 around which the developing means driving coupling 68 on the main assembly side is fitted is given a D-shaped cross section; the shaft portion 115*a* with the D-shaped cross section fits in the D-shaped hole of the aforementioned coupling 68 so that the coupling 68 and coupling shaft 115 rotate together. The coupling shaft 115 is provided with two circumferential grooves, one being at the front end and the other being immediately behind the front plate 65, and the front groove is fitted with a stopper ring 116 and the rear groove is fitted with a stopper ring 117. Between the developing means driving coupling 68 on the apparatus main assembly side and the bracket 114, a compression coil spring 118 is fitted, in the compressed state, around the coupling shaft 115.

With the pinion gear 121*a* fixed to the motor shaft of the motor 73 fixed to the rear plate 69, the large diameter gear 121*c*1 of a step gear 121*c* is engaged, with the interposition of a gear 121*b*. A gear 121*d*, meshed with the smaller diameter gear 121*c*2 of the step gear 121*c*1, is meshed with a gear 121*e* fixed to the rear end of the coupling shaft 115. The rear end portion 115*b* of the coupling shaft 115 is reduced in diameter, creating a step 115*c*. This reduced diameter shaft portion 115*b* is given a D-shaped cross section. The gear 121*e* is prevented from moving in the shaft direction, by this step 115*c*, and a stopper ring 122 fitted in a circumferential groove with which the reduced shaft portion 115*b* with the D-shaped cross section is provided.

The gear 121*b*, the step gear 121*c*, and the gear 121*d* are rotatably supported by the reduced diameter portions 123*a*, 124*a*, and 125*a* of their own nonrotational shafts 123, 124, and 125, which are fixed, by one end, to the front plate 65 by swaging, and are fitted, by the other end, in the holes of the rear plate 69, correspondingly. The gears 121*b*, 121*c*, and 121*d* are prevented from moving in the shaft direction, by the steps 123*c*, 124*c*, and 125*c* between the larger diameter portions 123*b*, 124*b*, and 125*b* and reduced diameter portions 123*a*, 124*a*, and 125*b* of the nonrotational shafts 123, 124, and 125, and the stopper rings 126, 127, and 128 fitted in the circumferential grooves of the reduced diameter portion 123*a*, 124*a*, and 125*a*, correspondingly. The pinion gear 121 a, gear 121*b*, and larger diameter gear 121*c*1 of the step gear 121*c* are helical gears.

As described above, the driving apparatus E with which the apparatus main assembly 14 is provided to drive the process cartridge B comprises: the photosensitive drum driving coupling 66, charging means driving coupling 67, and developing means driving coupling 68. These couplings are independently driven by their own motors, that is, the photosensitive drum driving motor 71, the charging roller driving motor 72, and the development roller driving motor 73, through their own gear trains. In other words, the rotation of the photosensitive drum 7 is not linked to the rotation of the charge roller 8*a*, the development roller 10*d*, the stirring screws 10*g* and 10*h*, and the like, and therefore, the photosensitive drum 7 is not affected by the changes in the load which applies to the stirring screws 10*g* and 10*h*, and the like. Further, during the period in which the photosensitive drum 7 is started up, the photosensitive drum 7 is not subjected to the stirring load of the stirring screws 10*g* and 10*h*, as well as the inertia load of the charge roller 8*a* and the development roller 10*d*, and the gear trains connecting the development roller 10*d*, the stirring screws 10*g* and 10, and the photosensitive drum 7. Therefore, the photosensitive drum 7 is smaller in the change in its rotational velocity, and also faster in its startup.

As the process cartridge B is inserted into the apparatus main assembly 14 in the longitudinal direction, the coupling 37*d* (cartridge side coupling) of the drum flange 37 integral with the photosensitive drum 7 engages into the coupling hole 66*a* of the above described driving unit E with which the apparatus main assembly 14 is provided. When the engagement does not occur, the photosensitive drum driving coupling 66 on the apparatus main assembly side is pushed back (moved rightward) on the coupling shaft 77 in the shaft direction in FIG. 28, against the force from the compression coil spring 82. In this state, the coupling surfaces of the coupling 37*d* and 66*a* are in contact with each other, without fully engaging, due to the pressure from the compression coil spring 82. Thus, as soon as the cartridge side coupling 37*d* and coupling hole 66*a* on the apparatus main assembly side coincide in rotational phase as the motor 71 rotates, the coupling 66 is caused to slide on the coupling shaft 77, by the force from the compression coil spring 82. As a result, the cartridge side coupling 37*d* engages into the coupling hole 6*a* on the apparatus main assembly side. In this state, the position of the coupling 66 on the driving side with respect to the shaft direction is fixed by the contact between the coupling 66 and the flange 77*a*located at the tip of the coupling shaft 77. The cartridge side coupling 37*d*, and the coupling hole 66*a* on the apparatus main assembly side, are in the form of a twisted equilateral triangular pillar, and are configured so that they loosely fit with each other; in other words, the longitudinal ridges of the cartridge side coupling 37*d* in the form of a twisted equilateral triangular pillar make contact with the walls of the coupling hole 66*a* in the form of a twisted equilateral triangular pillar, one for one. Thus, as the main assembly side coupling 66 rotates, such force that causes the two couplings to pull each other while aligning the rotational axes of the cartridge side coupling 37*d* and the main assembly side coupling 66 relative to each other. As a result, the cartridge side coupling 37*d* engages into the coupling hole 66*a* on the main assembly side, until the leading end of the coupling 37*d* in the form of a projection contacts the tip of the coupling shaft 77 where the flange 77*a* is present. The position of the coupling shaft 77 as a driving shaft, relative to the driving unit E fixed to the apparatus main assembly 14, with respect to the shaft direction, is fixed, and therefore, as the cartridge side coupling 37*d* comes into contact with the coupling shaft 77, the position of the photosensitive drum 7 relative to the apparatus main assembly 14 in terms of the shaft direction becomes fixed.

Incidentally, the coupling shaft 77 is pulled leftward in FIG. 28 as the projection of the cartridge side coupling 37*d* and the coupling portion with the hole 66*a* pull each other. However, the boss 74*e*3 of the large diameter gear 74*e* comes into contact with the bearing 78 with a flange, the position of which relative to the front plate 65 is fixed, and therefore, the stopper ring 81 comes into contact with the large gear 74*e*.

As the process cartridge B is inserted into the apparatus main assembly 14, the cartridge side coupling 37*d* engages into the coupling hole 66*a*. At the same time as the occurrence of this engagement, the charging means driving coupling 38 on the cartridge side, and the developing means driving coupling 39 on the cartridge side, engage with the charging means driving coupling 67 on the main assembly side and the developing means driving coupling 68, respectively. During these engagements, the couplings 38 and 67, which face each other, and the couplings 39 and 68, which face each other, engage with each other, as soon as the positions of their teeth align with the positions of the tooth gaps of their counterparts. When the teeth of one coupling 38 meet the teeth of the counterpart, the charging means driving coupling 38 and developing means driving coupling 39 on the cartridge side slide back the charging means driving coupling 67 and developing means coupling 68 on the apparatus main assembly side, on the coupling shafts 93 and 115, against the compression coil springs 96 and 118, respectively. Then, as the charging means driving coupling 67 and developing means driving coupling 98 on the apparatus main assembly side are rotated by the charge roller driving motor 72 and the development roller driving motor 73, the relationships in rotational phase between the coupling 38 and 67, and between the couplings 39 and 68, change until they match. Then, as soon as they match, the couplings 67 and 68 are caused to slide forward on the portions 93*a* of the shaft 93, and the portion 115*a* of the shaft 115, by the force from the compression springs 96 and 118, respectively. As a result, the couplings 67 and 68 engage with the couplings 38 and 39, respectively.

As the photosensitive drum driving motor 71 rotates, the rotation of the motor 71 is transmitted through the pinion gear 74*a*, the gear 74*b*, the step gear 74*c*, the gear 74*d*, the large diameter gear 74*e*, and coupling shaft 77 in this order. As a result, the main assembly side coupling 66 with the coupling hole 66*a* rotates, and then, the rotational force is transmitted to the cartridge side coupling 37*d* from the coupling hole 66*a*, rotating the photosensitive drum 7.

In the description given above, the positional relationship among the intermediary gears for driving the photosensitive drum 7, in the driving unit E, with respect to the direction parallel to their shafts, is determined by the positions of their side surfaces and flanges. As described before, the pinion gear 74*a* and large diameter gear 74*e* are supported in such a manner that they do not move in their shaft directions. Referring to FIG. 29, the gears 74*b* and 74*d* are subjected to rightward thrust, and the step gear 74*c* is subjected to the leftward thrust. However, they catch these thrusts, which they mutually effect, by their flanges and side surfaces. Therefore, the positions of the gears 74*b*, 74*c*, and 74*d* in terms of their shaft directions are fixed in terms of their positional relationship among themselves, as well as relative to the pinion gear 74*e* and large gear 74*e*. During the process in which their positions become fixed, each gear could come into contact with the side surfaces of the flanges of adjacent gears, by a plurality of portions. However, the occurrence of contact between any one of the aforementioned plurality of the portions of each gear with the corresponding portion of an adjacent gear prevents the occurrence of contact between the rest of the portions of this gear with the corresponding portions of the adjacent gear. In other words, the gears 74*b*, 74*c*, and 74*d* are fitted on the nonrotational shafts 86, 87, and 88, between the steps between the large diameter portions 86*b*, 87*b*, and 88*b* and reduced diameter portions 86*a*, 87*a*, and 88*a* of the nonrotational shafts 86, 87, and 88, and the stopper rings 89, 91, and 92, with the provision of a certain amount of play in the shaft direction, making it unnecessary for the positions of these gears with respect to the shaft direction to be precisely fixed.

(Relationship Between Maintenance of Constant Distance Between the Development Roller and the Photosensitive Drum, and the Development Means Driving Gear)

FIG. 31 shows the transmission of the rotational force from the developing driving coupling to the development roller, in terms of the load which applies to the components in the gear train between developing means driving coupling and the development roller.

The development roller 10*d* is fitted with a pair of spacer rings 10*j*, the diameters of which are greater than that of the development roller 10*d* by an amount equivalent to the development gap (shortest distance between peripheral surfaces of the photosensitive drum 7 and the development roller 10*d* in the development station), and which are placed in contact with the peripheral surface of the photosensitive drum 7, so that the aforementioned development gap is provided between the photosensitive drum 7 and development roller 10*d*.

As described before, the photosensitive drum 7 and the development roller 10*d* rotate in the same direction, and therefore, in the development station and the portions outside the development station in the longitudinal direction, their peripheral surfaces move in the opposite directions. Both longitudinal ends of the development roller 10*d* are provided with a journal portion 10*d*1, and the spacer ring 10*j* is rotatably fitted around the inward side of the journal portion 10*d*1, in terms of the longitudinal direction, with the rotational axis of the spacer ring 10*j* being in alignment with that of the journal portion 10*d*1. As described previously with reference to FIG. 18, the journal portion 10*d*1 is rotatably fitted in the hole 32*a* with a bearing surface, of the pivotal arm 32 pivotable about the pressure application center Slv. The pivotal arm 32 is kept under the pressure from the compression coil spring 35 so that the spacer ring 10*j* is kept pressed upon the photosensitive drum 7, outside the development station in terms of the longitudinal direction. Thus, in the area where the distance between the photosensitive drum 7 and the development roller 10*d* is smallest, as the photosensitive drum 7 and the development roller 10*d* rotate, the spacer ring 10*j* follows the rotation of the photosensitive drum 7, moving in the direction opposite to the movement of the peripheral surface of the development roller 10*d*.

Referring to FIG. 31, as the developing means driving coupling 39 receives a rotational force from the coupling 68 of the driving unit of the apparatus main assembly 14, the developing means driving coupling 39 and the driving gear 15*a* rotate in the counterclockwise direction, and the rotation is transmitted from the driving gear 15*a* to the development roller gear 15*b*, causing the development roller 10*d* to rotate in the clockwise direction.

In this embodiment, all gears have involute teeth. Therefore, the transverse line of action of a tooth load F coincides with a straight line slanted relative to the line tangential to the pitch circles, inclusive of the pitch point T, of the gear 15*a* and 15*b*, by only the pressure angle.

The effect of the tooth load upon the contact pressure between the spacer ring 10*j* and photosensitive drum 7 can be reduced by placing them approximately in a horizontal orientation so that the angle formed by the above described transverse line of action of the tooth load, and the line connecting the center of the hole with a bearing surface, of the pivotal arm as the development roller supporting member, and the pivotal center Slv remains within a range of +30°. Therefore, such an arrangement makes it possible to reduce the force necessary to be applied by the compression coil spring 35 through the pivotal arm 32, which in turn makes it possible to reduce the amount of the contact pressure which works between the spacer ring 10*j* and the photosensitive drum when the process cartridge B is not in use. Consequently, the spacer ring 10*j* can be prevented from creeping.

(Pressure Which Works Between the Charge Roller and the Photosensitive Drum)

Figure 32:
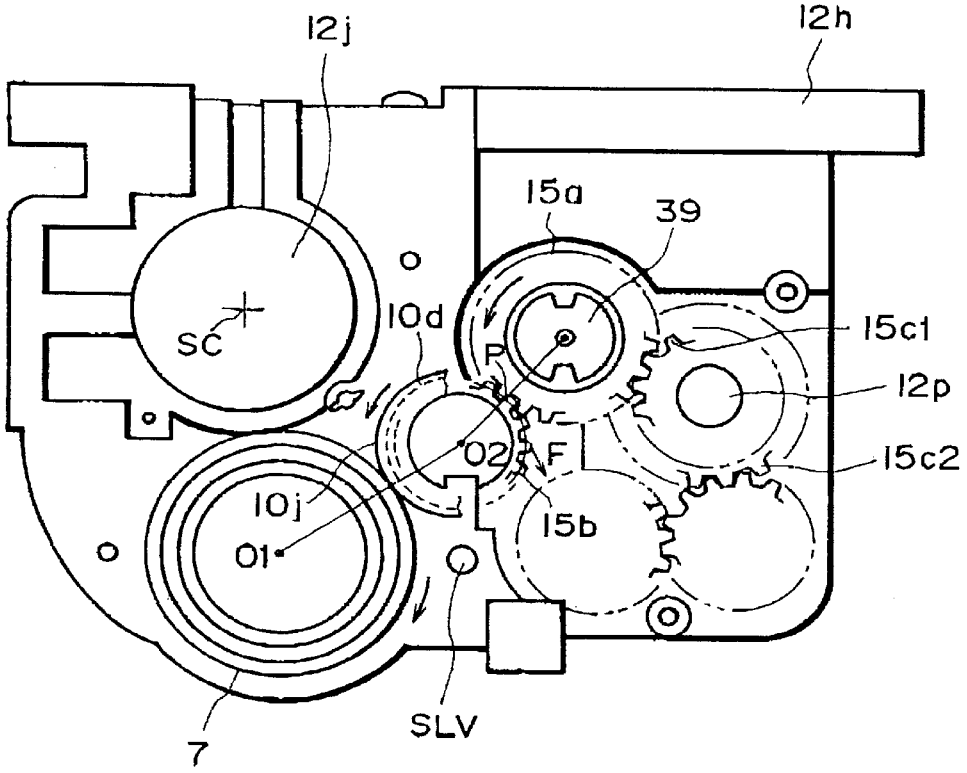
FIG. 32 is a rear view of the driving apparatus for the development sleeve, and shows the relationship, in terms of load, among the components in the driving apparatus.
Figure 33:
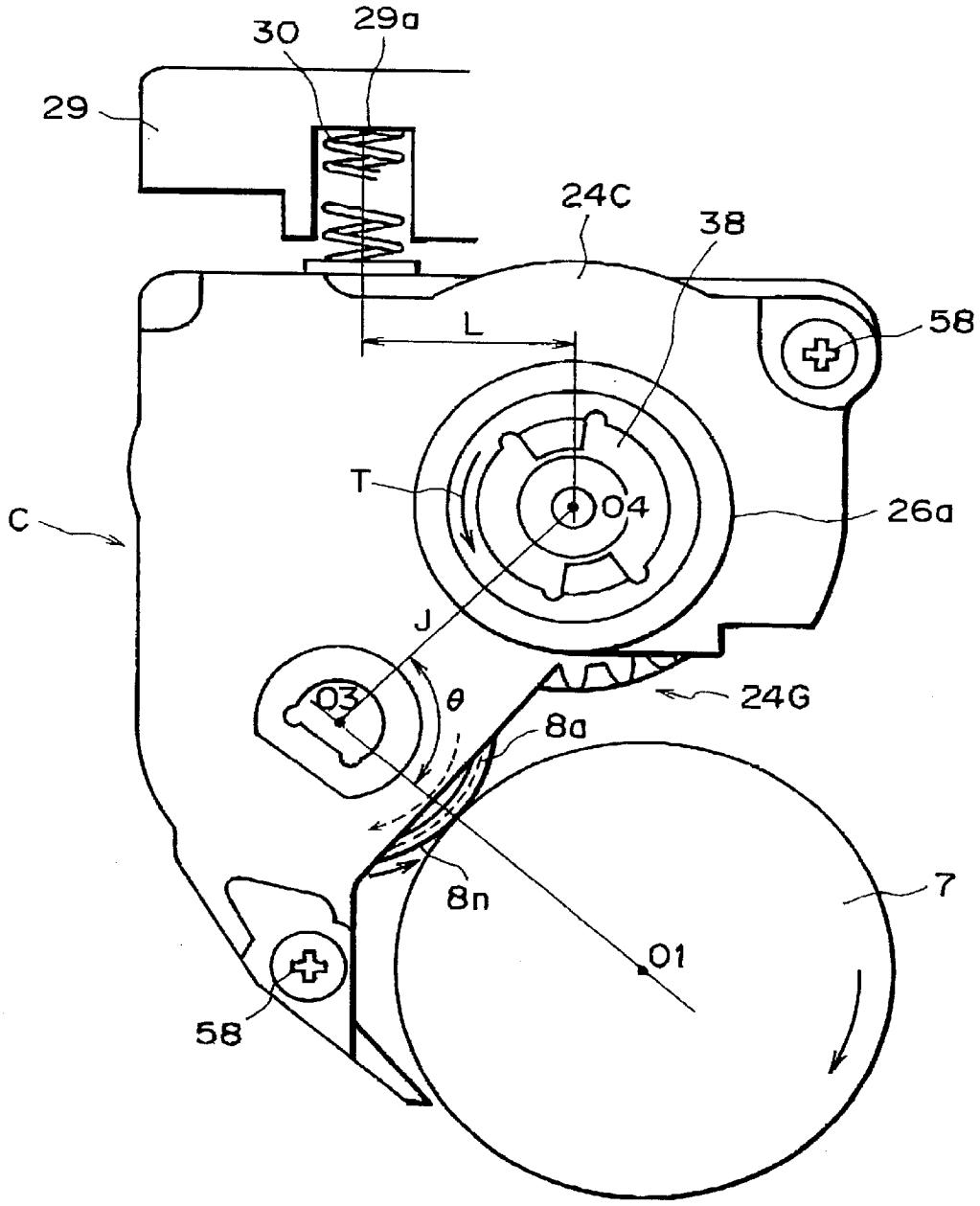
FIG. 33 is a rear view of the charging roller and its adjacencies, and shows the relationship, in terms of driving force, between the charging roller and the adjacent components involved in the driving of the charging roller.

FIG. 32 shows the load relationship when the rotational force is transmitted from the charging means couple to the charging unit which has the charge roller.

A gap is provided between the peripheral surfaces of the photosensitive drum 7 and the charge roller 8*a*. This gap is provided for a magnetic brush based charging process, in which not only is the photosensitive drum 7 charged, but also the transfer residual toner, or the toner remaining on the photosensitive drum 7 after image transfer, is taken in by the charge roller side, and sent back onto the photosensitive drum 7 after the polarity and potential level of the transfer residual toner are rectified. In order to create this gap, a pair of spacer rings 8*n* are rotatably fitted around a pair of the journal portions 8*a*2 of the charge roller 8*a*, one for one. The radius of each space ring 8*n* is greater than that of the charge roller 8*a* by an amount equivalent to the gap between the photosensitive drum 7 and charge roller 8*a*. The spacer rings 8*n* are kept in contact with the peripheral surface of the photosensitive drum 7, outside the charge station in terms of the longitudinal direction, by the pressure from unillustrated source and structural arrangement.

The photosensitive drum 7 and charge roller 8*a* rotate in the same direction. Thus, in the charge station, and the areas outside the charge station in terms of the longitudinal direction, the peripheral surfaces of the photosensitive drum 7 and charge roller 8*a* move in the opposite directions. Representing the centers of the charge roller 8*a* and charging means driving coupling 38 by o3 and o4, respectively, an angle θ which is formed by the line connecting the center o1 of the photosensitive drum 7 and the center of the charge roller 8*a*, and the line connecting the center o3 of the charge roller 8*a* and the center o4 of the charging means driving coupling 38, is a right angle. Incidentally, this angle θ has only to be an approximately right angle. Further, all that is necessary is that a configurational arrangement is made so that, the torque T transmitted to the charging means coupling 38 from the coupling 67 of the driving unit of the apparatus main assembly 14 presses the charge roller 8*a* upon the photosensitive drum 7, except for the angle range in which, as the angle θ increases and approaches 180°, the charge roller 8*a* is subjected to the force directed toward the photosensitive drum 7 due to the wedging function. In FIG. 32, the center o3 of the charge roller 8*a* must be on the left side of the line connecting the center o4 of the charging means coupling 38 and the center o1 of the photosensitive drum 7.

Because of the torque T which the charging means couple 38 receives, the charging unit C is pressured to rotate in the counterclockwise direction about the center of the cylindrical shaft portion 26*a* by which the charging unit C is supported, and the hole 23*a* (FIG. 11). Thus, representing the distance between the center o3 of the charge roller 8*a* and the center o4 of the charging means driving coupling portion 38 by J, a contact pressure of T/J is generated between the spacer ring 8*n* of the charge roller 8*a* and the photosensitive drum 7.

On the other hand, representing the distance between the center line of the compression coil spring 30 and the center o4 of the charging means driving coupling 38 by L, a torque of Fs·L, Fs being the force generated by the compression coil spring 30, is generated in the adjacencies of the cylindrical shaft portion 26*a* and the hole 23*a*. By this torque, a contact pressure of Fs·L/J is generated between the spacer ring 8*n* of the charge roller 8*a* and the photosensitive drum 7.

With the provision of the above described structural arrangement, even if the force which the compression coil spring 30 generates for pressing the charging unit C is relatively small, a sufficient amount of contact pressure is generated and maintained between the spacer ring 8*n* and the photosensitive drum 7 during an image forming operation. Therefore, it is possible to employ a compression coil spring with a smaller amount of resiliency, which in turn makes it possible to make the contact pressure, generated between the spacer ring 8*n* and the photosensitive drum 7 by the compression coil spring when the process cartridge B is not in use, small enough to prevent the spacer ring 8*n* from creeping due to the contact pressure.

(Cartridge Chamber Unit)

FIG. 34 shows one of the cartridge chamber unit. Each image forming portion is provided with a cartridge chamber unit 14*a* as shown in FIG. 34. This cartridge chamber unit 14*a* includes a cartridge guide 14*b* and the driving unit E. The cartridge guide 14*b* has a pair of guides 14*c*, which are perpendicular to the direction in which the recording medium 2 is conveyed, and are parallel to the surface of the recording medium 2. When the process cartridge B is inserted into, or removed from, the cartridge installation box 14*a*, the guide portions 12*a* and 29*b* of the process cartridge B are fitted into the pair of guides 14*c*. As the process cartridge B is inserted into the cartridge chamber unit 14*a*, the photosensitive drum driving coupling 37*d* (male coupling), charging means driving coupling 38, and developing means driving coupling 39, of the process cartridge B engage with couplings 66, 67, and 68 of the driving unit E.

With the provision of the above described cartridge chamber unit, the apparatus main assembly can be simplified with regard to the structure for transmitting the driving force to each of a plurality of process cartridges from its own driving force providing source.

The present invention could further improve the rotational accuracy of an electrophotographic photosensitive drum.

Further, the present invention makes it possible to more accurately position an electrophotographic photosensitive drum relative to the main assembly of an image forming apparatus when a process cartridge is installed into the apparatus main assembly.

Further, the present invention makes it possible to position an electrophotographic photosensitive drum and a cartridge frame, independently from each other, relative to the main assembly of an image forming apparatus, when a process cartridge is installed into the main assembly of an image forming apparatus.

While the invention has been described with reference to the structures disclosed herein. it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus, comprising:

a cartridge frame;

an electrophotographic photosensitive drum supported on said cartridge frame;

wherein said electrophotographic photosensitive drum has a leading end portion, with respect to a mounting direction in which said process cartridge is mounted to the main assembly of the electrophotographic image forming apparatus in the axial direction of said electrophotographic photosensitive drum, and is supported on said cartridge frame for movement in a direction crossing with the axial direction of said electrophotographic photosensitive drum;

process means actable on said electrophotographic photosensitive drum;

a cartridge drum positioning portion for positioning the leading end portion of said photosensitive drum to the main assembly of said apparatus by engagement with a main assembly drum positioning portion provided in the main assembly of said electrophotographic image forming apparatus when said process cartridge is mounted to the main assembly of the electrophotographic image forming apparatus, wherein said cartridge drum positioning portion is disposed substantially coaxially with said electrophotographic photosensitive drum;

a cartridge frame positioning portion for positioning said cartridge frame to the main assembly of the electrophotographic image forming apparatus by engagement with a main assembly frame positioning portion provided in the main assembly of the electrophotographic image forming apparatus when said process cartridge is mounted to the main assembly of the electrophotographic image forming apparatus;

wherein said cartridge frame positioning portion is disposed at a leading end portion of said process cartridge with respect to the mounting direction in which said process cartridge is mounted to the main assembly of the electrophotographic image forming apparatus.

2. A process cartridge according to claim 1, wherein said cartridge frame positioning portion is a positioning cylindrical portion extended in said cartridge frame in the mounting direction.

3. A process cartridge according to claim 2, wherein said positioning cylindrical portion is projected outwardly from a leading end surface of said cartridge frame, and said positioning cylindrical portion is extended from outside of said cartridge frame to inside thereof.

4. A process cartridge according to claim 2 or 3, wherein a rear side cylindrical portion is provided at a rear side of said positioning cylindrical portion, and a circular projected portion of a flange of said electrophotographic photosensitive drum enters an upstream side end of said rear side cylindrical portion in the mounting direction, and a gap of 0.2 mm–0.4 mm is provided between an inner surface of said rear side cylindrical portion and an outer surface of said circular projected portion, and said rear side cylindrical portion is disposed substantially coaxially with said positioning cylindrical portion.

5. A process cartridge according to claim 4, wherein said positioning cylindrical portion and said rear side cylindrical portion are made of resin material, and are integrally molded with an end cover of resin material as a part of said cartridge frame.

6. A process cartridge according to claim 4, further comprising a cartridge coupling, at a leading end of said circular projected portion, for receiving a driving force for rotating said electrophotographic photosensitive drum through a main assembly coupling provided in the main assembly of the electrophotographic image forming apparatus when said process cartridge is mounted to the main assembly of the electrophotographic image forming apparatus.

7. A process cartridge according to claim 6, wherein said cartridge drum positioning portion is in the form of a recess formed substantially at the center of said cartridge coupling.

8. A process cartridge according to claim 2 or 3, wherein the inner diameter of said positioning cylindrical portion is 25 mm–27 mm, and the length thereof is 8 mm–10 mm.

9. A process cartridge according to claim 1, wherein said cartridge drum positioning portion is a recess formed at the center of a flange of said electrophotographic photosensitive drum, wherein said flange is mounted to a downstream side end of a cylinder of said electrophotographic photosensitive drum.

10. A process cartridge according to claim 9, wherein said flange has a circular projected portion, and a free end of said circular projected portion is provided with a cartridge coupling for receiving a driving force for rotating said electrophotographic photosensitive drum through a main assembly coupling provided in the main assembly of said electrophotographic image forming apparatus, wherein said recess is disposed substantially at center portions of said cartridge coupling and said circular projected portion.

11. A process cartridge according to claim 10, wherein said cartridge coupling has a substantially triangular prism which is twisted, and said main assembly coupling has a twisted hole having a substantially triangular cross-section, wherein corner portions of the substantially triangular prism are beveled, and said recess comprising said cartridge drum positioning portion is provided substantially at the center of said substantially triangular prism.

12. A process cartridge according to claim 10, wherein when said process cartridge is mounted to the main assembly of said electrophotographic image forming apparatus, a driving shaft as said main assembly drum positioning portion provided in the main assembly of the electrophotographic image forming apparatus is engaged with said recess, and the main assembly coupling provided at a free end portion or leading end portion of said driving shaft is engaged with said cartridge coupling, by which the position of said electrophotographic photosensitive drum in a direction crossing with the axial direction is determined, and a rotating force for rotating said electrophotographic photosensitive drum is transmitted from the main assembly of said electrophotographic image forming apparatus, wherein said driving shaft is rotatable by a driving force from a motor provided in the main assembly of the electrophotographic image forming apparatus.

13. A process cartridge according to claim 12, wherein the amount of press-fitting is 10 $\mu$m and a gap between said driving shaft and said recess is 30 $\mu$m in a direction crossing with an axis of said driving shaft.

14. A process cartridge according to claim 1 or 13, wherein an upstream side end of said electrophotographic photosensitive drum with respect to a mounting direction, is rotatably supported on said cartridge frame so as not to be movable in a direction crossing the axial direction of the electrophotographic photosensitive drum.

15. A process cartridge according to claim 1, wherein said process means includes at least one of developing means for developing an electrostatic latent image formed on said electrophotographic photosensitive drum, charging means for charging said electrophotographic photosensitive drum, and cleaning means for removing a developer remaining on said electrophotographic photosensitive drum.

16. A process cartridge according to claim 1, 2, 3, 9, 10 or 15, wherein said cartridge frame positioning portion is disposed so as to be coaxial with the electrophotographic photosensitive drum when said cartridge drum positioning portion is engaged with the main assembly drum positioning portion so that said electrophotographic photosensitive drum is positioned to the main assembly of the electrophotographic image forming apparatus.

17. A process cartridge detachably mountable to a main assembly of an electrophotographic image forming apparatus, comprising:

a cartridge frame;

an electrophotographic photosensitive drum supported on said cartridge frame;

wherein said electrophotographic photosensitive drum has a leading end portion, with respect to a mounting direction in which said process cartridge is mounted to the main assembly of the electrophotographic image forming apparatus in the axial direction of said electrophotographic photosensitive drum, and is supported on said cartridge frame for movement in a direction crossing with the axial direction of said electrophotographic photosensitive drum;

a developing roller for developing an electrostatic latent image formed on said electrophotographic photosensitive drum;

a charging roller for charging said electrophotographic photosensitive drum;

a cartridge drum positioning recess for positioning said electrophotographic photosensitive drum to the main assembly of the electrophotographic image forming apparatus by engagement with a main assembly drum positioning portion provided in the main assembly of the electrophotographic image forming apparatus when said process cartridge is mounted to the main assembly of the electrophotographic image forming apparatus;

wherein said cartridge drum positioning recess is disposed coaxially with said electrophotographic photosensitive drum, and said cartridge drum positioning recess is provided at a center of a circular projected portion of a flange of said electrophotographic photosensitive drum, and wherein said flange is mounted at one end portion of a cylinder of said electrophotographic photosensitive drum in the axial direction of said electrophotographic photosensitive drum, a positioning cylindrical portion for positioning said cartridge frame to the main assembly of the apparatus by engagement with a main assembly frame positioning portion provided in the main assembly of the electrophotographic image forming apparatus when said process cartridge is mounted to the main assembly of the apparatus;

wherein said positioning cylindrical portion is disposed at a leading end of said process cartridge, with respect to the mounting direction in which said process cartridge is mounted to the main assembly of the apparatus, and said positioning cylindrical portion is disposed such that it is coaxial with said electrophotographic photosensitive drum when said electrophotographic photosensitive drum is positioned to the main assembly of the apparatus by engagement of said cartridge drum positioning recess with the main assembly drum positioning portion, wherein said positioning cylindrical portion is extended in the mounting direction on said cartridge frame, wherein said positioning cylindrical portion is outwardly projected from a free end surface of said cartridge frame, and wherein said positioning cylindrical portion is extended from outside to inside of said cartridge frame; and a cartridge coupling for reception of a driving force for rotating said electrophotographic photosensitive drum through a main assembly coupling provided in the main assembly of the electrophotographic image forming apparatus when said process cartridge is mounted to the main assembly of the electrophotographic image forming apparatus, and said cartridge drum positioning recess is disposed at a center of said cartridge coupling and said circular projected portion.

18. A process cartridge according to claim 17, wherein a rear side cylindrical portion is provided at a rear side of the positioning cylindrical portion, and said circular projected portion enters an upstream side end of said rear side cylindrical portion, wherein a gap of 0.2–0.4 mm is formed between an inner surface of said rear side cylindrical portion and an outer surface of said circular projected portion, wherein said rear side cylindrical portion is substantially coaxial with said positioning cylindrical portion.

19. A process cartridge according to claim 18, wherein the inner diameter of said positioning cylindrical portion is 25 mm–27 mm, and the length thereof is 8 mm–10 mm.

20. A process cartridge according to claim 18 or 19, wherein said positioning cylindrical portion and rear side cylindrical portion are made of resin material, and are integrally molded with an end cover of resin material as a part of said cartridge frame.

21. A process cartridge according to claim 17, wherein said cartridge coupling has a substantially triangular prism which is twisted, and the main assembly coupling has a twisted hole having a substantially triangular cross-section, wherein corner portions of the substantially triangular prism are beveled, and said cartridge drum positioning recess as a cartridge drum positioning portion is provided substantially at the center of said substantially triangular prism.

22. A process cartridge according to claim 17, 18, or 19, wherein when said process cartridge is mounted to the main assembly of said apparatus, a driving shaft as said main assembly drum positioning portion provided in the main assembly of the electrophotographic image forming apparatus is engaged with said cartridge drum positioning recess, and the main assembly coupling, provided at a free end portion or leading end portion of said driving shaft, is engaged with said cartridge coupling, by which the position of said electrophotographic photosensitive drum in a direction crossing the axial direction of said electrophotographic photosensitive drum is determined, and a rotating force for rotating said electrophotographic photosensitive drum is transmitted from the main assembly of said electrophotographic image forming apparatus, wherein said driving shaft is rotatable by a driving force from a motor provided in the main assembly of the electrophotographic image forming apparatus.

23. A process cartridge according to claim 22, wherein the amount of press-fitting is 10 μm and a gap between said driving shaft and said cartridge drum positioning recess is 30 μm in a direction crossing with an axis of said driving shaft.

24. A process cartridge according to claim 22, wherein an upstream side end of said electrophotographic photosensitive drum with respect to the mounting direction, is rotatably supported on said cartridge frame so as not to be movable in a direction crossing with the axial direction of the electrophotographic photosensitive drum.

25. An electrophotographic image forming apparatus for forming an image on a recording material, to which a process cartridge is detachably mountable, comprising:

(a) a main assembly drum positioning portion;

(b) a main assembly frame positioning portion;

(c) a mounting member for detachably mounting a process cartridge, the process cartridge including:

a cartridge frame;

an electrophotographic photosensitive drum supported on the cartridge frame;

wherein the electrophotographic photosensitive drum has a leading end portion, with respect to a mounting direction in which the process cartridge is mounted to a main assembly of said electrophotographic image forming apparatus in the axial direction of the electrophotographic photosensitive drum, and is supported on the cartridge frame for movement in a direction crossing with the axial direction of the electrophotographic photosensitive drum;

process means actable on the electrophotographic photosensitive drum;

a cartridge drum positioning portion for positioning the electrophotographic photosensitive drum to the main assembly of said electrophotographic image forming apparatus by engagement with said main assembly drum positioning portion when the process cartridge is mounted to the main assembly of said electrophotographic image forming apparatus, wherein the cartridge drum positioning portion is disposed coaxial with the electrophotographic photosensitive drum; and a cartridge frame positioning portion for positioning the cartridge frame to the main assembly of said electrophotographic image forming apparatus by engagement with said main assembly frame positioning portion when the process cartridge is mounted to the main assembly of said electrophotographic image forming apparatus, wherein the cartridge frame positioning portion is disposed at a leading end portion of the process cartridge with respect to the mounting direction in which the process cartridge is mounted to the main assembly of said electrophotographic image forming apparatus.

26. An electrophotographic image forming apparatus for forming an image on a recording material, to which a process cartridge is detachably mountable, comprising:

(a) a main assembly drum positioning portion;

(b) a main assembly frame positioning portion;

(c) a main assembly coupling;

(d) a mounting member for detachably mounting a process cartridge, the process cartridge including:

a cartridge frame;

an electrophotographic photosensitive drum supported on the cartridge frame;

wherein the electrophotographic photosensitive drum has a leading end portion, with respect to a mounting direction in which the process cartridge is mounted to a main assembly of the electrophotographic image forming apparatus in the axial direction of the electrophotographic photosensitive drum, and is supported on the cartridge frame for movement in a direction crossing with the axial direction of the electrophotographic photosensitive drum;

a developing roller for developing an electrostatic latent image formed on the electrophotographic photosensitive drum;

a charging roller for charging the electrophotographic photosensitive drum;

a cartridge drum positioning recess for positioning the electrophotographic photosensitive drum to the main assembly said electrophotographic image forming apparatus by engagement with the main assembly drum positioning portion when the process cartridge is mounted to the main assembly of said electrophotographic image forming apparatus, wherein the cartridge drum positioning recess is disposed coaxially with the electrophotographic photosensitive drum, and the cartridge drum positioning recess is provided at the center of a circular projected portion of a flange of the electrophotographic photosensitive drum, and wherein the flange is mounted at one end portion of a cylinder of the electrophotographic photosensitive drum in an axial direction of the electrophotographic photosensitive drum;

a positioning cylindrical portion for positioning the cartridge frame to the main assembly of said electrophotographic image forming apparatus by engagement with said main assembly frame positioning portion when the process cartridge is mounted to the main assembly of said electrophotographic image forming apparatus;

wherein the positioning cylindrical portion is disposed at a leading end, with respect to the mounting direction in which the process cartridge is mounted to the main assembly of said electrophotographic image forming apparatus, and the positioning cylindrical portion is disposed such that it is coaxial with the electrophotographic photosensitive drum when the electrophotographic photosensitive drum is positioned to the main assembly of said electrophotographic image forming apparatus by engagement of the cartridge drum positioning recess with said main assembly drum positioning portion, wherein the positioning cylindrical portion is extended along the mounting direction on the cartridge frame, and the positioning cylindrical portion is projected outwardly from a free end surface of the cartridge frame, and the positioning cylindrical portion is extended from outside to inside of the cartridge frame; and a cartridge coupling for receiving a driving force for rotating the electrophotographic photosensitive drum through a main assembly coupling provided in the main assembly of said electrophotographic image forming apparatus when the process cartridge is mounted to the main assembly of said electrophotographic image forming apparatus, and the cartridge drum positioning recess is disposed at a center of the cartridge coupling and the circular projected portion.

* * * * *

UNITED STATES PATENT AND TRADEMARK OFFICE

CERTIFICATE OF CORRECTION

PATENT NO. : 6,608,980 B2 
DATED : August 19, 2003
INVENTOR(S) : Kazunari Murayama et al.

It is certified that error appears in the above-identified patent and that said Letters Patent is hereby corrected as shown below:

Title page,
Item [30], Foreign Application Priority Data, "Dec. 27, 2000" should read -- Dec. 7, 2000 --.

Column 35,
Line 55, reads "apparatus;" should read -- apparatus, --.

Signed and Sealed this

Eighteenth Day of May, 2004

JON W. DUDAS
*Acting Director of the United States Patent and Trademark Office*